US010105020B2

(12) United States Patent
Carper et al.

(10) Patent No.: US 10,105,020 B2
(45) Date of Patent: Oct. 23, 2018

(54) DUAL ROLL PAPER TOWEL DISPENSER

(71) Applicant: Wausau Paper Towel & Tissue, LLC, Mosinee, WI (US)

(72) Inventors: Ken Carper, Cincinnati, OH (US); Adam Elliott, Lexington, KY (US); Mark Henson, Danville, KY (US); Dan Knight, Lexington, KY (US); Steven Roy Streicher, Cincinnati, OH (US)

(73) Assignee: Wausau Paper Towel & Tissue, LLC, Mosinee, WI (US)

( * ) Notice: Subject to any disclaimer, the term of this patent is extended or adjusted under 35 U.S.C. 154(b) by 797 days.

(21) Appl. No.: 14/531,675

(22) Filed: Nov. 3, 2014

(65) Prior Publication Data

US 2015/0157177 A1 Jun. 11, 2015

Related U.S. Application Data

(60) Provisional application No. 61/904,326, filed on Nov. 14, 2013, provisional application No. 61/899,748, filed on Nov. 4, 2013.

(51) Int. Cl.

| | |
|---|---|
| ***A47K 10/38*** | (2006.01) |
| ***A47K 10/36*** | (2006.01) |
| *A47K 10/32* | (2006.01) |

(52) U.S. Cl.

CPC ..... *A47K 10/38* (2013.01); *A47K 10/3656* (2013.01); *A47K 10/3643* (2013.01);
(Continued)

(58) Field of Classification Search

CPC .... A47K 10/36; A47K 10/38; A47K 10/3656; A47K 10/3643; A47K 2010/326; A47K 2010/3668; A47K 2010/3253

See application file for complete search history.

(56) References Cited

U.S. PATENT DOCUMENTS 2,826,373 A * 3/1958 Schwartz ..... A47K 10/36 225/14
3,007,650 A 11/1961 Burton
(Continued)

FOREIGN PATENT DOCUMENTS

EP 0 522 477 B1 10/1995
EP 1 915 080 B1 12/2008

OTHER PUBLICATIONS

International Search Report and Written Opinion for Application No. PCT/US2014/063741 dated Jul. 13, 2015.
(Continued)

*Primary Examiner* — William A. Rivera
(74) *Attorney, Agent, or Firm* — Merchant & Gould P.C.

(57) ABSTRACT

A dual roll paper towel dispenser, a method of dispensing towel from a dual roll paper towel dispenser, and a method of servicing a dual roll paper towel dispenser are disclosed herein. The dual roll paper towel dispenser can be provided with a dispenser mechanism disposed in a dispenser housing. The dispenser mechanism can include a first drive roller for dispensing paper from an upper first roll of paper and a second drive roller for dispensing paper from a lower second roll of paper. The dispenser mechanism can further include a drive system including a motor for selectively operating the first drive roller and the second drive roller, wherein the drive system powers the motor in a first rotational direction to actuate the first drive roller and powers the motor in a second rotational direction opposite the first rotational direction to actuate the second drive roller.

22 Claims, 56 Drawing Sheets

(52) U.S. Cl.
CPC *A47K 2010/326* (2013.01); *A47K 2010/3253* (2013.01); *A47K 2010/3668* (2013.01)

(56) References Cited

U.S. PATENT DOCUMENTS

| | | | | |
|---|---|---|---|---|
| 3,132,782 | A | 5/1964 | Coates, Jr. | |
| 3,737,087 | A * | 6/1973 | Rooklyn | A47K 10/36 225/23 |
| 4,148,442 | A * | 4/1979 | Baumann | A47K 10/3687 242/560.1 |
| 4,260,117 | A * | 4/1981 | Perrin | A47K 10/3687 242/564.2 |
| 4,432,482 | A * | 2/1984 | Beausoleil | A47K 10/36 225/46 |
| 4,634,192 | A * | 1/1987 | Fielding | A47K 10/28 242/560.1 |
| 5,400,982 | A | 3/1995 | Collins | |
| 6,412,679 | B2 | 7/2002 | Formon et al. | |
| 6,426,701 | B1 | 7/2002 | Levy et al. | |
| 6,592,067 | B2 | 7/2003 | Denen et al. | |
| 6,685,074 | B2 | 2/2004 | Gracyalny et al. | |
| 6,736,348 | B1 | 5/2004 | Formon et al. | |
| 6,742,689 | B2 | 6/2004 | Formon et al. | |
| 6,892,620 | B2 | 5/2005 | Kapiloff | |
| 6,903,654 | B2 | 6/2005 | Hansen et al. | |
| 6,977,588 | B2 | 12/2005 | Schotz et al. | |
| 7,040,566 | B1 | 5/2006 | Rodrian et al. | |
| 7,182,288 | B2 | 2/2007 | Denen et al. | |
| 7,296,765 | B2 | 11/2007 | Rodrian | |
| 7,341,170 | B2 | 3/2008 | Boone | |
| 7,380,748 | B2 | 6/2008 | Goeking et al. | |
| 7,398,944 | B2 | 7/2008 | Lewis et al. | |
| 7,523,885 | B2 | 4/2009 | Lewis | |
| 7,533,845 | B2 | 5/2009 | Neveu et al. | |
| 7,554,084 | B2 | 6/2009 | Mok et al. | |
| 7,594,622 | B2 | 9/2009 | Witt et al. | |
| 7,698,980 | B2 | 4/2010 | Morris et al. | |
| 7,726,599 | B2 | 6/2010 | Lewis et al. | |
| 7,735,770 | B2 | 6/2010 | Conner | |
| 7,774,096 | B2 | 8/2010 | Goerg et al. | |
| 7,783,380 | B2 | 8/2010 | York et al. | |
| 7,793,882 | B2 | 9/2010 | Reinsel et al. | |
| 7,795,584 | B2 | 9/2010 | Mok et al. | |
| 7,821,155 | B2 | 10/2010 | Reinsel et al. | |
| 7,837,077 | B2 | 11/2010 | Formon et al. | |
| 7,845,593 | B2 | 12/2010 | Formon et al. | |
| 7,878,446 | B2 | 2/2011 | Reinsel et al. | |
| 7,931,228 | B2 | 4/2011 | Omdoll | |
| 7,963,475 | B2 | 6/2011 | Rodrian | |
| 7,984,872 | B2 | 7/2011 | Kuehneman et al. | |
| 8,066,217 | B2 | 11/2011 | Cittadino et al. | |
| 8,082,827 | B2 | 12/2011 | Friesen et al. | |
| 8,082,828 | B2 | 12/2011 | Formon et al. | |
| 8,160,742 | B2 | 4/2012 | Goerg et al. | |
| 8,165,716 | B1 | 4/2012 | Goeking et al. | |
| 8,186,551 | B2 | 5/2012 | Morris et al. | |
| 8,651,003 | B1 * | 2/2014 | Vercellone | B26D 5/16 242/598.6 |
| 9,370,283 | B2 * | 6/2016 | Fellhoelter | A47K 10/3687 |
| 2005/0171634 | A1 | 8/2005 | York et al. | |
| 2007/0152010 | A1 | 7/2007 | Denen et al. | |
| 2007/0194166 | A1 | 8/2007 | Reinsel et al. | |
| 2007/0194167 | A1 | 8/2007 | Denen et al. | |
| 2008/0011772 | A1 | 1/2008 | Morris et al. | |
| 2008/0018302 | A1 | 1/2008 | Reinsel et al. | |
| 2008/0048064 | A1 | 2/2008 | Lemaire et al. | |
| 2008/0078777 | A1 | 4/2008 | Cittadino et al. | |
| 2008/0087758 | A1 | 4/2008 | Formon et al. | |
| 2008/0217350 | A1 | 9/2008 | Hansen et al. | |
| 2008/0245922 | A1 * | 10/2008 | Fellhoelter | A47K 10/36 242/554.6 |
| 2009/0101751 | A1 | 4/2009 | Cittadino et al. | |
| 2009/0120952 | A1 | 5/2009 | Cattacin et al. | |
| 2009/0177315 | A1 | 7/2009 | Goeking et al. | |
| 2009/0217870 | A1 | 9/2009 | Luu | |
| 2010/0044407 | A1 | 2/2010 | Yardley | |
| 2010/0170979 | A1 | 7/2010 | Lewis et al. | |
| 2010/0286817 | A1 | 11/2010 | Goeking et al. | |
| 2010/0286818 | A1 | 11/2010 | Goeking et al. | |
| 2011/0114782 | A1 | 5/2011 | Rodrian et al. | |
| 2012/0167739 | A1 | 7/2012 | Lewis et al. | |
| 2012/0255413 | A1 * | 10/2012 | Osborne, Jr. | A47K 10/3687 83/436.5 |
| 2013/0161346 | A1 * | 6/2013 | Wolme | A47K 10/38 221/26 |
| 2015/0238056 | A1 * | 8/2015 | Fellhoelter | A47K 10/3687 242/560 |

OTHER PUBLICATIONS

Partial International Search Report for Application No. PCT/US2014/063741 dated May 7, 2015.

* cited by examiner

306

308

DUAL ROLL PAPER TOWEL DISPENSER

RELATED APPLICATIONS

This application claims priority to U.S. Provisional Application Ser. No. 61/904,326, filed Nov. 14, 2013 and U.S. Provisional Patent Application Ser. No. 61/899,748, filed Nov. 4, 2013, the entireties of which are hereby incorporated herein by reference.

BACKGROUND

Dual roll paper towel dispensers are advantageous because they permit dispensing from one paper roll and then, once the paper from that paper roll is exhausted, they permit dispensing from a second paper roll held in reserve. A paper towel dispenser that permits sequential dispensing of the rolls is advantageous because it allows a roll to become depleted of paper towel before a custodian or janitor replaces the depleted roll with a new roll. In single roll paper towel dispensers, a custodian may replace a non-depleted paper roll thereby creating waste and added cost. In addition, not all dual roll paper towel dispensers encourage complete consumption of the paper from a paper roll.

One type of dual roll paper towel dispenser includes two rolls of paper towel arranged side by side. This type of arrangement can be referred to as a horizontally arranged dispenser and generally requires that the dispenser occupy a length of wall corresponding to the length of at least two paper rolls. See U.S. Pat. No. 4,260,117. Another type of dual roll paper towel dispenser includes two rolls arranged vertically with respect to each other. Such dispensers can be referred to as vertically arranged dispensers. See U.S. Pat. Nos. 3,288,387; 4,165,138; 4,206,858; and 6,145,779. Certain vertically arranged dual roll paper towel dispensers include a transfer mechanism that permits a paper towel transfer from a depleted primary roll to a secondary roll held in reserve wherein both rolls dispense through the same drive roller and nip roller. Such designs can be difficult to service. For example, in some cases, the custodian may need to move the secondary roll to the primary roll position, and then install a new secondary roll. Because of the complexity, there is an increased chance that the dispenser may not be serviced correctly.

Several electronic dual roll paper towel dispenser designs are available. For example, see U.S. Pat. Nos. 7,354,015; 7,325,768; 7,325,767; 6,695,246; and 6,988,689.

SUMMARY

In general terms, this disclosure is directed to a dual roll paper towel dispenser, a method of dispensing towel from a dual roll paper towel dispenser, and a method of servicing a dual roll paper towel dispenser. Unlike traditional roll towel dispensers, the disclosed dual roll paper towel dispenser accommodates two full rolls of towels with no need to move or prematurely replace stub rolls. The disclosed design automatically transfers dispensing functions to the second roll when the first roll is completely depleted, keeping high-traffic areas up and running while reducing maintenance. Alternating dispensing and simultaneous dispensing from the first and second rolls are also possible with the disclosed design.

In one example, a dual roll paper towel dispenser is provided having a dispenser mechanism and a dispenser housing constructed to receive a first roll of paper on an upper mandrel and a second roll of paper on a lower mandrel. The dispenser mechanism can include a first drive roller for dispensing paper from the first roll of paper and a second drive roller for dispensing paper from the second roll of paper. The dispenser mechanism can further include a drive system including a motor for selectively operating the first drive roller and the second drive roller, wherein the drive system powers the motor in a first rotational direction to actuate the first drive roller and powers the motor in a second rotational direction opposite the first rotational direction to actuate the second drive roller.

In one aspect and by non-limiting example, a dual roll paper towel dispenser includes a dispenser housing constructed to receive a first roll of paper and a second roll of paper where the first roll of paper and the second roll of paper are vertically arranged so that the first roll of paper is located vertically above the second roll of paper when the dispenser is mounted on a wall and a dispenser opening for dispensing paper from the first roll of paper and the second roll of paper. The dual roll paper towel dispenser includes a first mandrel for holding the first roll of paper within the dispenser housing, a second mandrel for holding the second roll of paper within the housing and a dispenser mechanism. The dispenser mechanism includes a first drive roller and a first nip roller for dispensing paper from the first roll of paper through the dispenser opening, a second drive roller and a second nip roller for dispensing paper from the second roll of paper through the dispenser opening, and a motor for powering the first drive roller and the second drive roller.

Another aspect is a method of dispensing towel from a dual roll paper towel dispenser. The method includes arranging a first roll of paper on a first mandrel and arranging a second roll of paper on a second mandrel. The dispenser is mounted on a wall and the first roll of paper and the second roll of paper are located within a dispenser housing having a dispenser opening in a front wall of the housing, the dispenser includes a dispenser mechanism comprising a first drive roller and a first nip roller, and a second drive roller and a second nip roller, and paper from the first roll of paper is located between the first drive roller and the first nip roller, and paper from the second roll of paper is located between the second drive roller and the second nip roller. The method includes dispensing the paper from the first roll of paper through the dispenser opening or dispensing the paper from the second roll of paper through the dispenser opening.

A further aspect is a method of servicing a dual roll paper towel dispenser. The method includes supplying paper to a dual roll dispenser so that a first roll of paper is located on a first mandrel and a second roll of paper is located on a second mandrel. The dispenser is mounted on a wall, the first roll of paper and the second roll of paper are located within a dispenser housing having a dispenser opening in a front wall of the housing, the dispenser includes a dispenser mechanism comprising a first drive roller and a first nip roller, and a second drive roller and a second nip roller, and paper from the first roll of paper is located between the first drive roller and the first nip roller, and paper from the second roll of paper is located between the second drive roller and the second nip roller.

A method of monitoring and operating the dual roll paper towel dispenser is also disclosed and can include the steps of: detecting that one or more rolls in the dispenser is empty when a paper sensor does not detect paper after two consecutive dispensing cycles from the same roll; monitoring an opened and closed status of a door of the dispenser; conducting a paper loading operation for each roll that has been detected as being empty when the door status has changed from opened to closed; recording that a new roll has been loaded into the dispenser when the paper sensor detects that a sheet has been dispensed; and resetting a direction setting of the motor to match a setting that existed prior to the paper loading operation.

A method of identifying a paper jam in a dual roll paper towel dispenser is also disclosed and can include the steps of: monitoring the back-EMF of a motor during a coast period during a dispensing operation using a pulse counter; identifying a paper jam fault when the back-EMF pulse counter value is below a threshold value; and setting the roll status to a jammed status.

A method of controlling the dispense time for a dual roll paper towel dispenser is also disclosed including the steps of: monitoring the back-EMF of a motor during a coast period during a dispensing operation using a pulse counter; monitoring a battery voltage during a dispensing operation; calculating a first dispense time for the motor to maintain a desired dispensed sheet length based on the difference between measured battery voltage and a nominal battery voltage; calculating a second dispense time for the motor to maintain a desired dispensed sheet length based on the motor back-EMF pulse count; and selecting the greater of the first and second dispense times to set the dispense time for the motor in the next dispensing operation.

A method of calibrating a paper sensor in a paper towel dispenser is also disclosed including the steps of: initiating a paper sensor calibration routine when paper is not present in a chute of the dispenser; activating a light emitter of the paper sensor; incrementing the light emitter intensity upward until the paper sensor receiver detects light reflecting from chute to establish a reflection value; and setting the light emitter intensity to a value that is lower than the intensity associated with the reflection value.

A method of setting a hand sensor sensing range in a paper towel dispenser is also disclosed including: establishing a normal sensing range for the hand sensor, the normal sensing range being associated with a first distance; establishing a low sensing range for the hand sensor, the low sensing range being associated with a second distance that is less than the first distance; determining if paper is present in a chute of the dispenser; setting the hand sensor to operate with the normal sensing range when no paper is detected in the chute and when paper is in the chute for a period of time that is less than a predetermined threshold; and setting the hand sensor to operate with the low sensing range when paper has been present in the chute for a period of time that is greater than the predetermined threshold.

DETAILED DESCRIPTION

Figure 1:
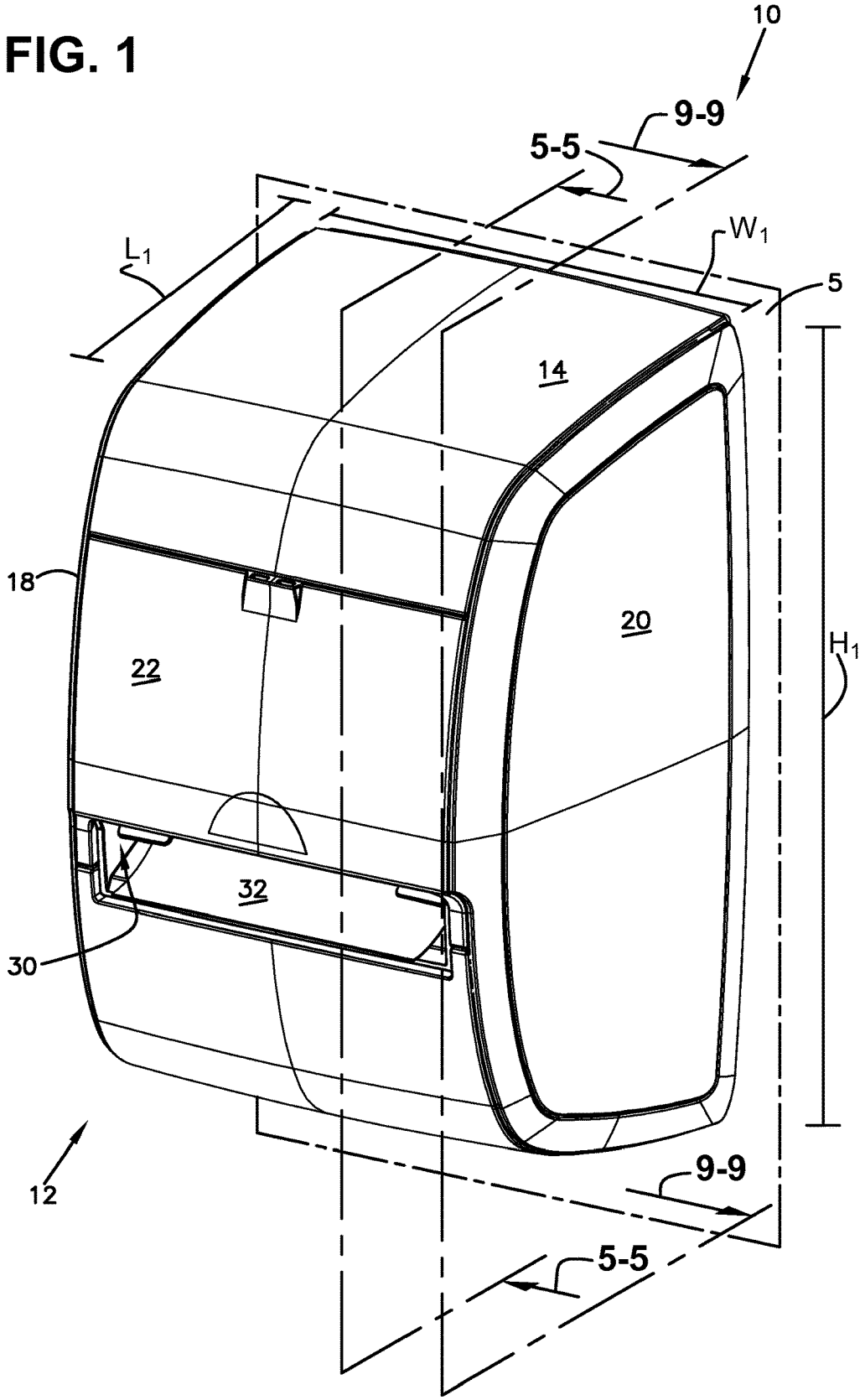
FIG. 1 is a front perspective view of an example electronic paper towel dispenser mounted on a wall in accordance with the principles of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 is a front perspective view of an example electronic dual roll paper towel dispenser 10 mounted on a wall 5. The example electronic dual roll paper towel dispenser 10 can be mounted to the wall 5 or other supporting member by any conventional means such as, but not limited to, brackets, adhesive, nails, screws or anchors (not shown). The example electronic dual roll paper towel dispenser 10 includes a housing 12 having a main body 14, a back wall 16, two side doors 18, 20, and an openable and closable front cover 22. The housing 12 may be made out of stainless steel, aluminum, plastic or other types of materials, or other types of substantially non-corrosive materials. In certain examples, the main body 14, two side doors 18, 20 and the front cover 22 can be made from a material having a gloss finish.

In one example, the electronic dual roll paper towel dispenser 10 can have a height $H_1$ from about 18 inches to about 22 inches. In one embodiment, the height $H_1$ can range from about 19 inches to about 21 inches. It will be appreciated that at the electronic dual roll paper towel dispenser 10 can be configured and arranged with a variety of heights $H_1$.

In one example, the electronic dual roll paper towel dispenser 10 can have a width $W_1$ from about 9 inches to about 15 inches. In one embodiment, the width $W_1$ can range from about 11 inches to about 14 inches. It will be appreciated that at the electronic dual roll paper towel dispenser 10 can be configured and arranged with a variety of widths $W_1$.

In one example, the electronic dual roll paper towel dispenser 10 can have a length $L_1$ from about 8 inches to about 14 inches. In one embodiment, the length $L_1$ can range from about 9 inches to about 13 inches. It will be appreciated that at the electronic dual roll paper towel dispenser 10 can be configured and arranged with a variety of lengths $L_1$.

Figure 2:
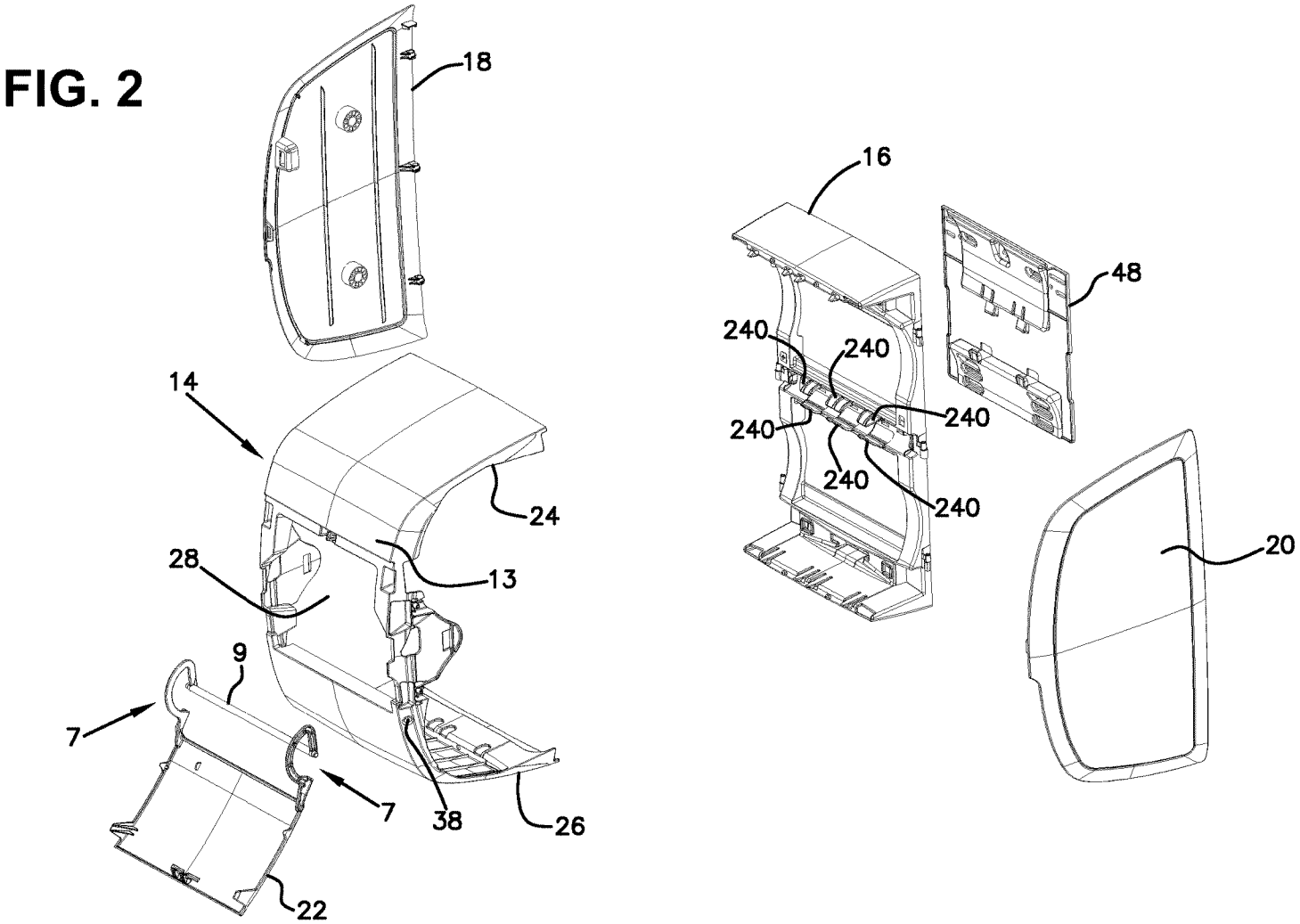
FIG. 2 is an exploded view of the electronic paper towel dispenser shown in FIG. 1.

Referring to FIG. 2, the main body 14 of the housing 12 can include a top portion 24, a bottom portion 26, and a front wall 13. In certain examples, the top and bottom portions 24, 26 and front wall 13 can be unitarily formed with the main body 14 of the housing 12. In other examples, the top and bottom portions 24, 26 and the front wall 13 can be coupled to the main body 14 of the housing 12. The housing 12 defines an opening 28 that can be covered by the front cover 22.

In one example, the front cover 22 defines a slot 30 near a bottom of the main body 14 for dispensing paper towels 32 (see FIG. 1) therethrough. The front cover 22 can include swing arms 7 attached at opposite sides of the front cover 22 near a lower portion 11 thereof. The swing arms 7 can each include a rod 9 for attaching the front cover 22 to the main body 14 of the housing 12. In one example, the rod 9 can rests in a pivot point 38 defined by the main body 14 of the housing 12.

Figures 3, 4:
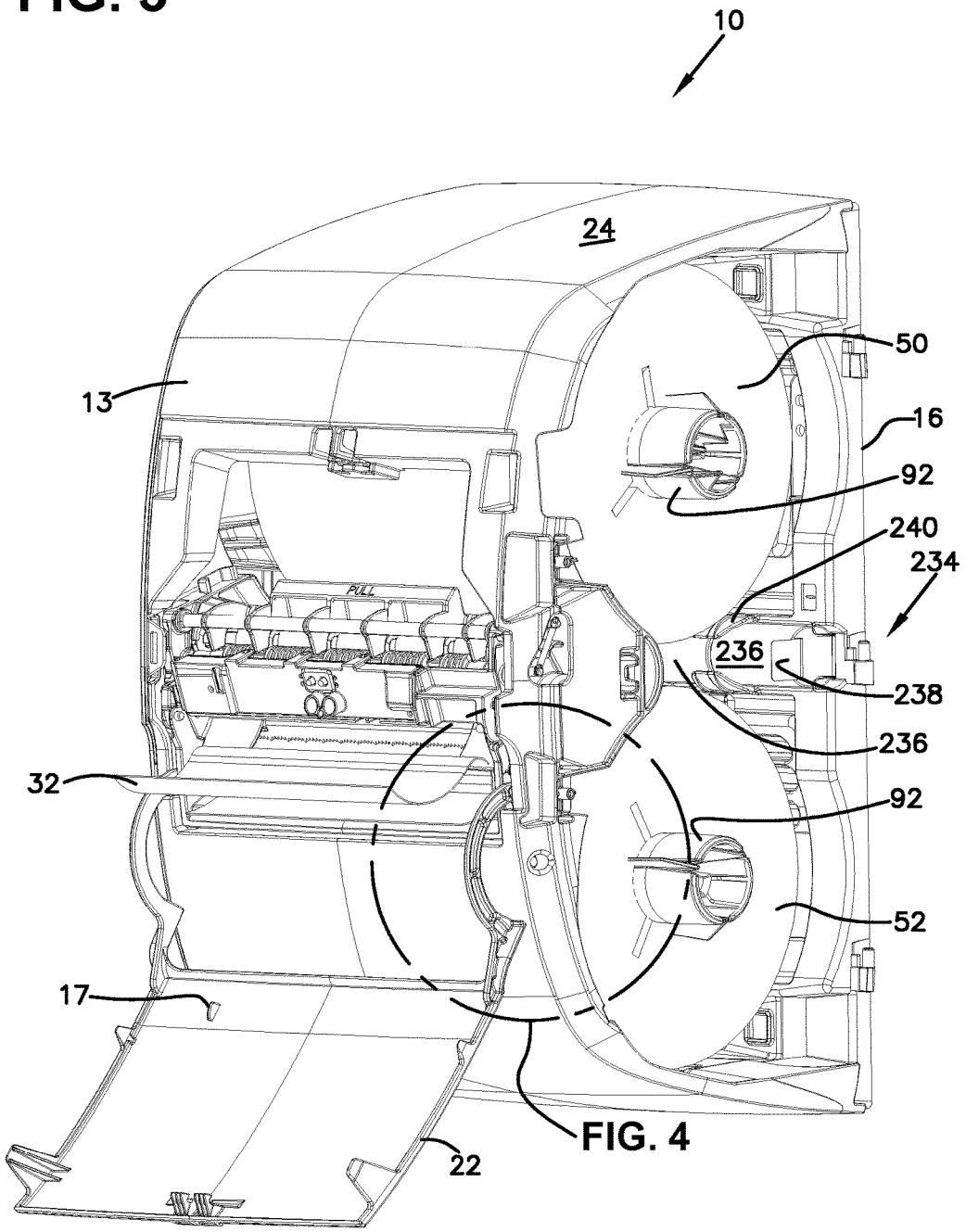
FIG. 3 is a perspective view of the electronic dual roll paper towel dispenser shown in FIG. 1 with two side doors removed and front cover open.
FIG. 4 is an enlarged view of a portion of the front cover shown in FIG. 3.
Figure 4:
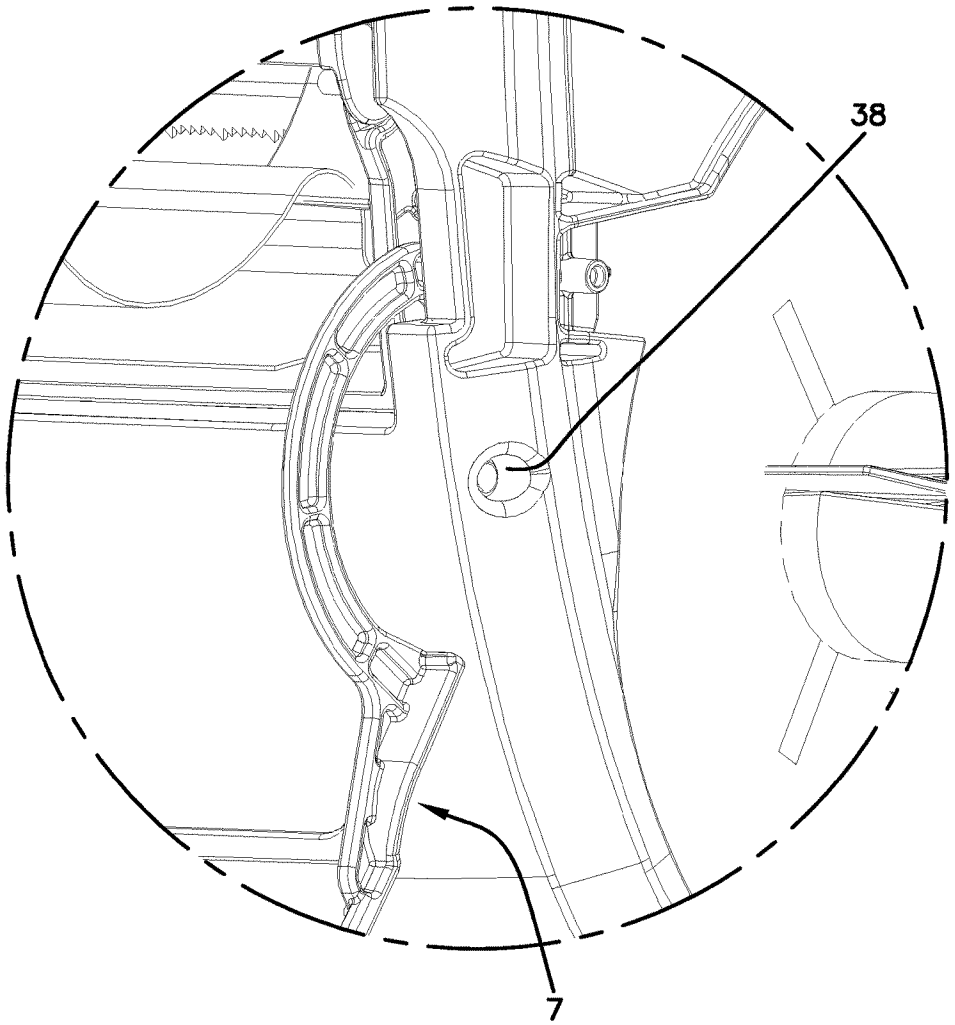

Referring to FIG. 3, a perspective view of the example electronic dual roll paper towel dispenser 10 is depicted with the two side doors 18, 20 removed and the front cover 22 open. When the front cover 22 is opened, the front cover 22 may be unlatched and opened.

Referring to FIG. 4, an enlarged portion of the front cover 22 is shown. The front cover 22, may be attached to the main body 14 by, for example, pivot point 38, for easy opening and closing of the front cover 22 when a supply of paper is placed in the housing 12. The rod 9 of the swing arms 7 can be configured to engage the pivot point 38 for securing the front cover 22 to the main body 14 of the housing 12. The front cover 22 can pivot open and closed within the pivot point 38.

Figure 5:
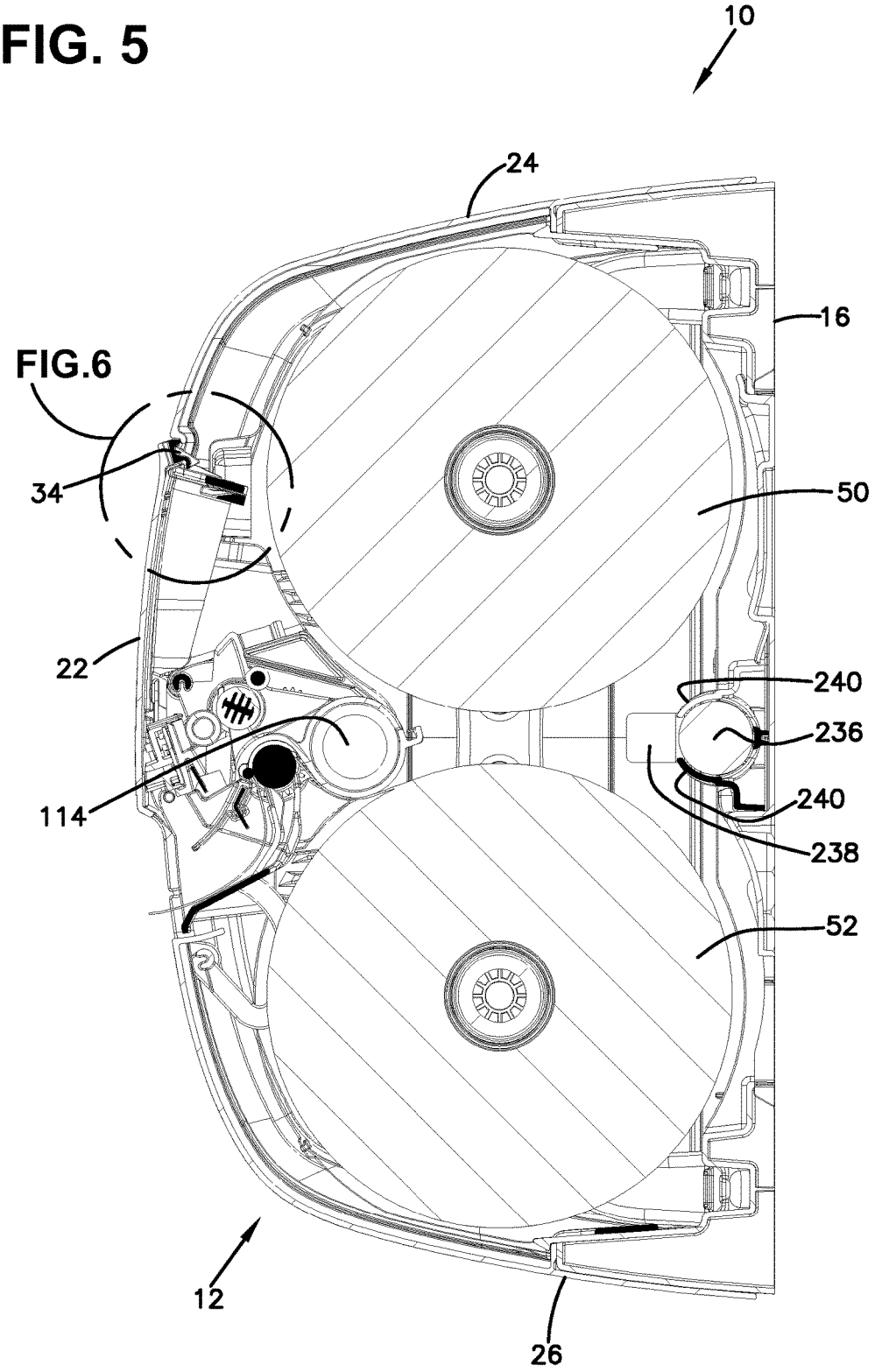
FIG. 5 is a cross-sectional view of the electronic dual roll paper towel dispenser shown in FIG. 1 taken along line 5-5.
Figure 6:
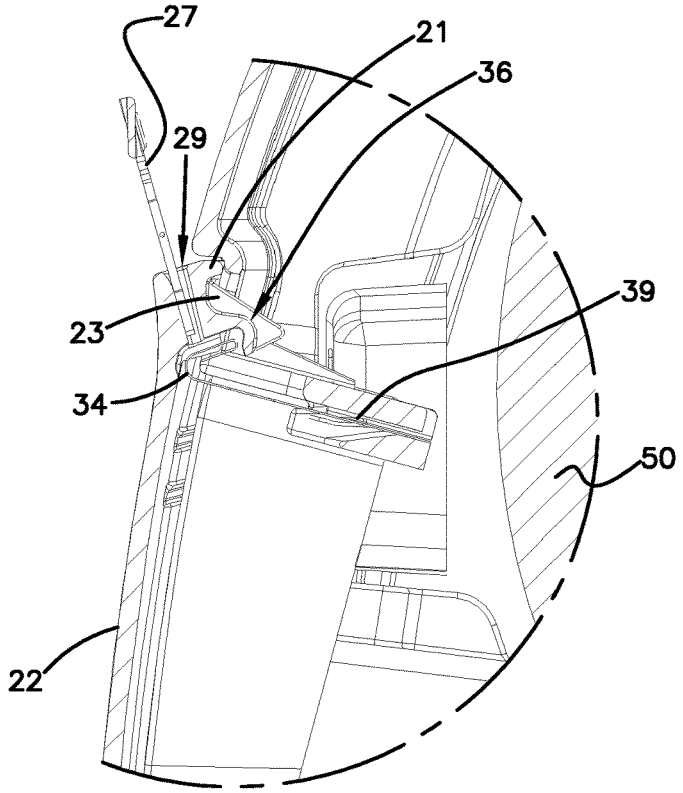
FIG. 6 is an enlarged view of a portion of the electronic dual roll paper towel dispenser shown in FIG. 5.

Referring to FIGS. 5-6, a cross-sectional view of the example electronic dual roll paper towel dispenser 10 is depicted. In one example, the front cover 22 can be latched in a closed position. The front cover 22 can be closed by using a latch 34 attached within a cavity 39 of the main body 14 of the housing 12.

Referring to FIG. 6, an exploded view of the latch 34 is depicted. The latch 34 can be a flexible metal spring that constructed to move up and down for engaging and releasing the front cover 22. In one example, the latch 34 can be adapted to abut against a front door catch 36 of the front door 22 to prevent the front cover 22 from opening when in the closed position. The latch 34 can spring up into position such that the front door catch 36 abuts the latch 34 to create a stop for the front cover 22.

In one example, the front cover 22 can include engaging elements 21 that can be configured to engage ramps 23 on the main body 14 of the housing 12. The engaging elements 21 can be guided into openings 25 defined by the main body 14 when the front cover 22 is closed. In one example, a key 27 can be used by maintenance personnel to open the front cover 22. The key 27 can be arranged and configured to engage a slot 29 located between the ramps 23. In certain examples, the key 27 can be pushed downwardly onto the latch 34 to allow the front door catch 36 to move past the latch 34 for the front cover 22 to open.

Figure 7:
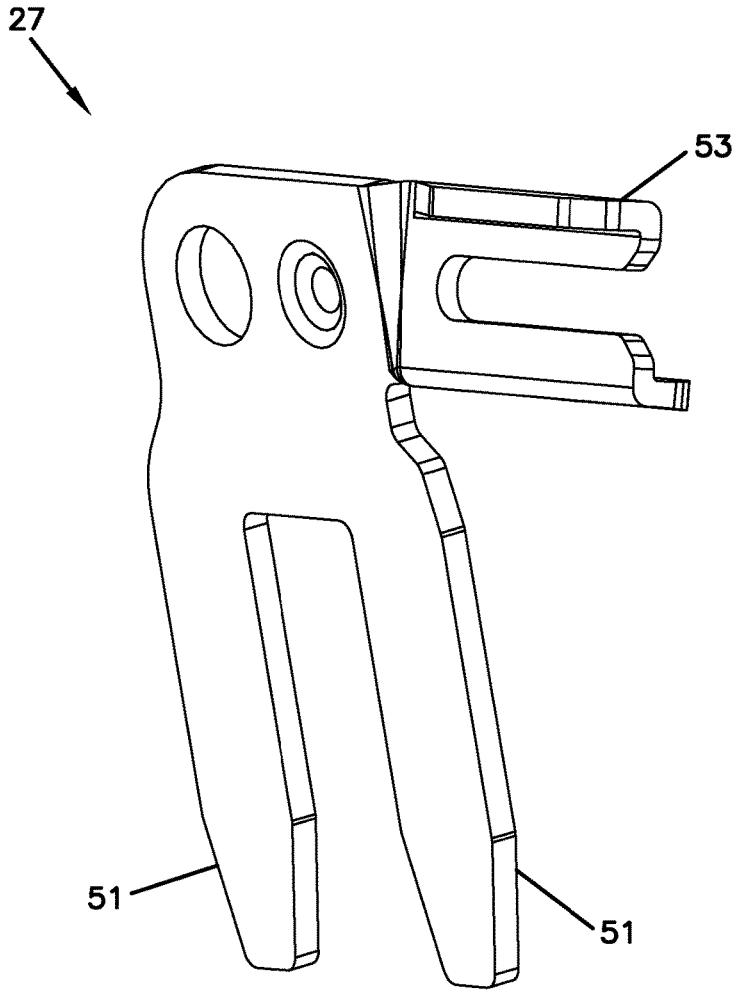
FIG. 7 is a perspective view of an example key in accordance with the principles of the present disclosure.

Referring to FIG. 7, a perspective view of the key 27 is illustrated. The key can include tongs 51 and an extension member 53. In one example, the tongs 51 can engage the opening 29 to push down on the latch 34 to allow the front cover 22 to open. The key can be stored within the housing 12 by sliding the extension member 53 within the housing 12 at a stored position (not shown).

Figure 8:
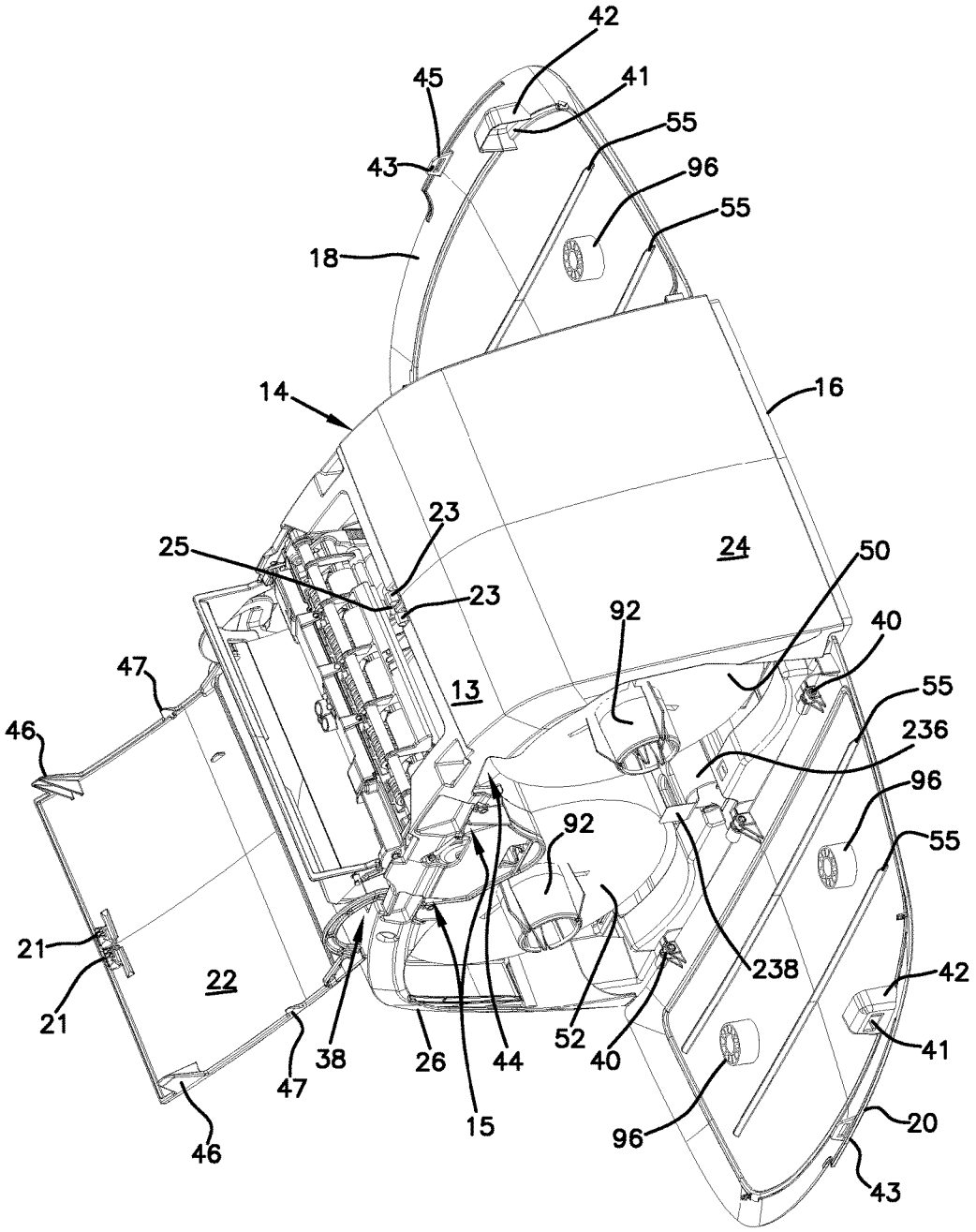
FIG. 8 is a perspective view of the electronic dual roll paper towel dispenser shown in FIG. 1 with the two side doors and front cover open.

Referring to FIG. 8, a perspective view of the example electronic dual roll paper towel dispenser 10 shown in FIG. 1 is depicted with the two side doors 18, 20 and the front cover 22 open. In one example, the two side doors 18, 20 can include structural ridges 55 to help provide rigidity to the two side doors 18, 20. The two side doors 18, 20 can each include plugs 96 to help prevent improper loading of paper rolls and to support mandrels for mounting the paper rolls thereon.

In certain examples, the two side doors 18, 20 may each be hinged to one side of the back wall 16 of the housing 12 by, for example, hinge pivots 40. The two side doors 18, 20 open about the hinge pivots 40 to move between a closed position (see FIG. 1) and an open position (see FIG. 8). The two side doors 18, 20 can each include upper catches 42 and lower catches 43 for locking the two side doors 18, 20 in a closed position. The upper catches 42 can define an opening 41 and the bottom catches 43 define an opening 45.

Figure 10:
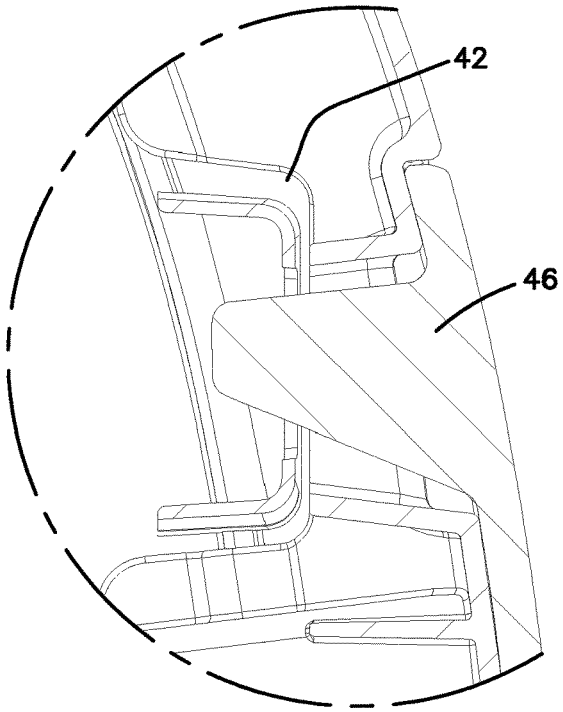
FIG. 10 is an exploded view of a portion of FIG. 9.
Figure 9:
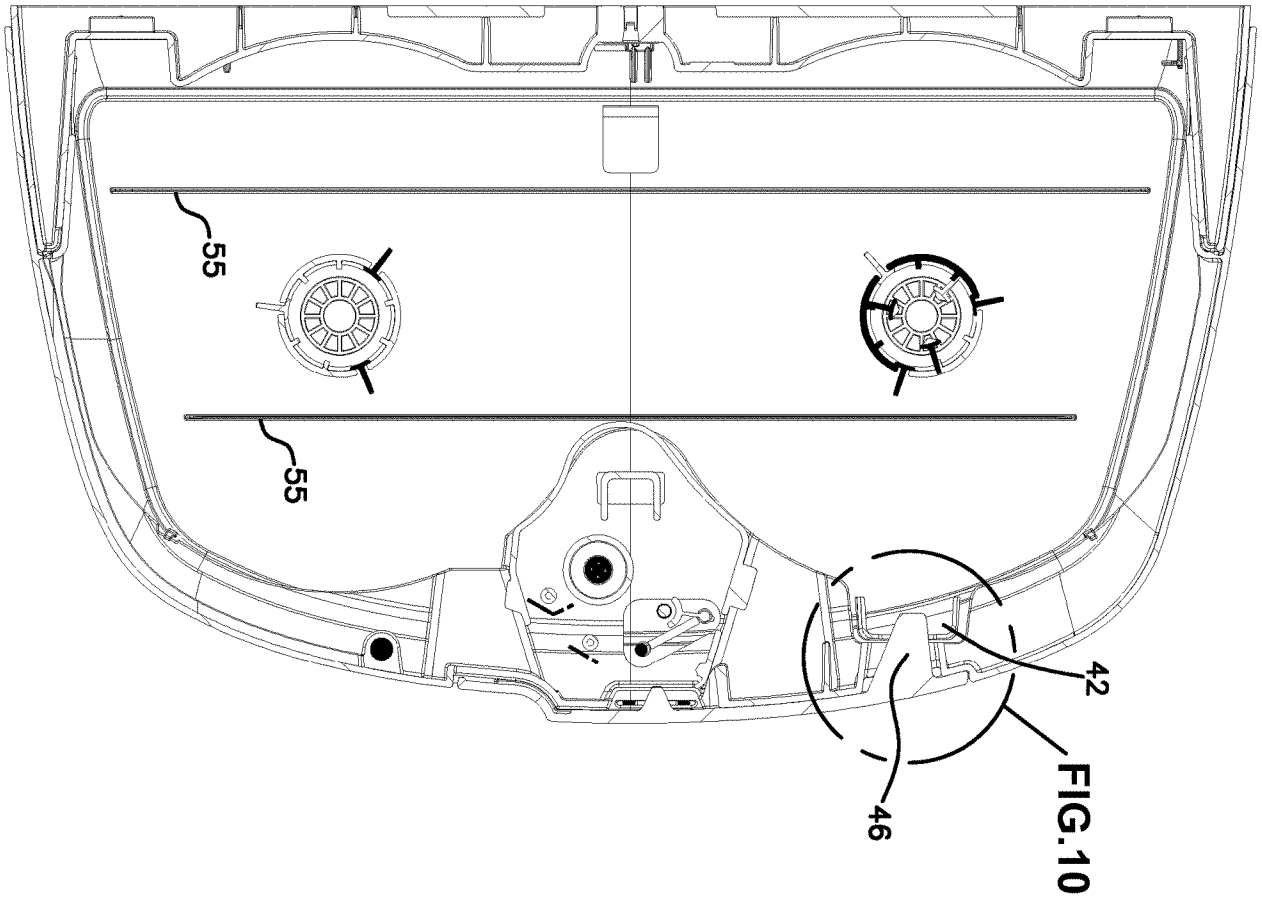
FIG. 9 is a cross-sectional view of the example electronic dual roll paper towel dispenser shown in FIG. 1 taken along line 9-9.

Referring to FIGS. 9-10, a cross-sectional view of the example electronic dual roll paper towel dispenser 10 shown in FIG. 1. In one example, the upper catches 42 of the two side doors 18, 20 engage a cutout 44 (see FIG. 8) defined by the main body 14 of the housing 12 for securing the two side doors 18, 20 in a closed position.

Referring again to FIG. 8, the front cover 22 includes upper cover tabs 46, and lower cover tabs 47 on each side of the front cover 22 to help prevent the two side doors 18, 20 from opening. In one example, the upper cover tabs 46 can engage the opening 41 of the upper catches 42 to secure the two side doors 18, 20 in a closed position. The lower cover tabs 47 can engage the opening 45 of the lower catches 43 to secure the two side doors 18, 20 in a closed position. As such, the two side doors 18, 20 would not open until the front cover 22 is opened. The two side doors 18, 20 may be opened for reloading the example electronic dual roll paper towel dispenser 10 with paper towels 32.

Referring again to FIG. 2, the back wall 16 of the housing 12 includes a plate 48 constructed for hanging the example electronic dual roll paper towel dispenser 10 to the wall 5. The plate 48 may be made of the same materials as the housing 12. The plate 48 may be secured to the back wall 16 by, for example, a mechanical member, a snap configuration, locking tabs, welding, adhesive, or any other conventional attachment means. In other examples, the plate 48 may be coupled together with the back wall 16 such that the back wall 16 and the plate 48 are integrated together or constructed to form one piece.

Figure 11:
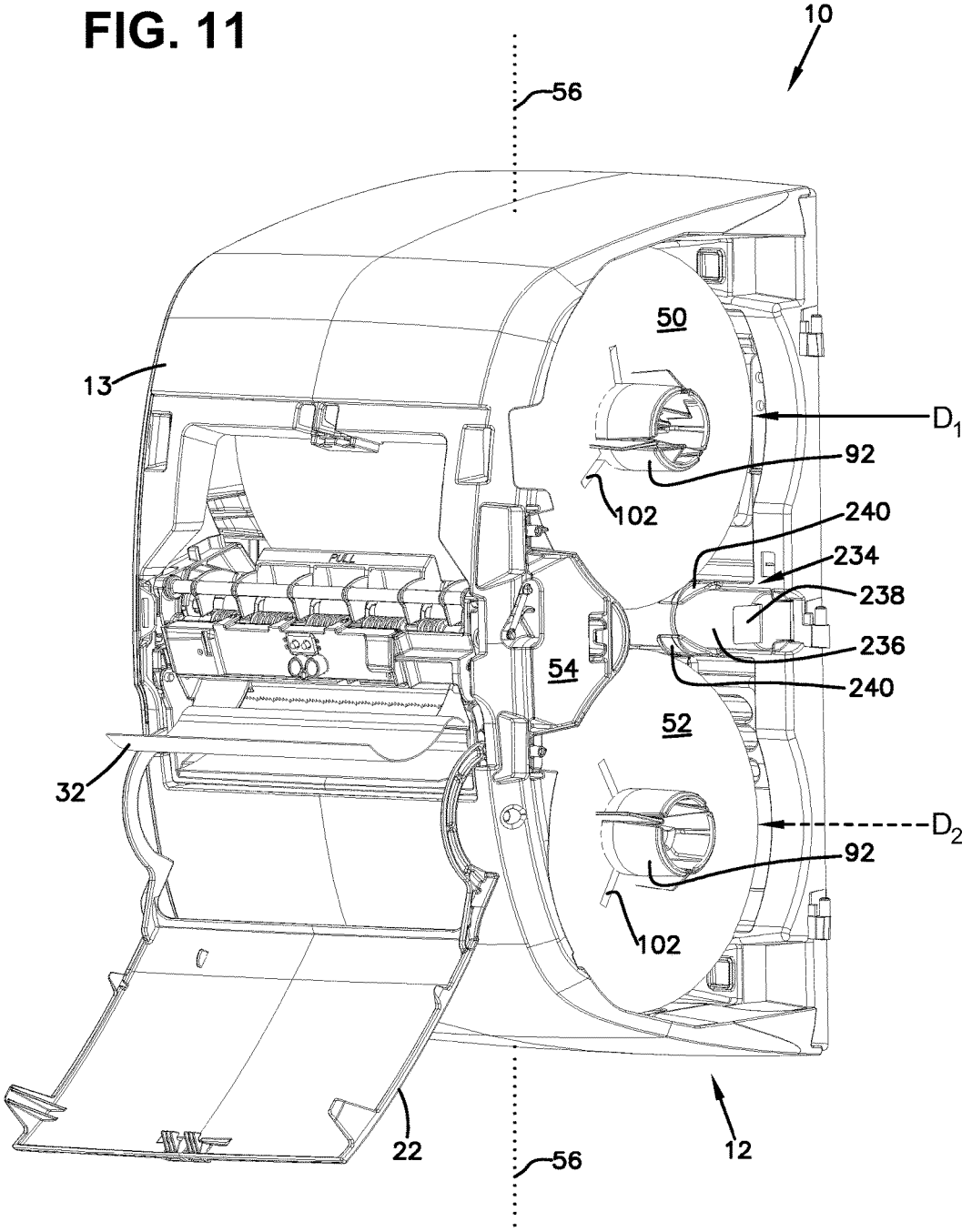
FIG. 11 a side perspective view of the electronic dual roll paper towel dispenser shown in FIG. 8.

FIG. 11 illustrates details of mounting rolls of paper towels in the example electronic dual roll paper towel dispenser 10.

FIG. 11 a side perspective view of the electronic dual roll paper towel dispenser 10 shown in FIG. 8 is depicted. As illustrated, the housing 12 of the electronic dual roll paper towel dispenser 10 can be adapted to hold an upper (e.g., first) roll 50, a lower (e.g., second) roll 52, and a drive module assembly 54 (e.g. dispenser mechanism). In one example, the upper and lower rolls 50, 52 are shown arranged in a vertically stacked configuration along a vertical axis 56. The drive module assembly 54 can be located in a space between a deepest part $D_1$ of the upper roll 50 and the deepest part $D_2$ of the lower roll 52 and between the front wall 13 and both the upper and lower rolls 50, 52. The deepest part $D_1$, $D_2$ of the upper and lower rolls 50, 52 can be from a center point (not shown) in a core of the upper and lower rolls 50, 52.

Figure 12:
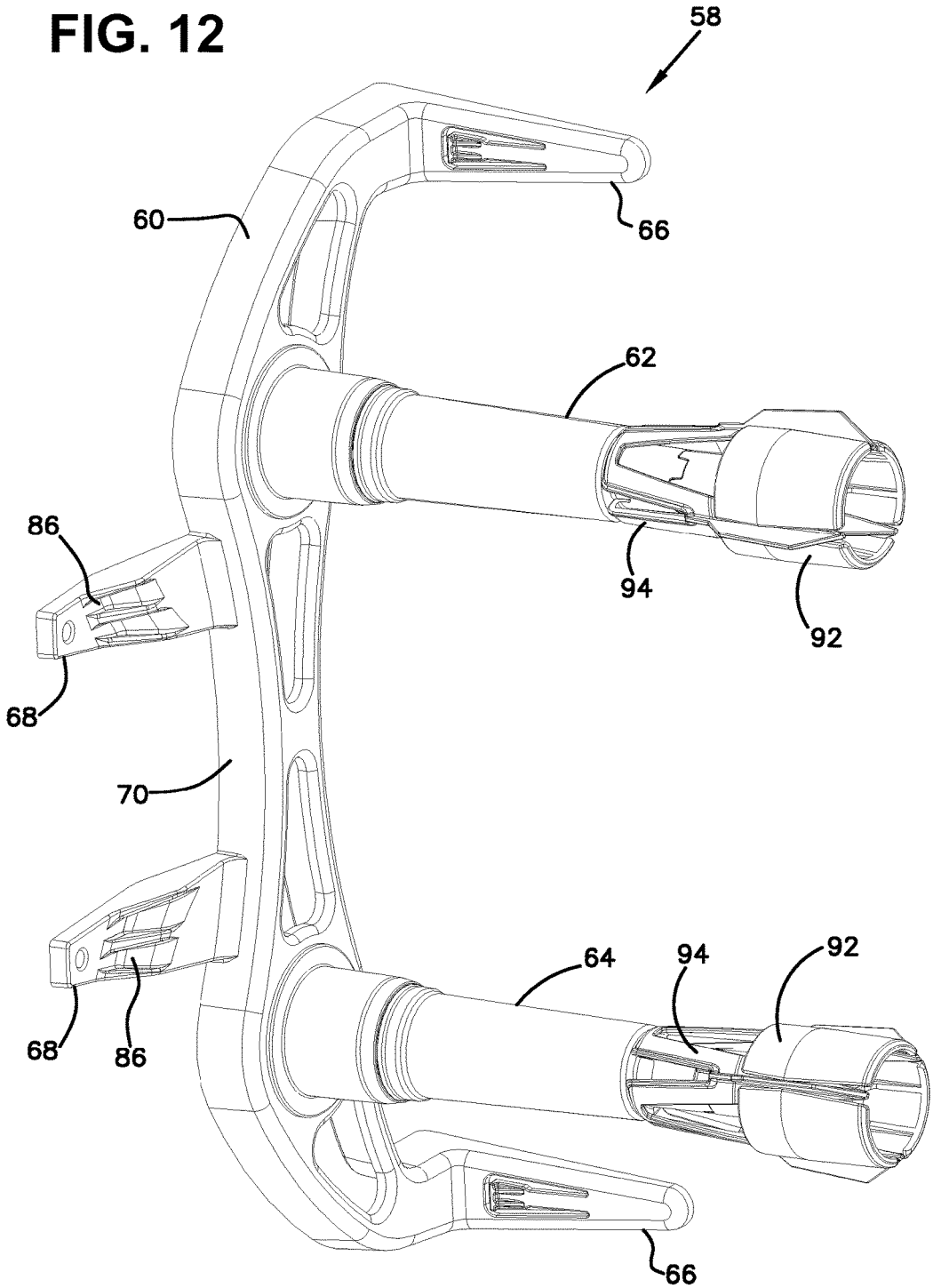
FIG. 12 is a perspective view of a mandrel assembly in accordance with the principles of the present disclosure.

Referring to FIG. 12, a perspective view of an example mandrel assembly 58 is shown. In one example, the example mandrel assembly 58 includes an arm 60, an upper (e.g., first) mandrel 62, and a lower (e.g., second) mandrel 64. In one example, the arm 60 includes mounting protrusions 66 that extend approximately perpendicularly therefrom and guiding arms 68 extending outwardly from an exterior surface 70 of the arm 60. In certain examples, the upper and lower rolls 50, 52 can be cantilevered supported from one side and mounted on the upper and lower mandrels 62, 64 respectively.

Figure 13:
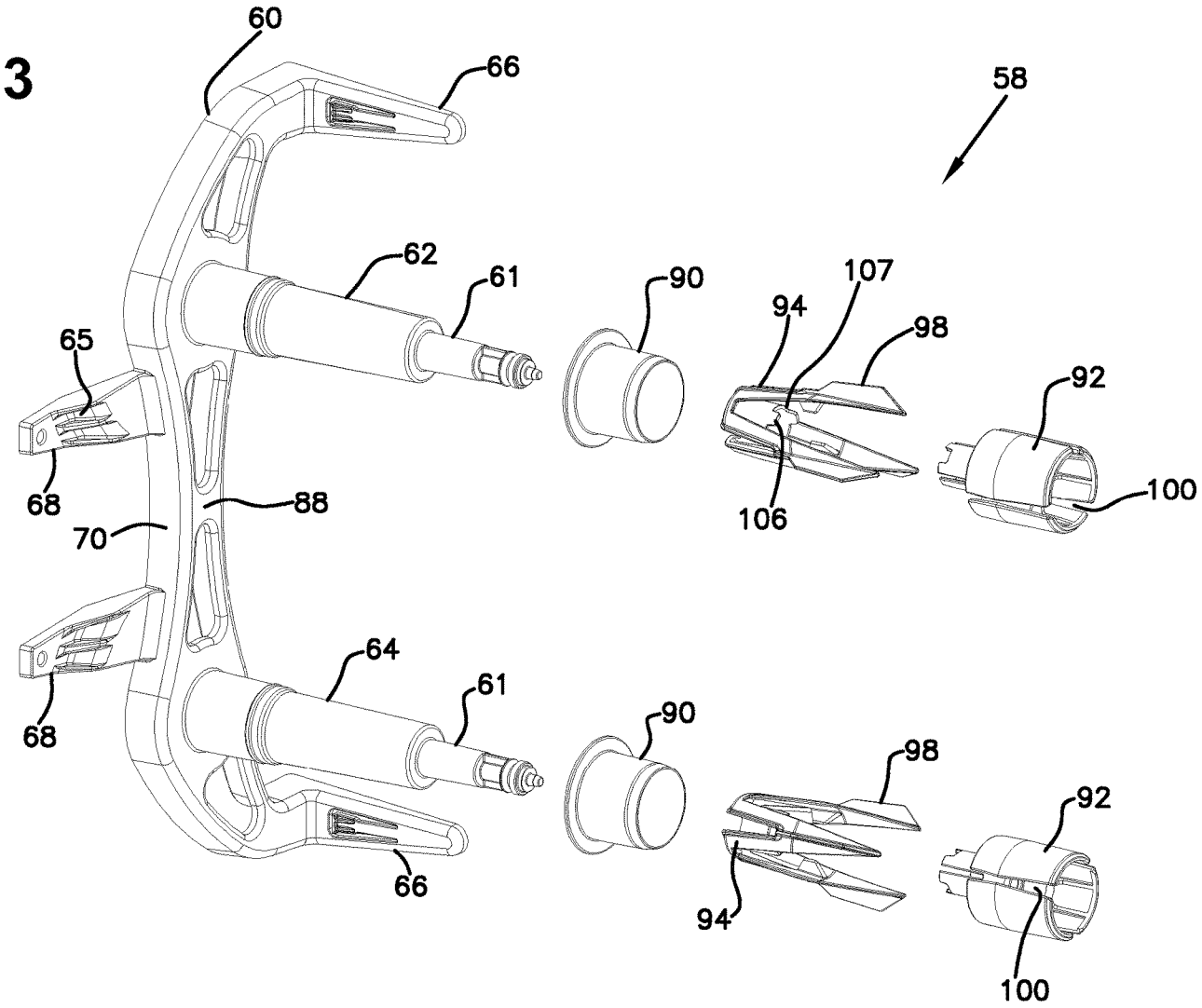
FIG. 13 is an exploded view of the mandrel assembly shown in FIG. 12.
Figure 15:
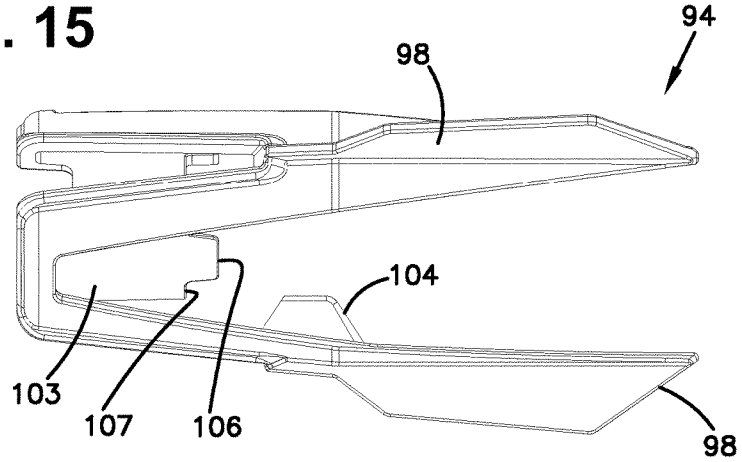
FIG. 15 is a side view of the roll cup finger shown in FIG. 14.
Figure 17:
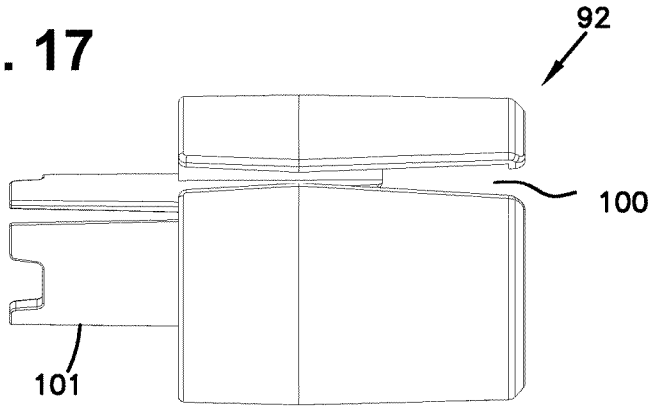
FIG. 17 is a side view of the roll cup shown in FIG. 16.
Figure 14:
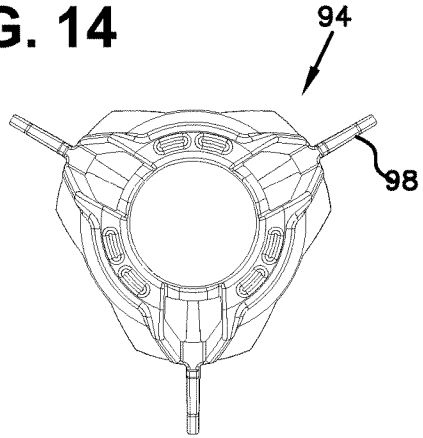
FIG. 14 is a top plan view of a roll cup finger in accordance with the principles of the present disclosure.
Figure 16:
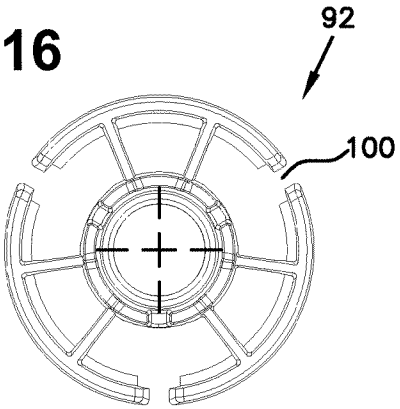
FIG. 16 is a top plan view of a roll cup in accordance with the principles of the present disclosure.

FIG. 13 is an exploded view of the mandrel assembly shown in FIG. 12.

In one example, the upper and lower mandrels 62, 64 each project proximally from a proximal face 88 of the arm 60. Each of the upper and lower mandrels 62, 64 can include a roll cup bearing 90 (e.g., bushing, sleeve), a roll cup 92, and roll cup fingers 94. The roll cup bearing 90 is illustrated adjacent to the proximal face 88 of the arm 60. The plugs 96 of the two side doors 18, 20 can be arranged and configured to engage the roll cups 92 to help prevent improper loading and support the upper and lower mandrels 62, 64.

In one example, the upper and lower rolls 50, 52 can each include notches 102 (see FIG. 11) on the outside core of the upper and lower rolls 50, 52 to assist in the correct installation of the upper and lower rolls 50, 52. In other examples, the notches 102 can be placed on the inside core of the upper and lower rolls 50, 52 to help with proper installation of the upper and lower rolls 50, 52. In certain examples, the upper and lower rolls 50, 52 can be loaded onto the upper and lower mandrels 62, 64 such that the roll cup fingers 94 engage the notches 102 and which can permit the two side doors 18, 20 to close.

Referring to FIGS. 14-17, the roll cup fingers 94 can include locking fingers 98 configured to engage grooves 100 defined by the roll cup 92 so that the roll cup fingers 94 and the roll cup 92 can be connected together. The roll cup fingers 94 can include a shaft 103 for positioning the roll cup 92 thereon. The shaft 103 of the roll cup fingers 94 can include a plurality of tabs 106 separated by gaps 107. The roll cup 92 can include a shaft 101 that defines a recess 105. The recess 105 of the shaft 101 can be constructed to receive the tabs 106 of the shaft 103 of the roll cup fingers 94 such that the roll cup fingers 94 and the roll cup 92 interlock or connect together.

In one example, the shafts 101, 103 of the roll cup fingers 94 and the roll cup 92 can be arranged and configured to fit over spindles 61 (see FIG. 13) of the upper and lower mandrels 62, 64 for attachment thereon. The roll cup fingers 94 and the roll cup 92 can be placed on the upper and lower mandrels 62, 64 to help orient the installation of the upper and lower rolls 50, 52. In one example, the roll cup fingers 94 can include a rib 104 that is constructed to abut the upper and lower mandrels 62, 64 if the upper and lower rolls 50, 52 are not installed correctly thereon. If the installation of the upper and lower rolls 50, 52 is incorrect the two side doors 18, 20 would not close due to the roll cup fingers 94 interfering with the plugs 96.

Figure 18:
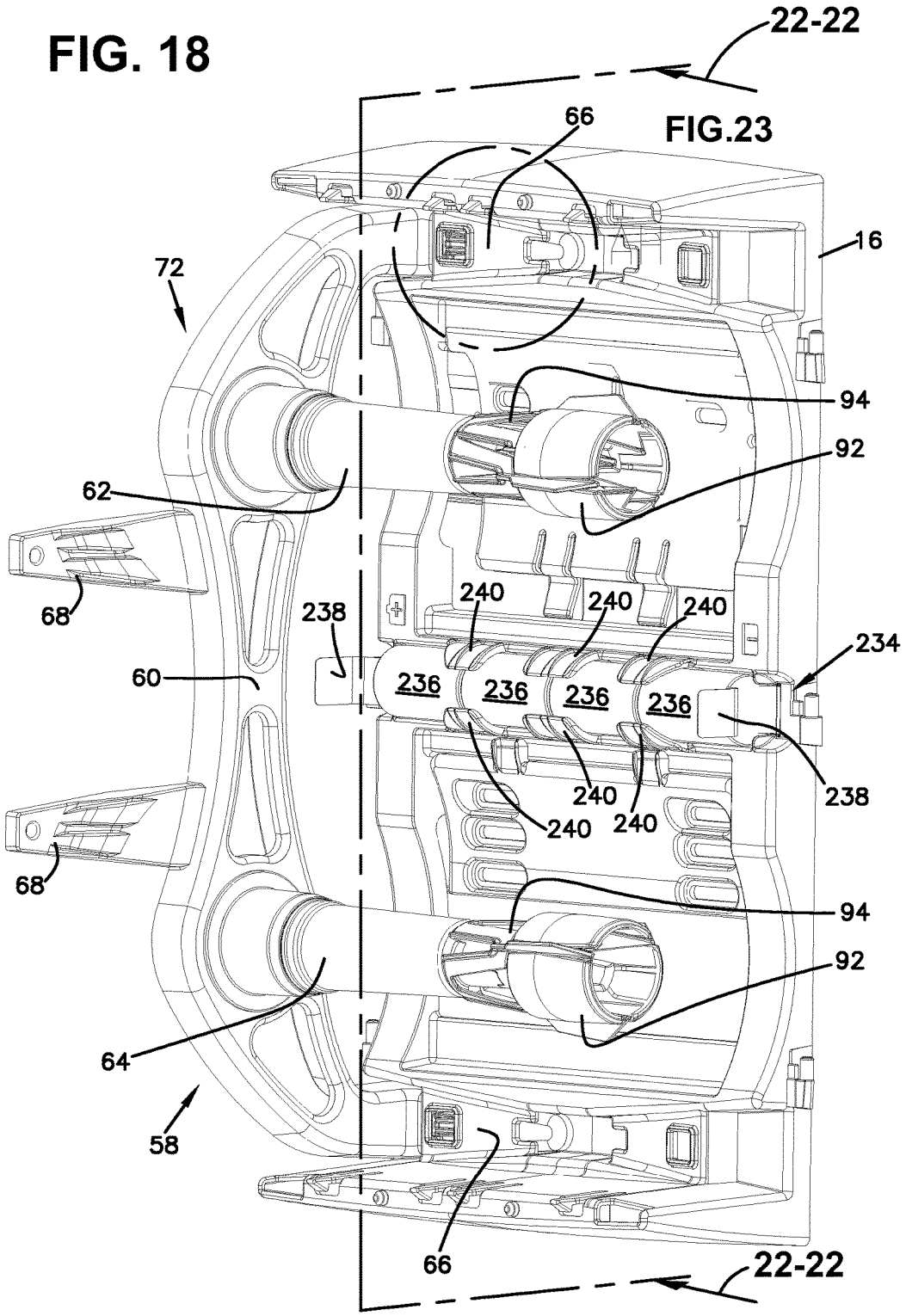
FIG. 18 is a perspective view a left mandrel assembly attached to a back wall of the electronic dual roll paper towel dispenser in accordance with the principles of the present disclosure.
Figure 19:
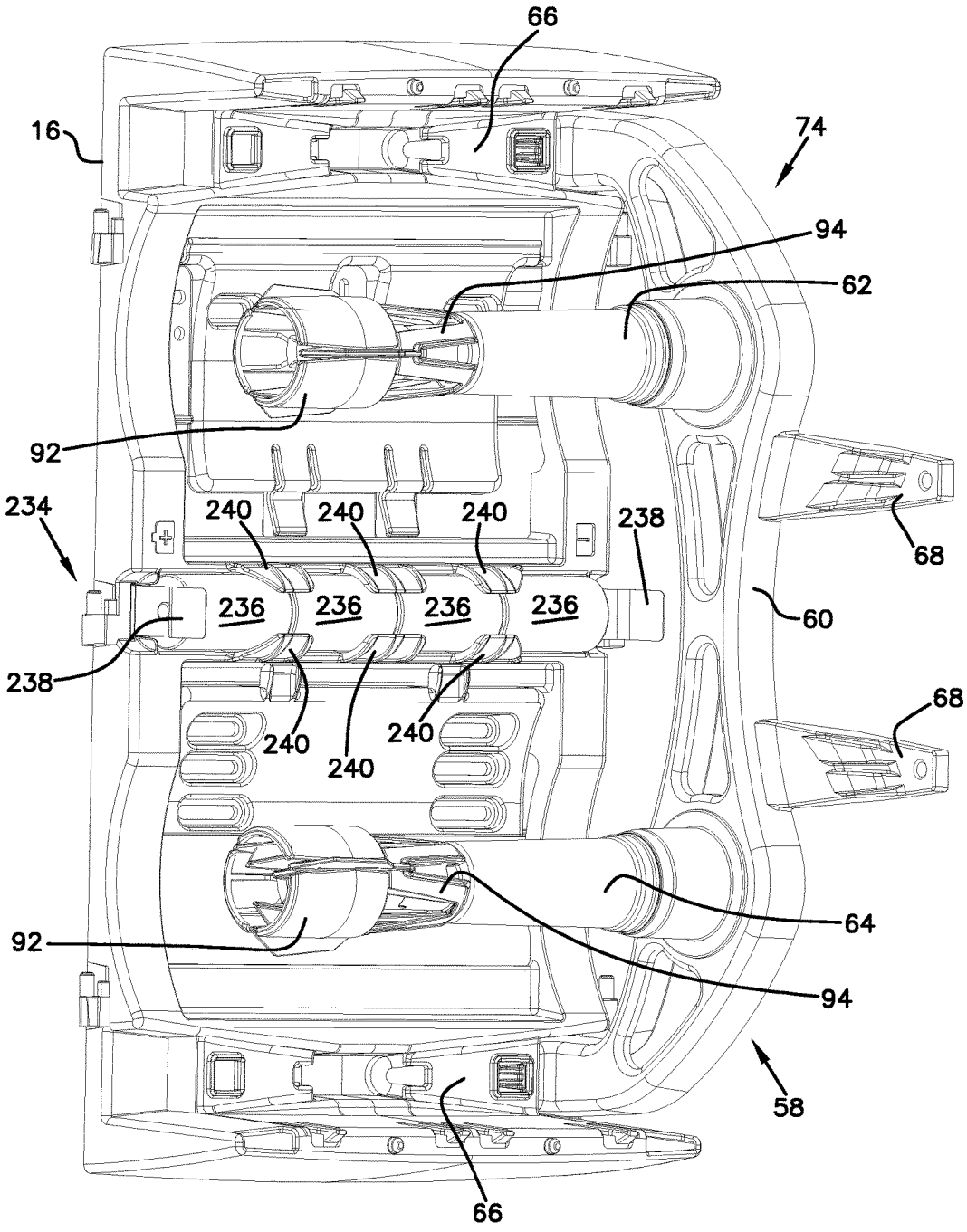
FIG. 19 is a perspective view a right mandrel assembly attached to the back wall of the electronic dual roll paper towel dispenser in accordance with the principles of the present disclosure.

Referring to FIGS. 18-19, a left side mandrel assembly 72 and a right side mandrel assembly 74 are depicted. The left and right side mandrel assemblies 72, 74 can be attached respectively at a left or right side of the electronic dual roll paper towel dispenser 10. This allows for the example electronic dual roll paper towel dispenser 10 to be mounted in a wide variety of environments. Irrespective of which side of the electronic dual roll paper towel dispenser 10 the mandrel assembly 58 is attached, the mounting protrusions 66 can engages the back wall 16 in the same manner.

Figure 20:
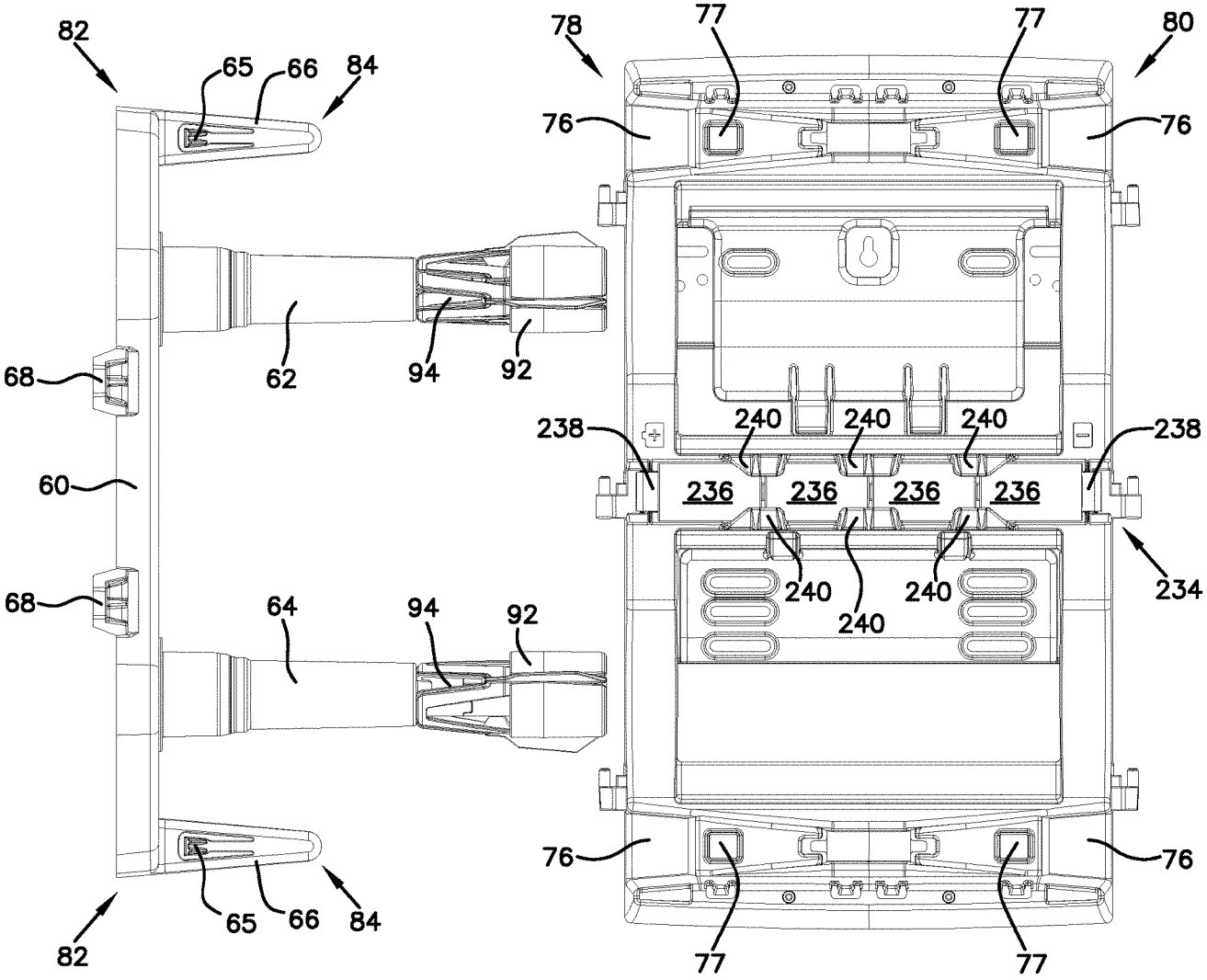
FIG. 20 is a front plan view of the left mandrel assembly of FIG. 18 retracted from the back wall.
Figure 21:
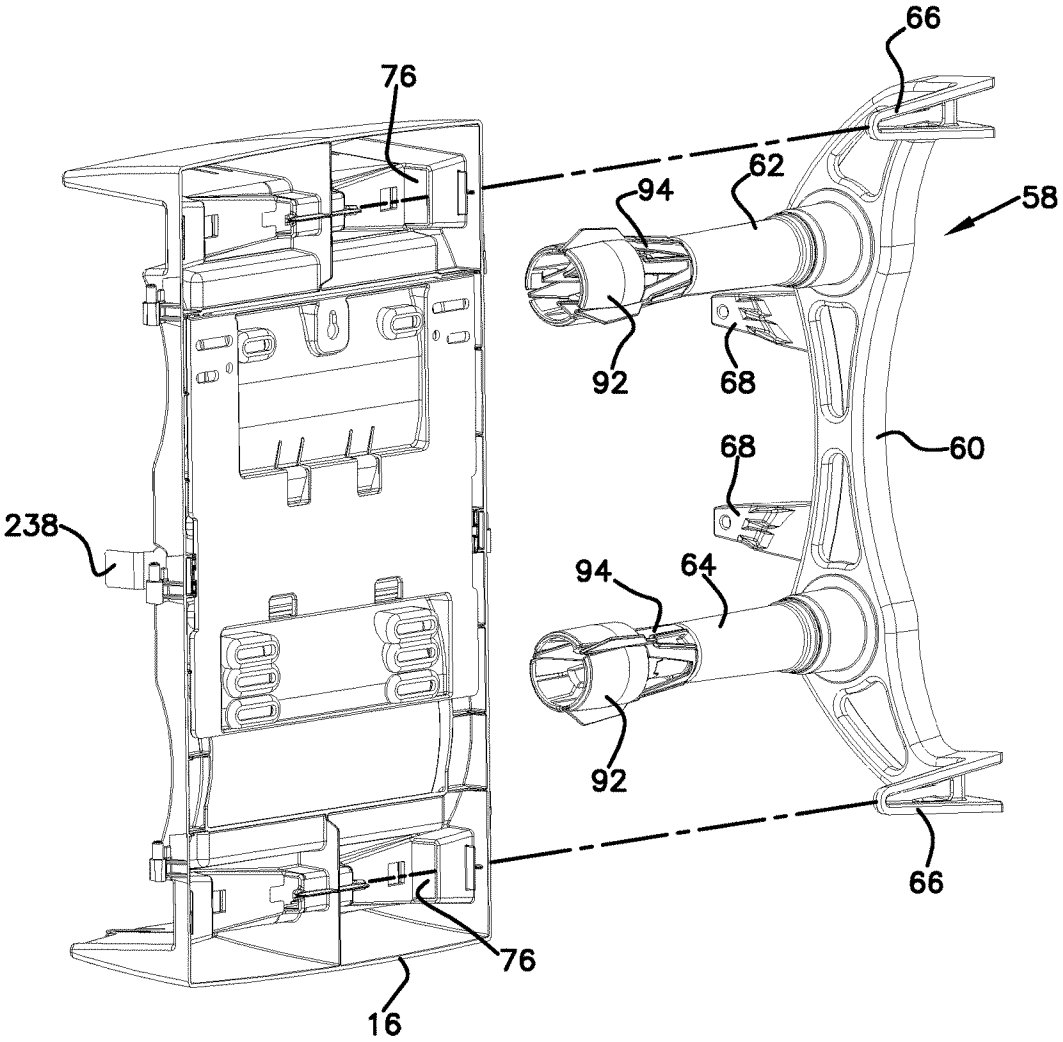
FIG. 21 is a back perspective view of the left mandrel assembly of FIG. 20.

Referring to FIGS. 20-21, the back wall 16 can define passages 76 on both a left side 78 and a right side 80 of the back wall 16. The passages 76 can include therein cavities 77. In one example, the mounting protrusions 66 can include a proximal end 82 and a distal end 84. The protrusions 66 can include spring fingers 65 that are arranged and configured to engage the cavities 77 in the passages 76 when sliding into the passages 76 of the back wall 16 at either the left or right sides 78, 80.

Figure 22:
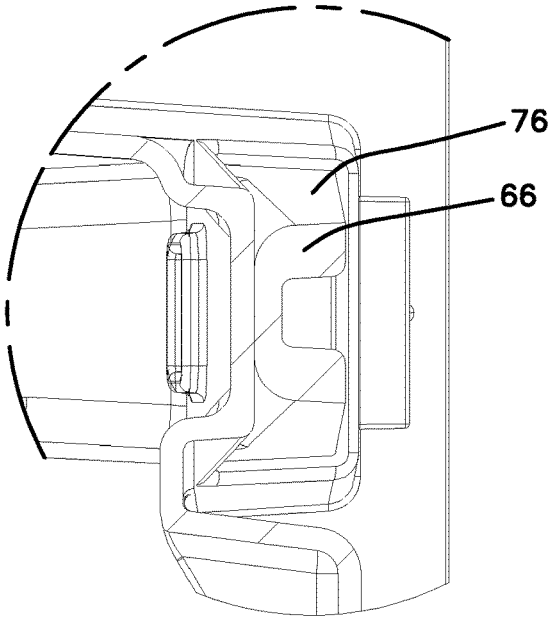
FIG. 22 is a cross-sectional view of a portion of the left mandrel assembly of FIG. 18 taken along lines 22-22.
Figure 23:
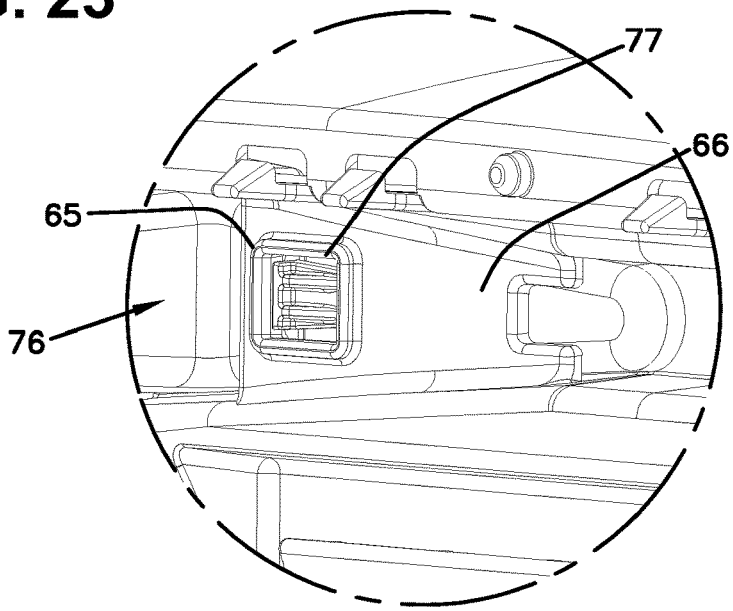
FIG. 23 is an enlarged portion of the left mandrel assembly of FIG. 18.

Referring to FIGS. 22-23, exploded views of the mounting protrusions 66 are illustrated. The mounting protrusions 66 can slide within the passages 76 of the back wall 16 such that the spring fingers engage the cavities 77 as shown. In certain examples, the protrusions 66 can extend in a proximal-to-distal direction along the back wall 16. Switching between the left and right side mandrel assemblies 72, 74 can change how the paper towel 32 comes off the upper and lower rolls 50, 52, in a clockwise orientation or a counter-clockwise orientation.

In certain examples, the guiding arms 68 on the mandrel assembly 58 can engage the front wall 13 at recess 15 (see FIG. 8) to help provide support to the front wall 13 and limit movement of the mandrel assembly 58. In one example, the guiding arms 68 include a bend retention portion 86 (see FIG. 12) that can engage the upper and lower rolls 50, 52 to help secure the upper and lower rolls 50, 52 to the upper and lower mandrels 62, 64 respectively.

Figure 24:
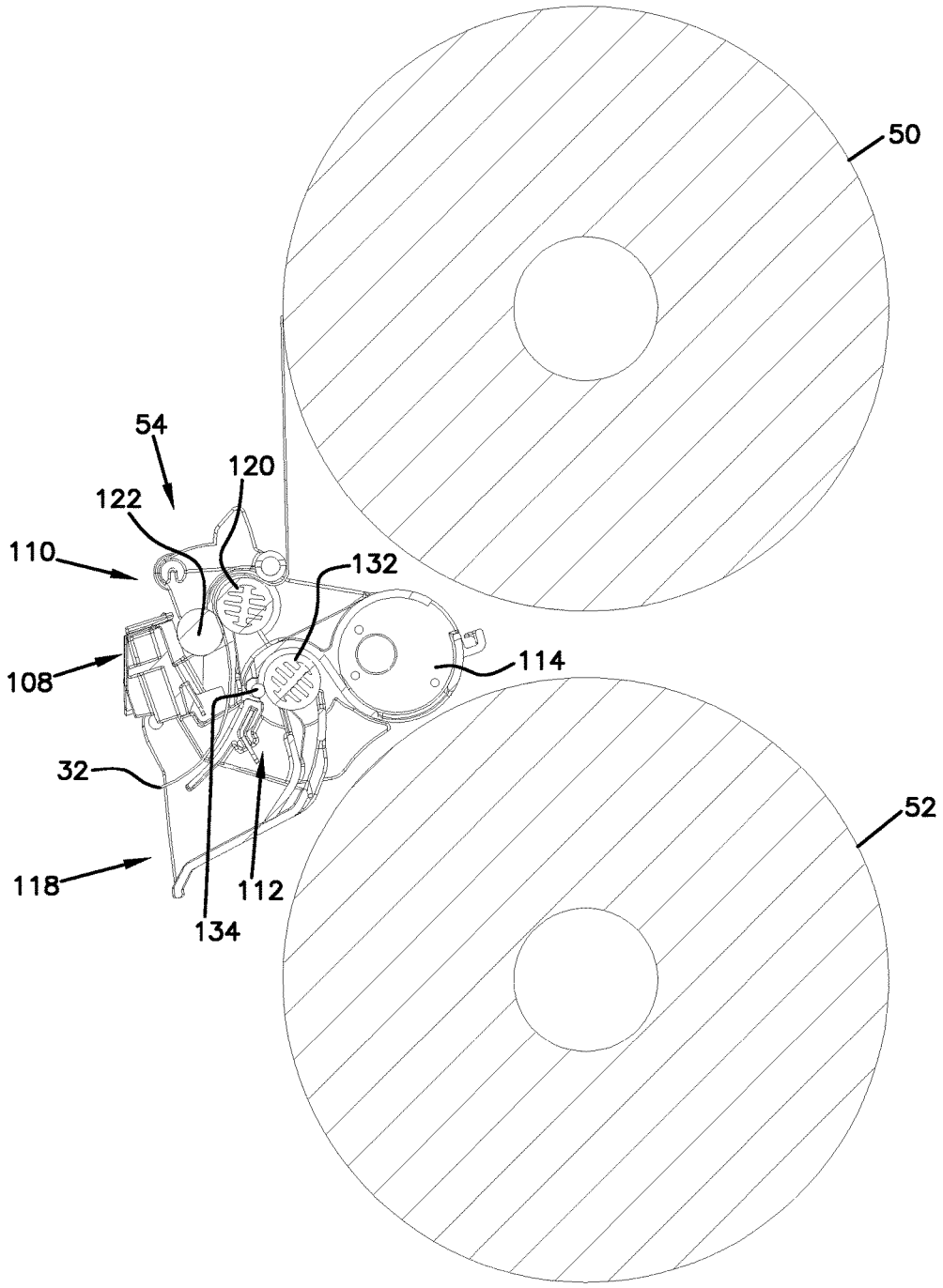
FIG. 24 is a cross-sectional view of a drive module assembly in accordance with the principles of the present disclosure.

Referring to FIG. 24, a cross-sectional view of the drive module assembly 54 is depicted. In one example, the drive module assembly 54 can include a module housing 108, an upper (e.g., first) drive mechanism 110, a lower (e.g., second) drive mechanism 112, a motor 114, and a circuit board 207 (see FIG. 40). In one example, the module housing 108 can be constructed to accommodate the first and second drive mechanisms 110, 112 in close proximity to one another to yield a compact arrangement for dispensing dual paper rolls. As illustrated, the first and second drive mechanisms 110, 112 can be two independent drive mechanisms for the upper and lower rolls 50, 52. Examples of the upper and lower drive mechanisms 110, 112 will be described in more detail below.

In one example, the upper and lower rolls 50, 52 can be fully loaded and ready for dispensing at the same time unlike traditional dispensers where the exchange bar only engages the reserve roll after the primary roll is depleted. In the drive module assembly 54, it is not necessary to move the upper and lower rolls 50, 52 around to a stub position for reloading. The upper and lower rolls 50, 52 can be replaced when empty without disturbing the other.

Figure 42:
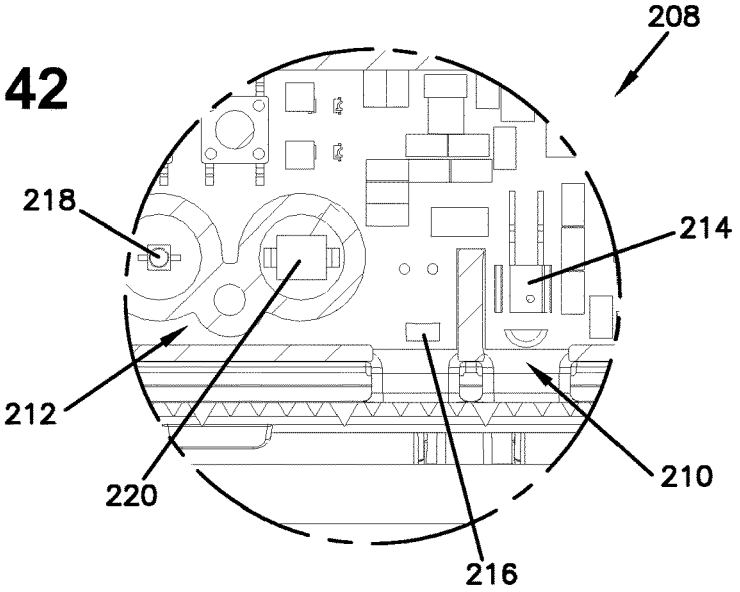
FIG. 42 is an enlarged view of a portion of the control circuit shown in FIG. 41.

In one example, the arrangement of the drive module assembly 54 provides for paper sheets from the upper and lower rolls 50, 52 to be detected by a paper sensor 210 (see FIG. 42). The drive module assembly 54 of the example electronic dual roll paper towel dispenser 10 can provide for the ability to dispense two paper towels 32 at once or alternately. In certain examples, the paper towel 32 can be dispensed through the same dispenser opening 118.

Figure 25:
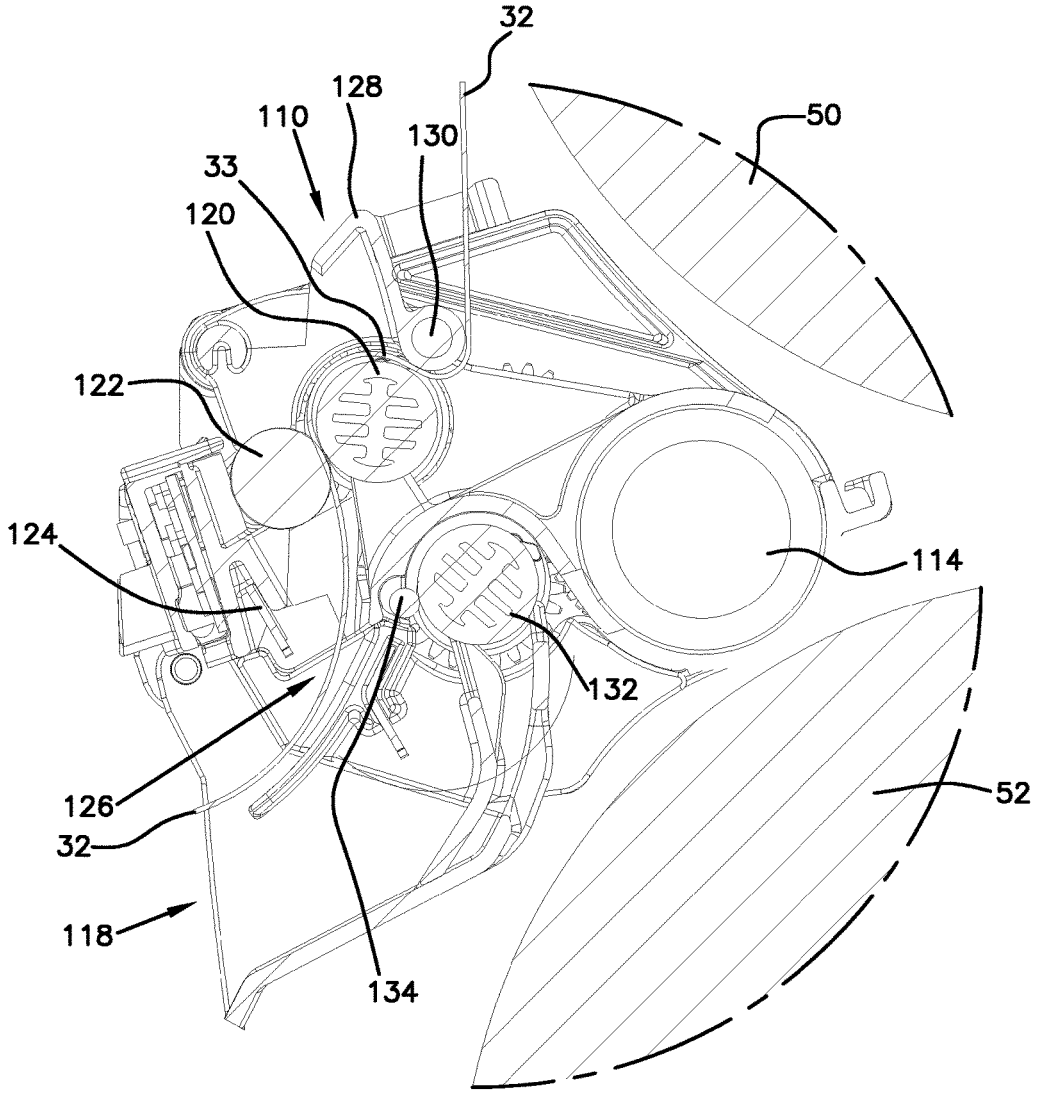
FIG. 25 is an enlarged view of a portion of the drive module assembly of FIG. 24 loading a sheet with an upper drive mechanism.
Figure 26:
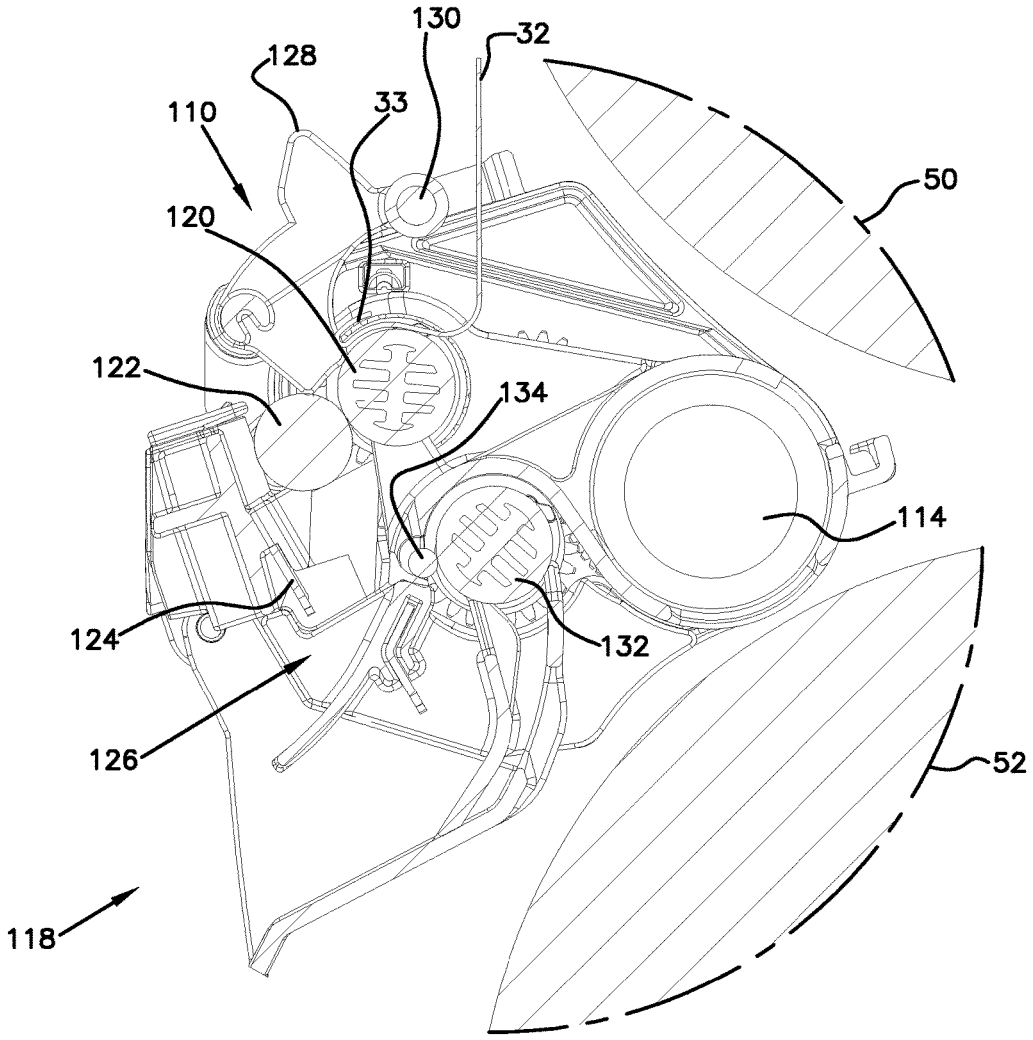
FIG. 26 is an enlarged view of a portion of the drive module assembly of FIG. 24 dispensing the sheet around an upper drive roller.
Figure 27:
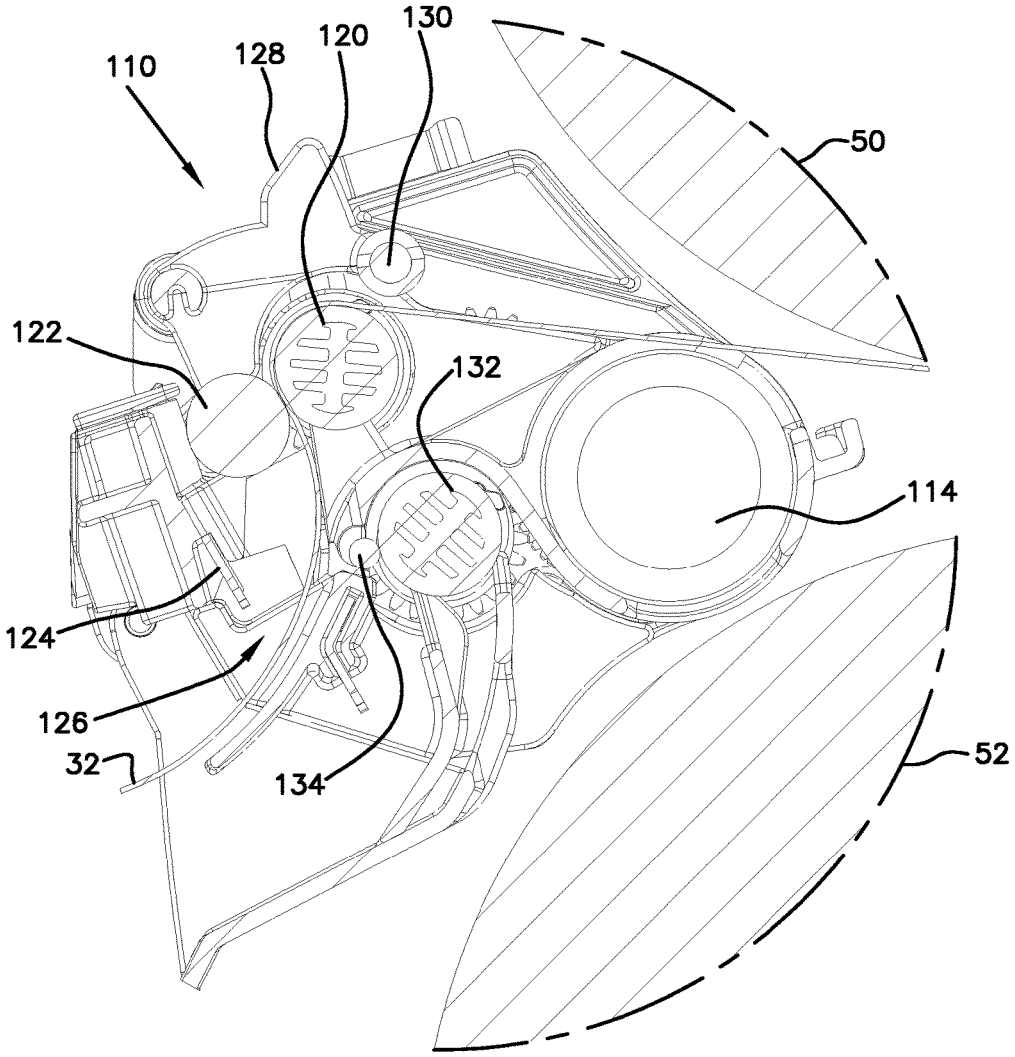
FIG. 27 is an enlarged view of a portion of the drive module assembly of FIG. 24 loading the sheet from a bottom of an upper roll.

FIGS. 25-27 illustrate features of the upper drive mechanism 110 of the drive module assembly 54.

Referring to FIGS. 25-26, the upper drive mechanism 110 can include an upper (e.g., first) drive roller 120, an upper (e.g., first) pinch roller 122 (e.g., nip roller), an upper (e.g., first) blade 124, an upper (e.g., first) chute area 126, and an upper transfer bar 128. The upper pinch roller 122 is shown in the drawings as a fixed roller. The upper pinch roller 122 can be positioned adjacent to the upper drive roller 120.

In one example, the upper pinch roller 122 can include rubber rings or friction material thereon for cooperating with the upper drive roller 120 in the feed of the paper towel 32.

The upper transfer bar 128 is shown in an open position for loading a paper sheet from the upper roll 50. The upper transfer bar 128 can be easily lifted into the open position and lowered by gravity. The drive module assembly 54 is constructed such that the upper roll 50 can be loaded without having to remove a bottom paper sheet from the lower roll 52.

In one example, the upper transfer bar 128 is free to float up and down about a pivot point 130 based on tensions in the paper towel sheet. The ability to float up and down allows for loading of paper towel rolls while maintaining a wrap on the upper drive roller 120. The wrap on the upper drive roller 120 provides for the upper drive roller 120 to adequately grip the paper towel sheet which can help prevent freewheeling and promote good dispensing. The upper transfer bar 128 is arranged and configured such that paper towels can be loaded from either the top or bottom (See FIG. 27) of a paper roll.

Referring to FIG. 26, an illustration of loading paper from an upper roll 50 using the upper drive mechanism 110 is depicted. In one example, a folded end 33 of the paper towel 32 can be drawn downwardly and introduced under the upper transfer bar 128 of the upper drive mechanism 110. The upper transfer bar 128 is lowered by gravity and can apply load pressure to the paper towel 32 to ensure that the upper drive roller 120 will pull the paper towel 32 to the upper pinch roller 122.

Referring to FIG. 27, the motor 114 can be used to drive the upper drive roller 120 to pull the paper towel 32 to the upper pinch roller 122. It is noted that the motor 114 can be of any suitable type (e.g. stepper, servo, brushed, brushless, etc.). As shown, the paper towel 32 will continue to dispense past the upper pinch roller 122 and out the upper chute area 126. A user can then grab a hold of the paper towel 32 and pull the paper towel 32 against the upper blade 124 to be torn.

Referring to FIGS. 28-36, an example of the lower drive mechanism 112 of the drive module assembly 54 is illustrated.

Figure 28:
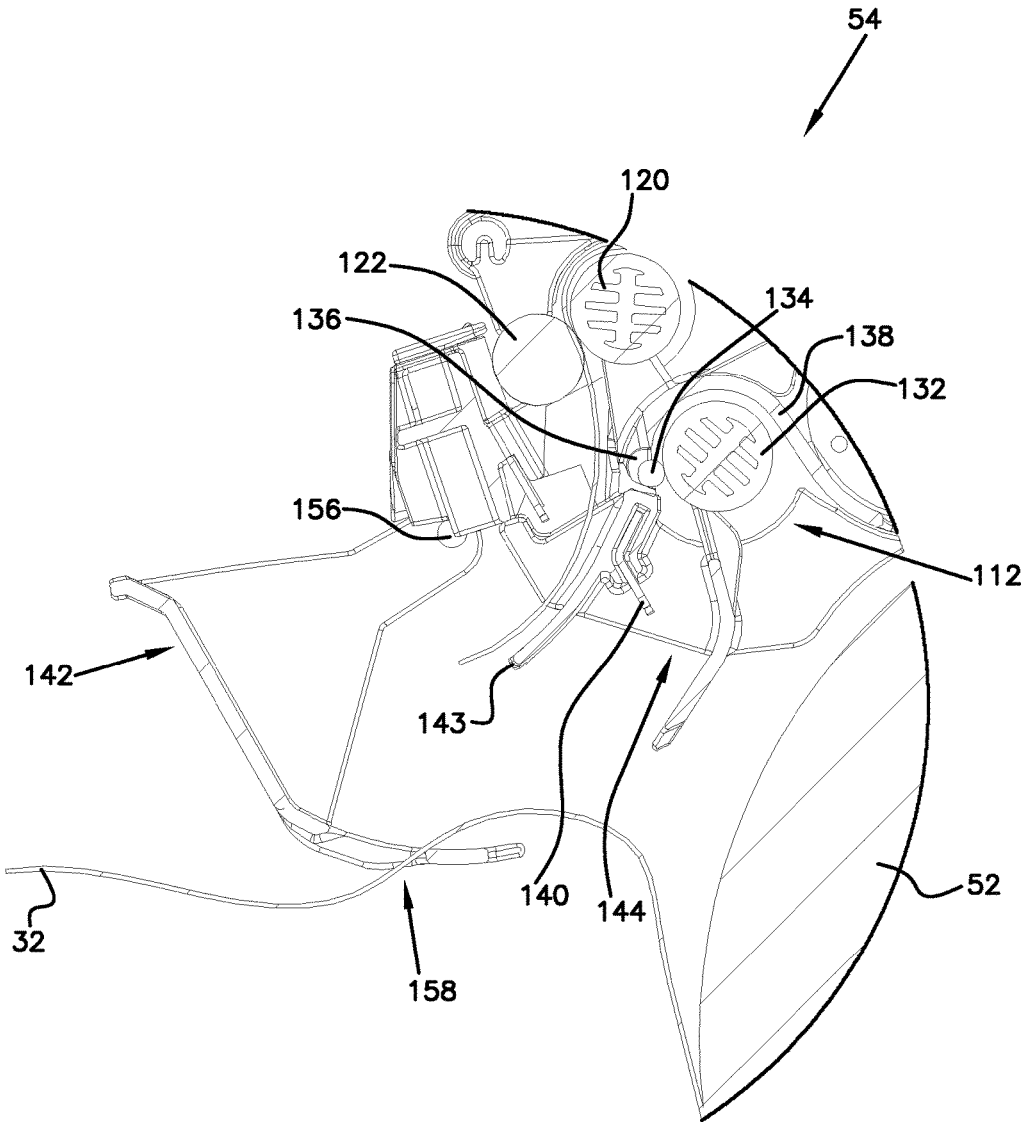
FIG. 28 is an enlarged view of a portion of the drive module assembly of FIG. 24 loading a sheet with a lower drive mechanism.

FIG. 28 is an enlarged cross-sectional view of the drive module assembly 54 with the lower drive mechanism 112.

In one example, the lower drive mechanism 112 can include a lower (e.g., second) drive roller 132, a lower (e.g., second) pinch roller 134 (e.g., nip roller), a paper roller trough 136, a trough member 138 located in the paper roller trough 136, a lower (e.g., second) blade 140, a feeder assembly 142, a lower (e.g., second) chute area 144 and a stripper bar 143.

The feeder assembly 142 is shown in the open position for loading. The trough member 138 can be configured to surround the lower drive roller 132 to create the paper roller trough 136 through which the paper towel 32 can be fed. In one example, the lower drive roller 132 can be configured with a plurality of tires 131 spaced by gaps 133 (see FIG. 29) to pull sheets of paper towels 32. In certain examples, the trough member 138 can help guide the paper towel 32 around the lower drive roller 132. In one example, the trough member 138 can be made from plastic. It is to be understood that other materials may be used.

In one example, the lower pinch roller 134 can be a floating roller. The lower pinch roller 134 can be configured to move freely within the paper roller trough 136. In the embodiment shown, the pinch roller 134 is held against the lower drive roller 132 by a pair of springs secured to the module housing 108 at each end of the pinch roller 134. The lower pinch roller 134 can cooperate with the lower drive roller 132 while feeding the paper towel 32 such that the lower pinch roller 134 rotates and slips on the lower drive roller 132. In one example, the lower pinch roller 134 can be a 3/16 inch diameter rod. The lower pinch roller 134 can be about 8.5 inches long. The size of the lower pinch roller 124 allows for the close proximity of the upper and lower chute areas 126, 144.

Figure 29:
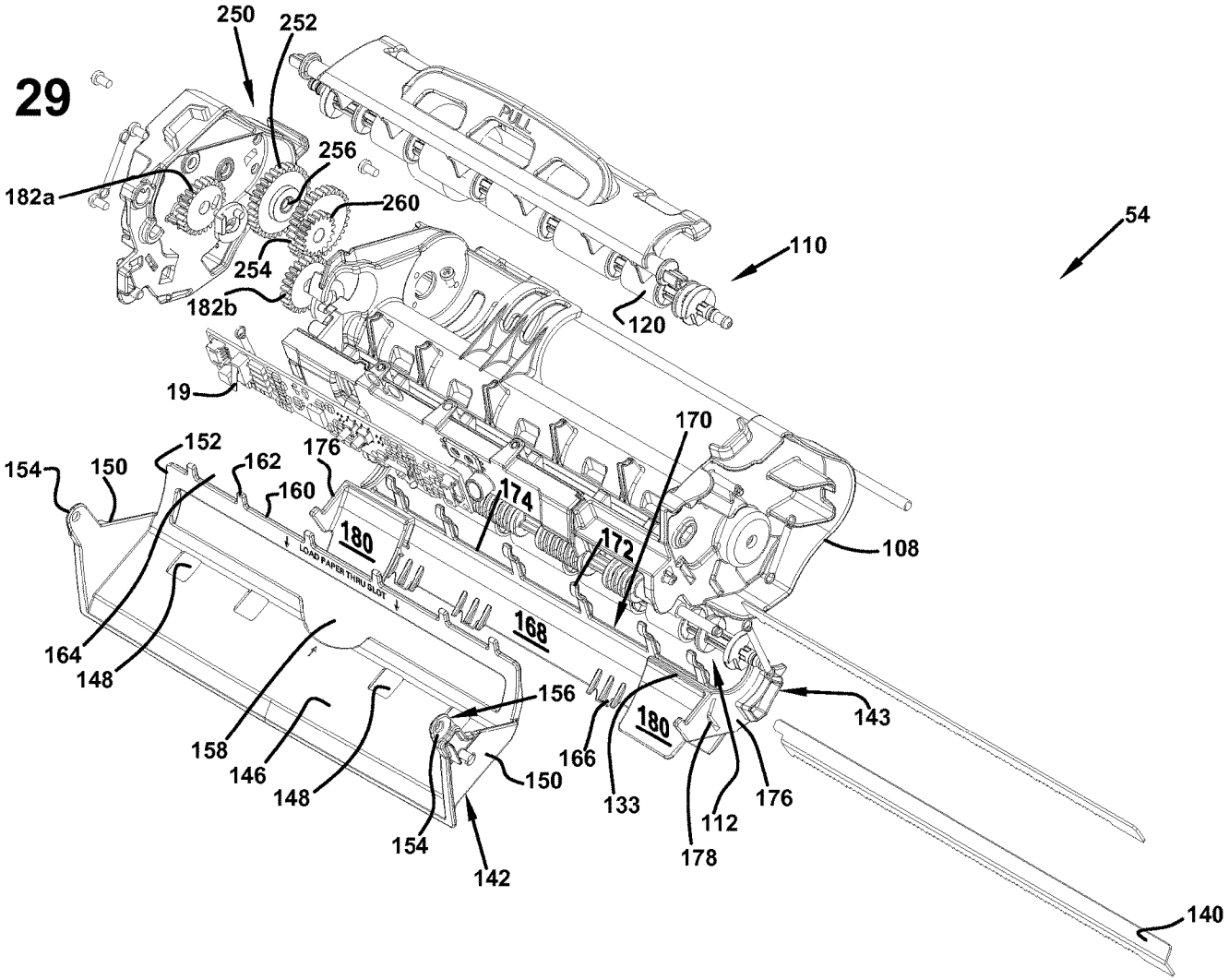
FIG. 29 is an exploded view of the drive module assembly.

Referring to FIG. 29, an exploded view of the drive module assembly 54 is shown. The feeder assembly 142 can include a bottom tray 146 that defines a plurality of apertures 148, two brackets 150 on opposite sides of the feeder assembly 142 such that the bottom tray 146 extends between the two brackets 150, and an upright frame 152 extending generally upwardly from the bottom tray 146. The feeder assembly 142 can be constructed to prevent high friction paper from contacting itself and pulling back up into contact with the lower drive roller 132 causing a jam. This concept is illustrated and described in more detail with reference to FIGS. 35-36.

In one example, the brackets 150 define openings 154 for receiving a fastener, such as, but not limited to, a thumbscrew, pin, bolt, dowel, rivet, latch, wire tie, and the like to be attached on the module housing 108. In other examples, the brackets 150 can be secured to the feeder assembly 142 by, for example, adhesive, fasteners, welding, brazing, or combinations of these or other bonding techniques. The feeder assembly 142 can pivot about pivot point 156 between an open and closed position.

Figure 34:
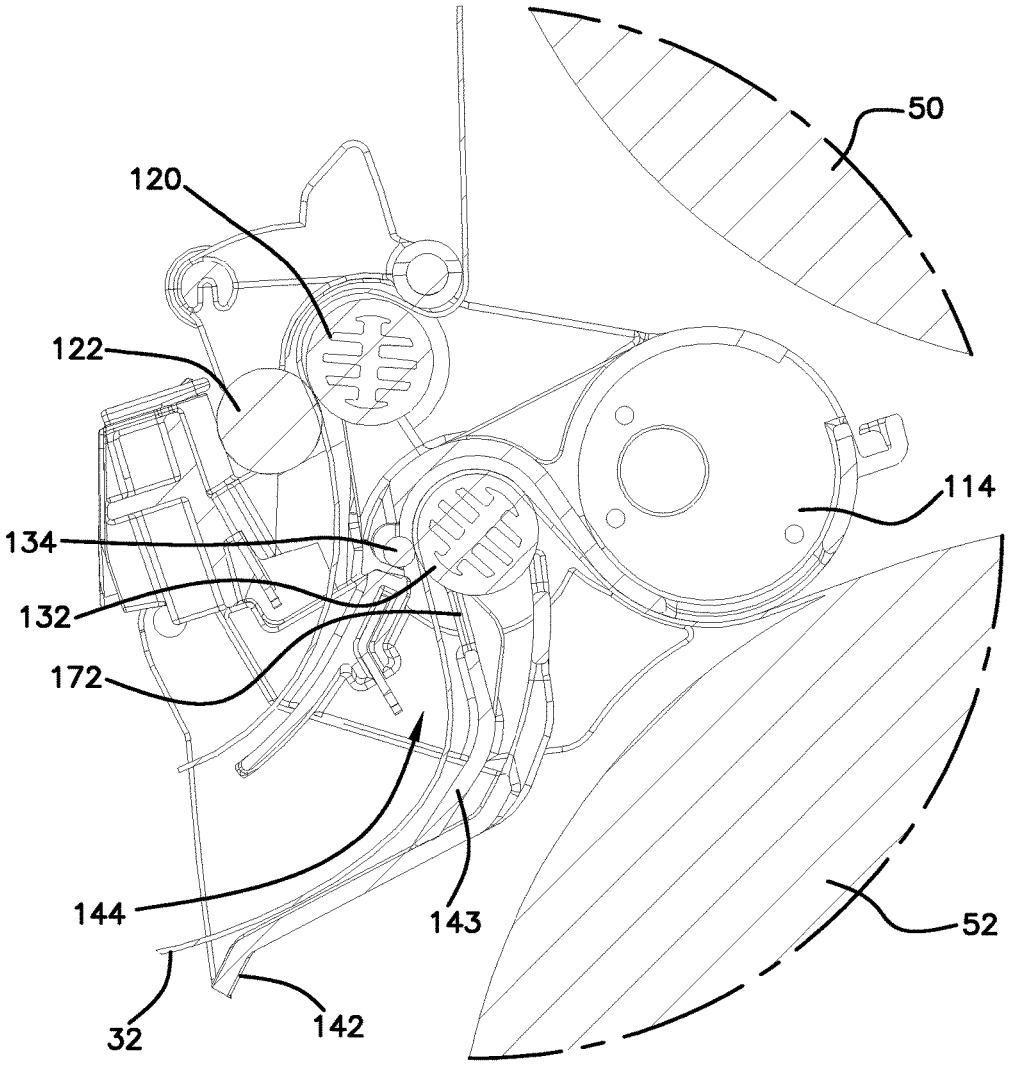
FIG. 34 is an enlarged view of a portion of the lower drive mechanism shown in FIG. 28 showing a stripper bar in accordance with the principles of the present disclosure.

In one example, the upright frame 152 can define a slot 158 for loading paper sheets from the lower roll 52. In one example, paper sheets can be loaded by coming off the bottom of the lower roll 52. In another example, paper sheets can be loaded by coming off the top of the lower roll 52, as shown in FIG. 34. The upright frame 152 can include a top surface 160 from which a plurality of feeding projections 162 extend upwardly therefrom. In certain examples, the plurality of feeding projections 162 can be spaced by gaps 164. The plurality of feeding projections 162 provide sufficient surface area to help cause the paper sheets to be pulled around the lower drive roller 132. The plurality of feeding projections 162 are discussed and illustrated in more detail with reference to FIG. 30.

As shown in FIG. 28, the feeder assembly 142 pivots open along pivot point 156 in preparation of feeding paper from the lower roll 52 through the slot 158 of the feeder assembly 142.

Figure 30:
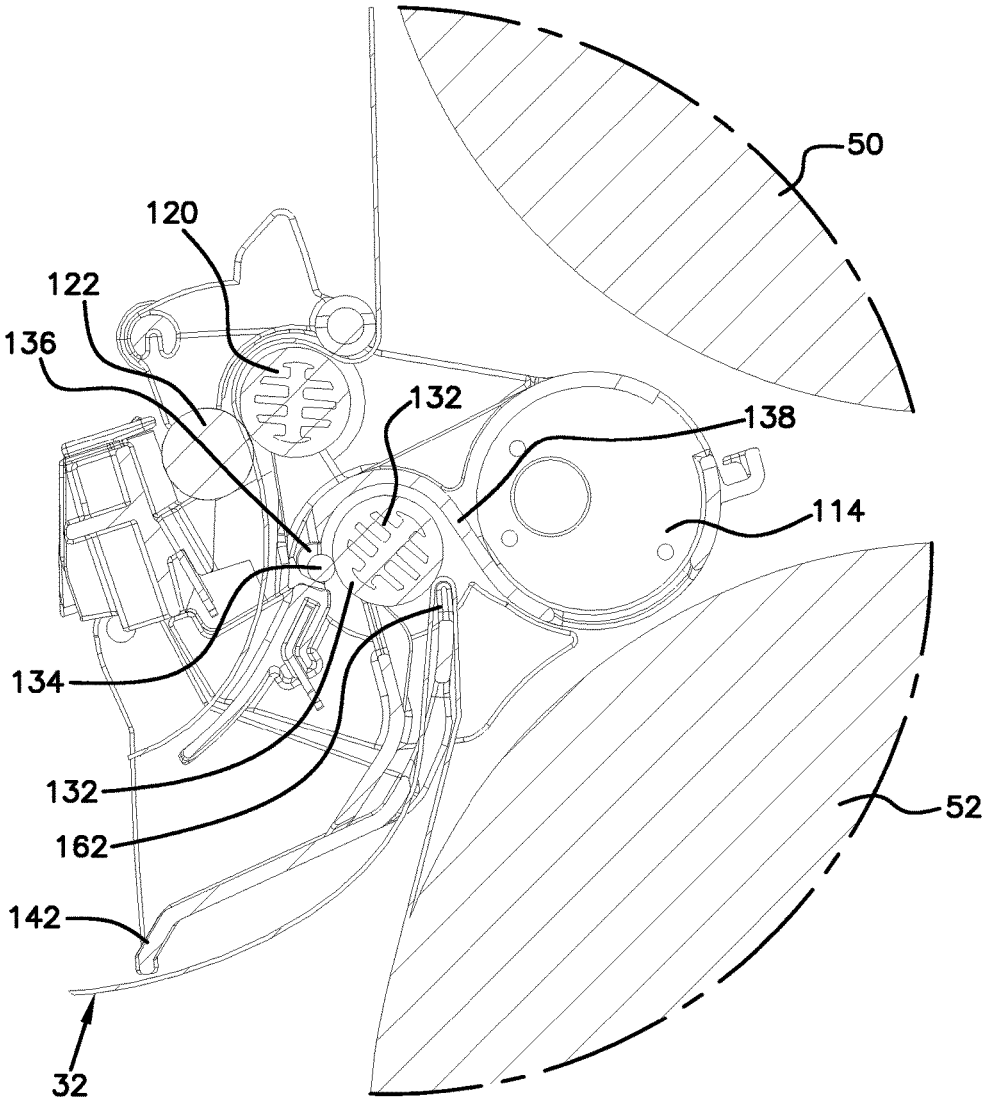
FIG. 30 is an enlarged view of a portion of the lower drive mechanism shown in FIG. 28.

Referring to FIG. 30, the paper towel 32 from the lower roll 52 can wrap around the feeder assembly 142 such that it loops up and over the plurality of feeding projections 162. The feeder assembly 142 can rotate to a close position to load the folded end 33 of the paper towel 32 from the lower roll 52 against the lower drive roller 132. In certain examples, the configuration of the feeding projections 162 can help to ensure that the paper towel 32 contacts the lower drive roller 132 and be pulled around for proper loading.

In one example, the feeding projections 162 can align with the gaps 133 of the lower drive roller 132 to help guide sheets of paper towel 32 over the lower drive roller 132. The motor 114 can be used to drive the lower drive roller 132 which can pull the paper towel 32 around the lower pinch roller 134 within the paper roller trough 136, as shown in FIG. 27.

Figure 31:
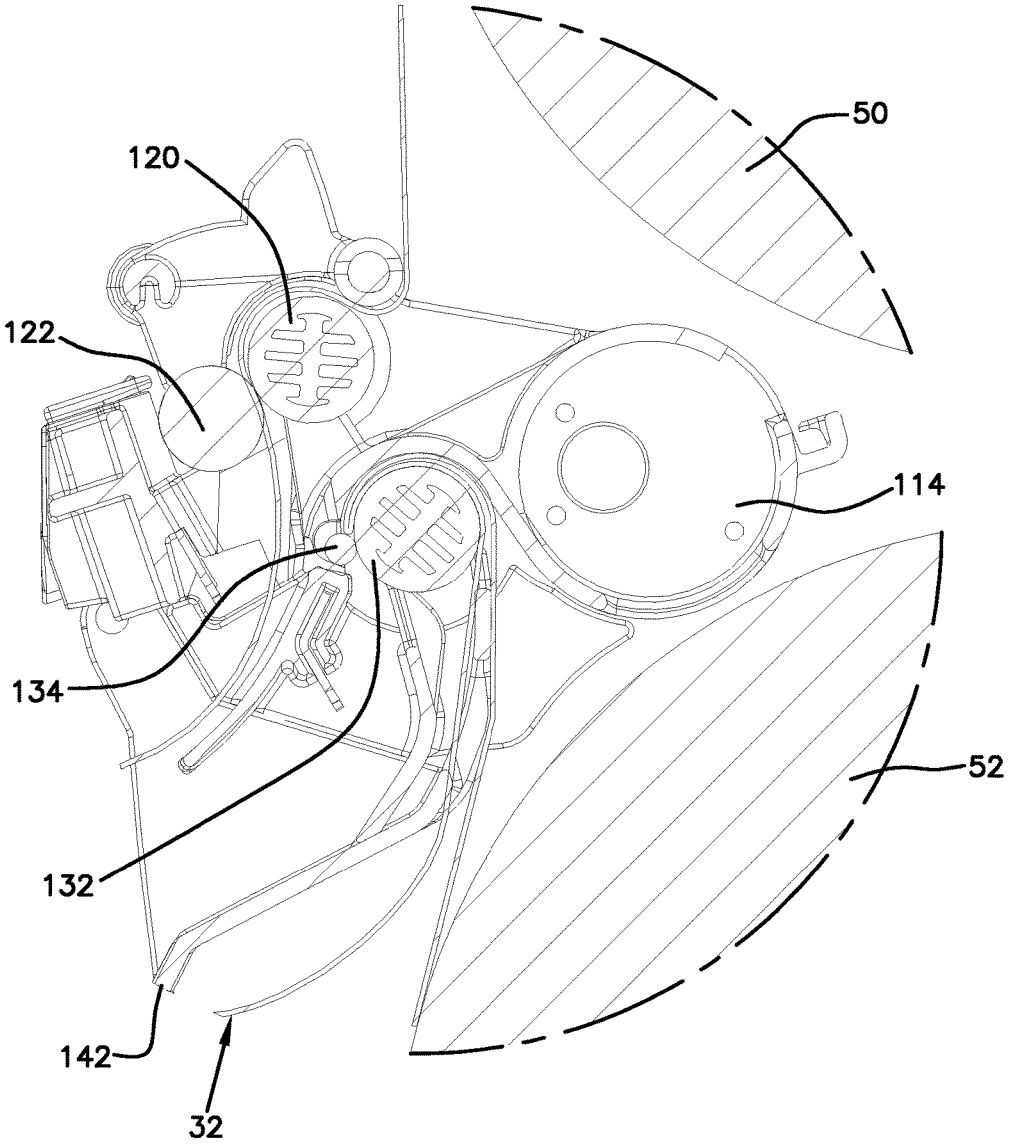
FIG. 31 is an enlarged view of a portion of the lower drive mechanism shown in FIG. 28.

Referring to FIG. 31, the motor 114 drives the lower drive roller 132 to pull the paper towel 32 past the lower pinch roller 134. In one example, the lower pinch roller 134 can float within the paper roller trough 136 to allow the folded end 33 of the paper towel 32 to be fed between the lower pinch roller 134 and the lower drive roller 132.

Figure 32:
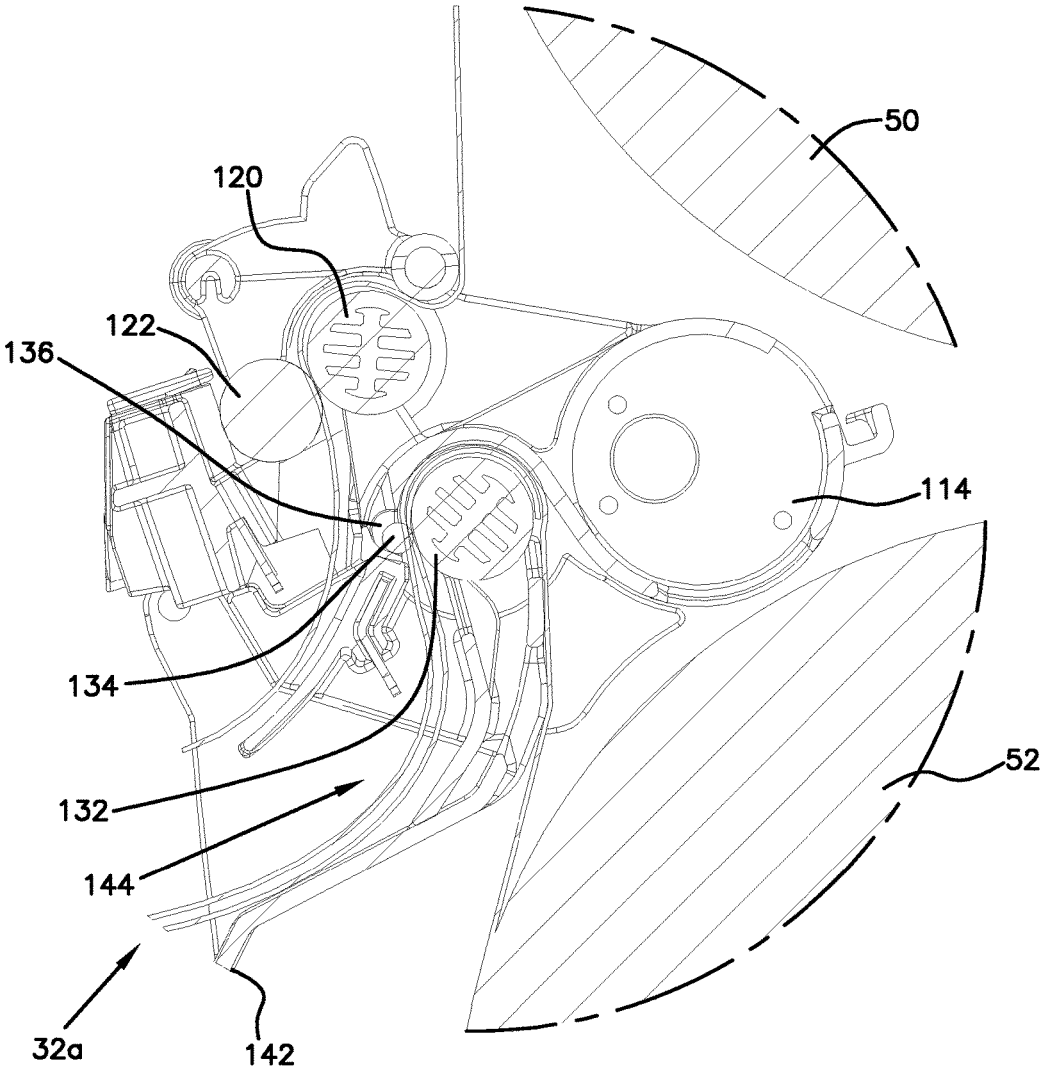
FIG. 32 is an enlarged view of a portion of the lower drive mechanism shown in FIG. 28.
Figure 33:
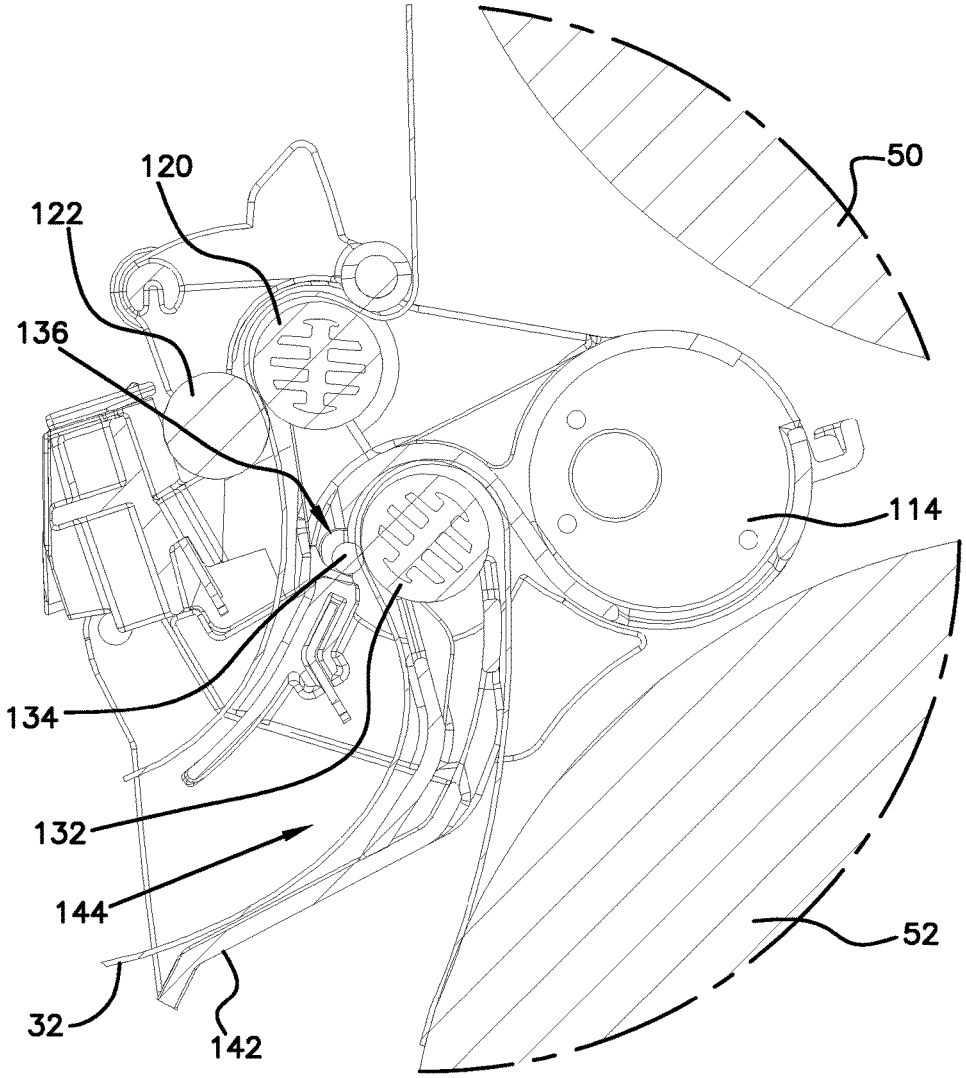
FIG. 33 is an enlarged view of a portion of the lower drive mechanism shown in FIG. 28.

Referring to FIGS. 32-33, the lower pinch roller 134 can back away from the lower drive roller 132 to allow two sheets of paper 32*a* to be accepted between the lower pinch roller 134 and the lower drive roller 132. The sheets help provide enough tension in order to be dispensed out. After the sheets of paper 32*a* passes through the paper roller trough 136, the lower pinch roller 134 can slide back to the lower drive roller 132. The lower pinch roller 134 can maximize the wrap angle around the lower drive roller 132 to help the lower drive roller 132 pull the paper towel 32. The motor 114 can continue to run to dispense the paper towel 32 out of the lower chute area 144.

Referring again to FIG. 29, the stripper bar 143 can include mating members 166 positioned along a lower surface 168 of the stripper bar 143. The mating members 166 can be constructed to engage the apertures 148 in the bottom tray 146 of the feeder assembly 142. The mating members 166 can help attach and support the stripper bar 143 on the feeder assembly 142. The stripper bar 143 includes an upper surface 170 from which a plurality of fingers 172 extend upwardly therefrom. In certain examples, the plurality of fingers 172 can be spaced by gaps 174.

In one example, the stripper bar 143 can include two brackets 176 on opposite sides of the stripper bar 143. In certain examples, the two brackets 176 can be secured to the stripper bar 143 by, for example, adhesive, fasteners, welding, brazing, or combinations of these or other bonding techniques. Each of the two brackets 176 can define a cavity 178 for receiving the lower blade 140. The stripper bar 143 can house a portion of the lower blade 140 within sleeves 180 adjacent to the two brackets 176. In one example, the sleeves 180 can be hollow for receiving and securing the lower blade 140 therein. In certain examples, the sleeves 180 can be integrated with or coupled to the two brackets 176. In other examples, the sleeves 180 can be secured to the stripper bar 143 by, for example, adhesive, fasteners, welding, brazing, or combinations of these or other bonding techniques.

Referring to FIG. 34, the plurality of fingers 172 of the stripper bar 143 can help guide the sheet paper out of the lower chute area 144 to prevent the sheet paper from wrapping back around the lower drive roller 132 and causing a jam. In one example, the plurality of fingers 172 can align with the gaps 133 of the lower drive roller 132 to help guide sheets of paper towel 32 out of the lower chute area 144. After the paper towel 32 is dispensed, the user can pull the paper towel 32 along the lower blade 140 to tear the paper towel 32.

Figure 35:
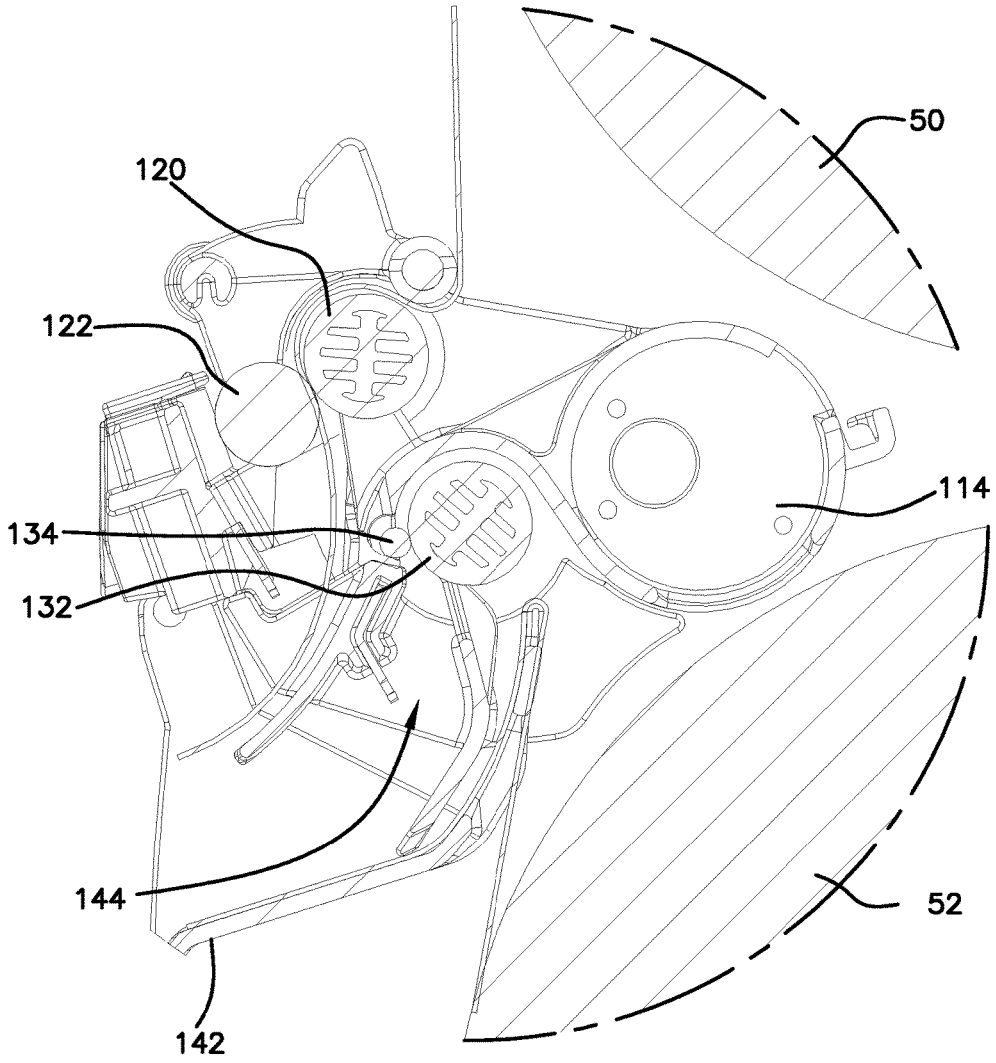
FIG. 35 is an enlarged view of a portion of the lower drive mechanism shown in FIG. 28 illustrating improper loading.
Figure 36:
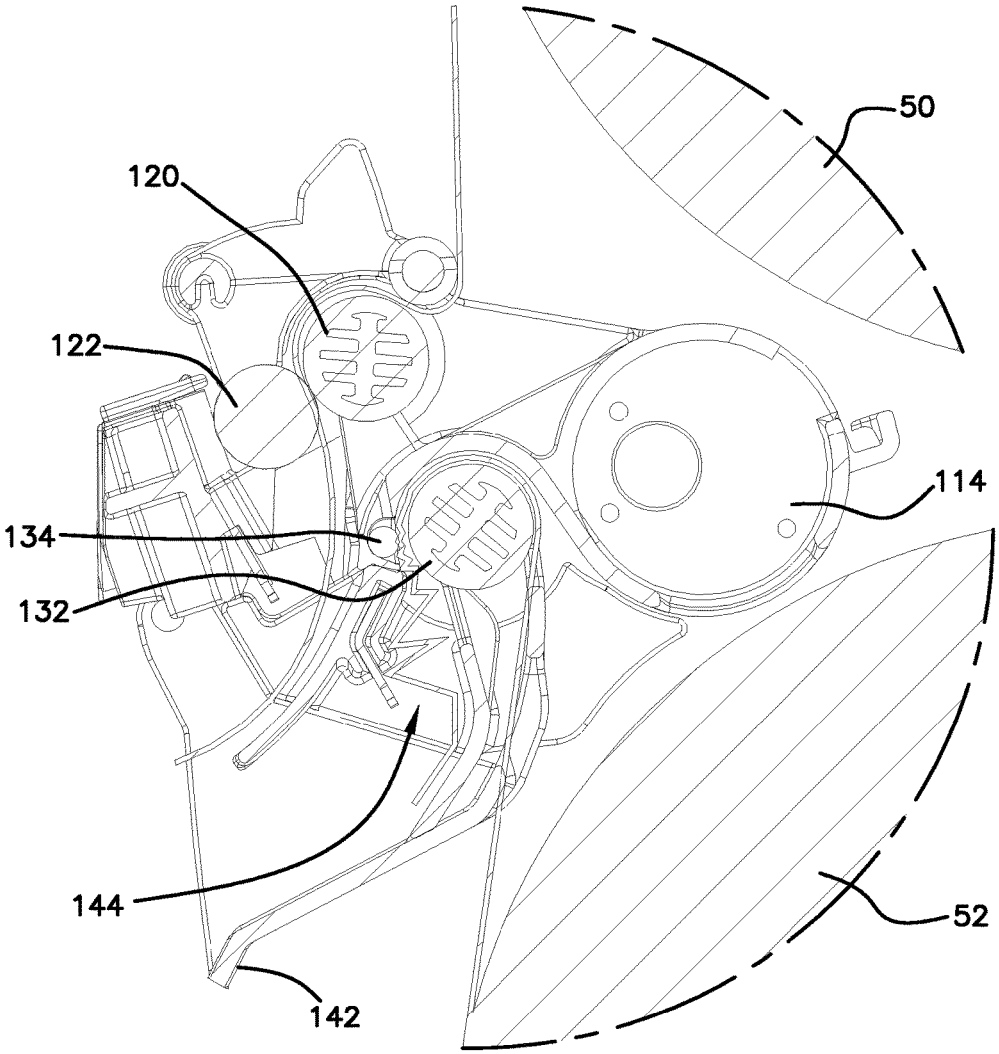
FIG. 36 is an enlarged view of a portion of the lower drive mechanism shown in FIG. 28 illustrating a paper jam.
Figure 37:
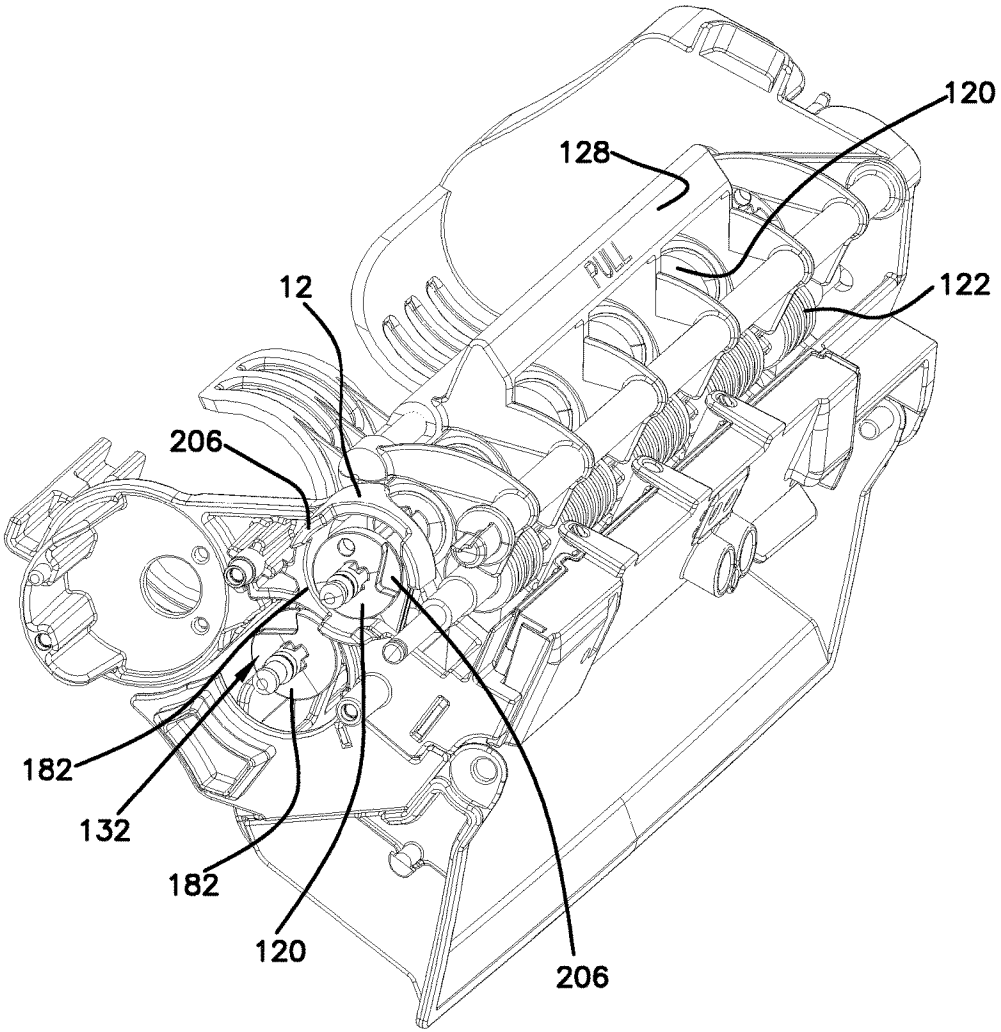
FIG. 37 is a perspective view of the drive module assembly showing a cam stop in accordance with the principles of the present invention.

Referring to FIGS. 35-36, an illustration of improperly loading the feeder assembly 142 is shown where the sheet is wrapped incorrectly. In the position illustrated, the sheet will not transfer to be loaded. If a jam or backup occurs in the lower chute area 144, the lower pinch roller 134 can be pushed away from the lower drive roller 132 to eliminate the force required to drive the paper sheet over the lower drive roller 132 so that no further paper can be dispensed. Once paper is pulled out of the lower chute area 144, the lower pinch roller 134 can fall against the lower drive roller 132 and paper can be dispensed again normally.

In one example, the size of the lower pinch roller 134 can provide for two paper sheets to have two discharge paths for dispensing out of separate independent locations. The paper from the upper roll 50 can be dispensed out of the upper chute area 126 from around the upper drive roller 120 and the paper from the lower roll 52 can be dispensed out of the lower chute area 144 from around the lower drive roller 132.

Referring to FIGS. 29 and 37-39, aspects of a drive system 248 including the motor 114 and a drive gear train 250 for selectively actuating the upper and lower drive rollers 120, 132 are shown in greater detail. In one aspect, the motor 114 is configured to be selectively driven in a first rotational direction R1 and driven in a second rotational direction R2 opposite the first rotational direction R1. As discussed in more detail later, the drive direction of the motor 114 can be controlled via the control circuit 208 such that dispenser 10 dispenses paper towels 32 from the upper roll 50 when the motor 114 is driven in the first direction A and dispenses paper towels 32 from the lower roll 52 when the motor 114 is driven in the second direction B. In one example, the control circuit 208 includes an H-circuit for selectively reversing polarity to the motor 114.

In one aspect, the motor 114 is provided with a motor drive shaft 115 onto which a first drive gear 252 and a second drive gear 254 are each mounted. Although not limited to such a configuration, the gears 252, 254 are the same size as each other having the same diameter and the same number of teeth. As shown, each of the gears 252, 254 is mounted to the motor drive shaft 115 via a respective one-way clutch bearing 256, 258. The one-way clutch bearings 256, 258 are constructed and configured to allow torque to be transferred from the motor drive shaft 115 to the gear 252, 254 only in one direction of rotation of the drive shaft 115.

In the embodiment shown, the clutch bearing 256 associated with the first drive gear 252 only transmits torque to the first drive gear 252 when the motor 114 powers the drive shaft 115 in the first rotational direction R1. Similarly, the clutch bearing 258 associated with the second drive gear 254 only transmits torque to the second drive gear 254 when the motor 114 powers the drive shaft 115 in the second rotational direction R2. This configuration ensures that one and only one of the first and second drive gears 252, 254 is ever driven by the motor 114 at any given time such that paper towels 32 are only dispensed from one of roll 50 and roll 52 and such that the motor 114 only drives the drive gears 252, 254 in the dispensing direction. However, it is noted that the disclosure is not limited to only such a configuration and that the clutch bearings 256, 258 could be arranged to drive both of the drive gears 252, 254 in the same direction for simultaneous dispensing in one motor direction. The drive gears 252, 254 could also be directly mounted to the drive shaft 115 in some applications where it is such a configuration would be desirable.

As shown, the first drive gear 252 drives an upper roller gear 182*a* that is mounted to a shaft 188*a* of the upper drive roller 120. An idler gear 260 is also provided that is intermeshed with the gears 252, 182*a*. Thus, when the motor 114 is driven in the first rotational direction R1, the upper drive roller 120 is also driven in the first rotational direction R1. However, when the motor is driven in the second rotational direction R2, no torque is transmitted to the first drive gear 252 and the upper drive roller 120 will remain stationary. It is noted that the use of one or more idler gears 260 is not necessary in all applications, but is useful where it is desired to have the upper drive roller 120 rotating in the same direction as first drive gear 252 and/or to accommodate a distance between shafts 115 and 188.

The second drive gear 254 is shown as driving a lower roller gear 182*b* that is intermeshed with the second drive gear 254 and that is mounted to a shaft 188*b* of the lower drive roller 132. Thus, when the motor 114 is driven in the second rotational direction R2, the lower drive roller 132 is driven in the first rotational direction R1. However, when the motor is driven in the first rotational direction R1, no torque is transmitted to the first drive gear 252 and the lower drive roller 132 will remain stationary. It is noted that the use of one or more idler gears could be used in conjunction with the second drive gear 254 and the lower roller gear 182*b*.

It is also noted that the drive gear train 250 is configured such that, regardless of motor direction, the upper and lower drive rollers 120, 132 are driven in the same direction (i.e. first rotational direction A) to dispense a paper towel 32. This functionality of the dispenser 10 is ensured even when the motor wiring may be incorrect as driving the motor 114 in any direction will result in dispensing of a paper towel 32 from one of the rolls 50, 52. It is also possible to configure the drive gear train 250 such that the upper and lower drive rollers 120, 132 rotate in opposite directions or both operate in the second rotational direction B, if desired.

With the above described drive system 248, it is possible for the control circuit 208 to automatically switch between dispensing from the upper roll 50 and the lower roll 52 when either of the rolls 50, 52 is completely dispensed simply by changing the motor drive direction. This independent dispensing functionality eliminates the need to move stub rolls and also enables each roll 50, 52 to be fully dispensed and replaced with a new roll without causing interference with or modification of an already installed roll 50, 52 that is not yet depleted.

Figure 38:
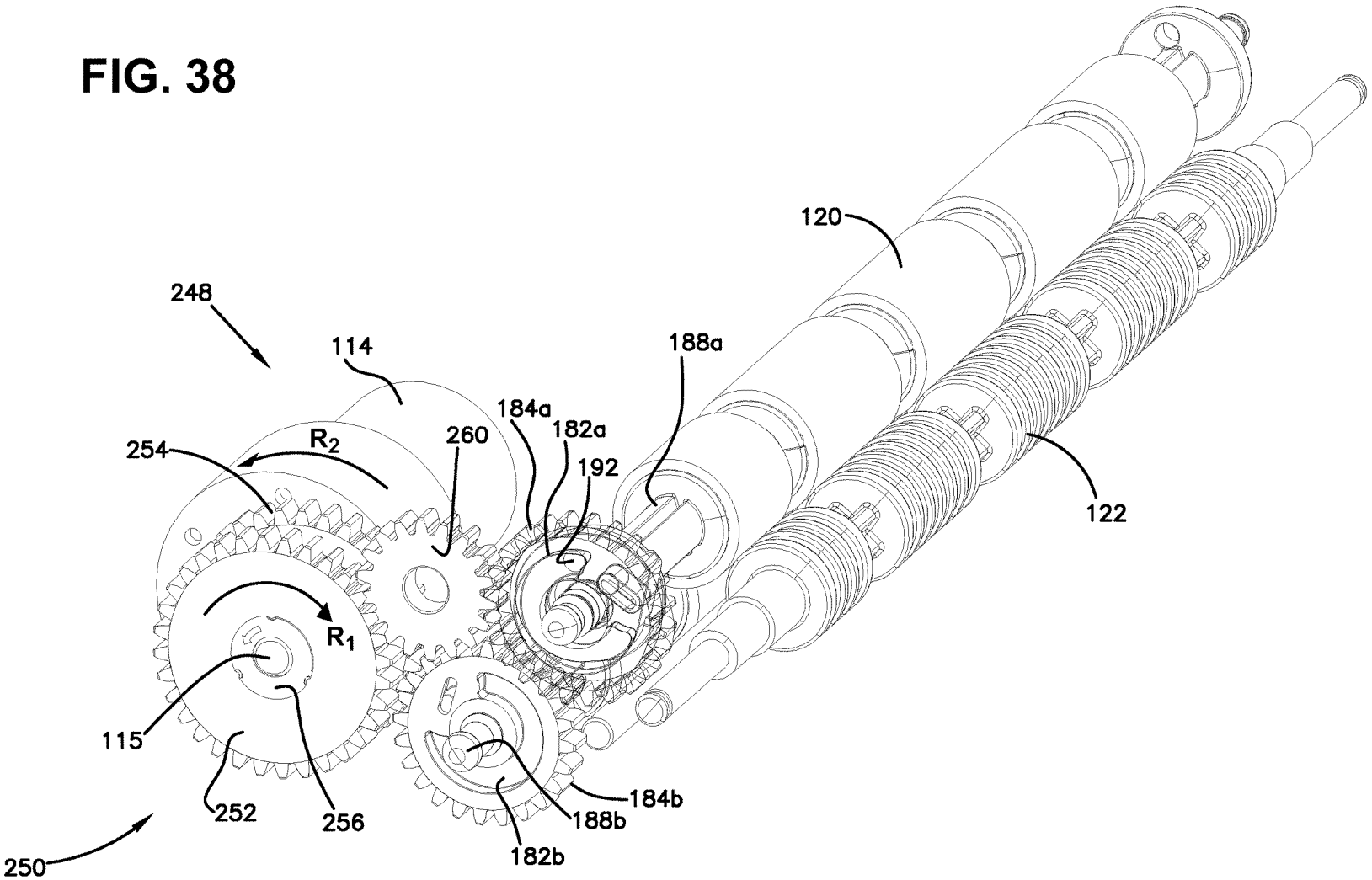
FIG. 38 is a perspective view of the cam stop with the housing removed.

As shown, each of the upper and lower drive rollers 120, 132 can each include a respective cam stop 182*a*, 182*b* (referred to as 182) that interacts with the respective roller gear 184*a*, 184*b* (referred to as 184). The cam stop 182 is arranged and configured to prevent further dispensing of paper when a user tries to bypass the functionality of automatic dispensing. Referring to FIG. 38, the cam stop 182 can interact with the roller gear 184 adjacent to the housing 12 to lock the upper and lower drive rollers 120, 132 to prevent further dispensing of paper.

Figure 39:
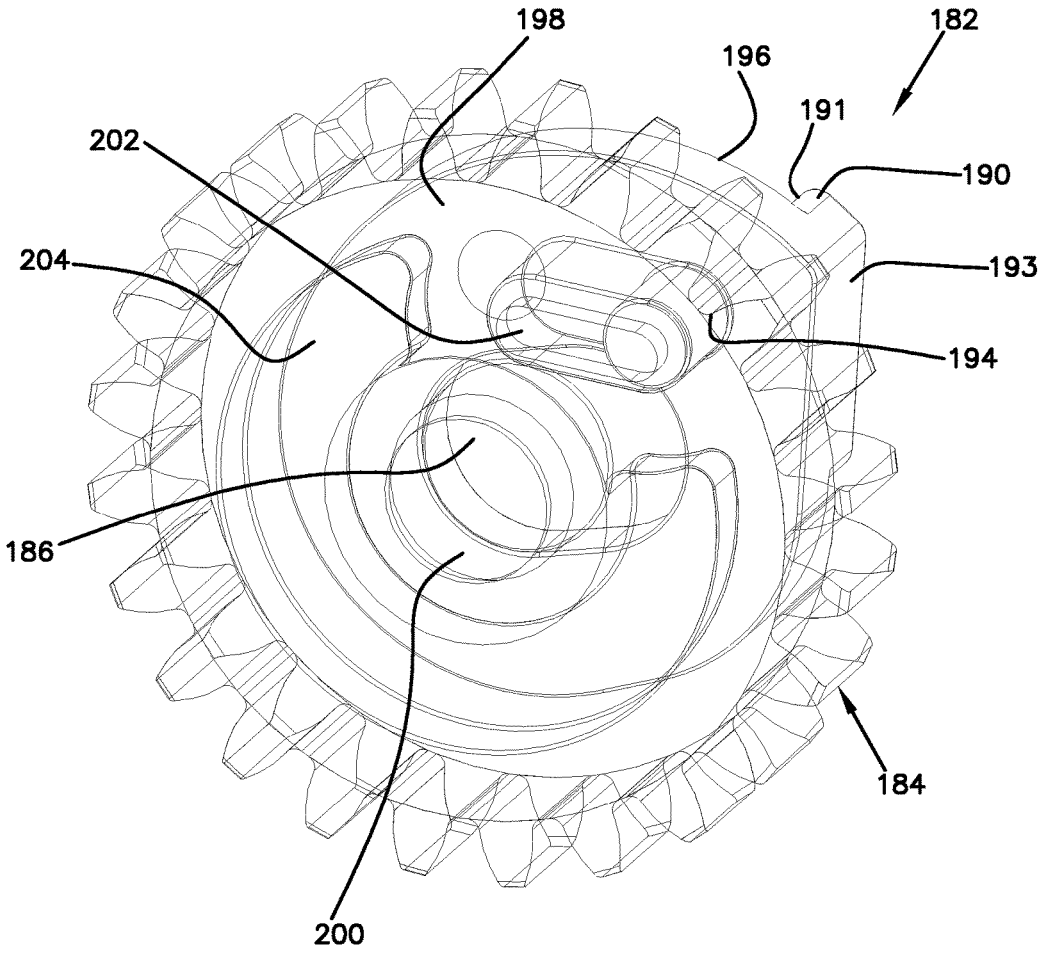
FIG. 39 is an enlarged view of the cam stop shown in FIG. 38.

FIG. 39 is an enlarged view of the cam stop 182 and roller gear 184. As most easily seen at FIG. 38, the cam stop 182 can define an opening 186 for receiving the shaft respective shaft 188*a*, 188*b* (referred to as 188) of the upper and lower drive rollers 120, 132. The cam stop 182 can include a lock 190, a pivot pin 192 and a post 194. The lock 190 can include a drive surface 191, and a locking surface 193. The lock 190 and the pivot pin 192 can be constructed on a first side 196 of the cam stop 182 and the post 194 can be constructed on a second side 198 of the cam stop 182. The roller gear 184 defines an opening 200 that aligns with the opening 186 on the cam stop 182 for receiving the shaft 188 of the upper and lower drive rollers 120, 132. The roller gear 184 can include a slot 202 and a ring opening 204.

In one example, the roller gear 184 can drive the cam stop 182 by the slot 202 of the roller gear 184 interacting with the post 194 of the cam stop 182. The cam stop 182 can be connected loosely to the upper and lower drive rollers 120, 132 but can contact the upper and lower drive rollers 120, 132 through the locking surface 190 and the pivot pin 192. The roller gear 184 and the cam stop 182 will drive in the same direction.

In one example, the cam stop 182 is free to rotate about the pivot pin 192 with limitations imposed by the slot 202 on the roller gear 184 and the lock 190. If a user pulls paper when the motor 144 is off, the roller gear 184 will not move while the upper and lower drive rollers 120, 132 move. This action can cause the cam stop 182 to rotate about the pivot pin 192 to move the post 194 in the slot 202 of the roller gear 184. The locking surface 193 of the lock 190 can move outwardly from the center of the roller gear 184.

In certain examples, if a user continues to pull paper, the locking surface 193 can become fully extended and the post 194 can be moved to the opposite end of the slot 202. The housing 12 can include a single stop 206 (see FIG. 37) or multiple stops 206 radially spaced adjacent to the cam stop 182. The stops 206 can be constructed to abut the cam stop 182 when the cam stop 182 is fully engaged. In this position, the paper can no longer be pulled to be dispensed.

In one example, the cam stop 182 can be fully retracted such that it will not hit the stops 206 on the housing 12. Once the motor 114 is on, the roller gear 184 will turn and the cam stop 182 can rotate out of the locking position so that paper can be dispensed once again.

In one example, dispensing towel from the electronic dual roll paper towel dispenser 10 includes arranging the upper roll 50 on the upper mandrel 62 and arranging the lower roll 52 on the lower mandrel 64. The electronic dual roll paper towel dispenser 10 can be mounted to the wall 5. The upper and lower rolls 50, 52 can be located within the housing 12 and dispensed through opening 118 in the front wall 13. The electronic dual roll paper towel dispenser 10 includes an upper drive mechanism 110 and a lower drive mechanism 112. Paper from the upper roll 50 can be located between the upper drive roller 120 and the upper pinch roller 122. Paper from the lower roll 52 can be located between the lower drive roller 132 and the lower pinch roller 134. Paper can be dispensed from the upper roll 50 through the opening 118 or dispensed from the lower roll 52 through the opening 118. In certain examples, a method of servicing the electronic dual roll paper towel dispenser 10 can include supplying paper the upper roll 50 is located on the upper mandrel 62 and the lower roll 52 is located on the lower mandrel 64.

Control Circuit

Referring again to FIGS. 40-41 and 48-57, the electronic dual roll paper towel dispenser 10 can include a control circuit 208 including a circuit board 207 for controlling the electronics of the electronic dual roll paper towel dispenser 10. An example control circuit is disclosed in U.S. Pat. Nos. 7,325,768, 6,293,486, 6,695,246, 6,854,684, 6,988,689, 7,325,767 and 7,354,015 which are hereby incorporated by reference in its entirety.

Figure 40:
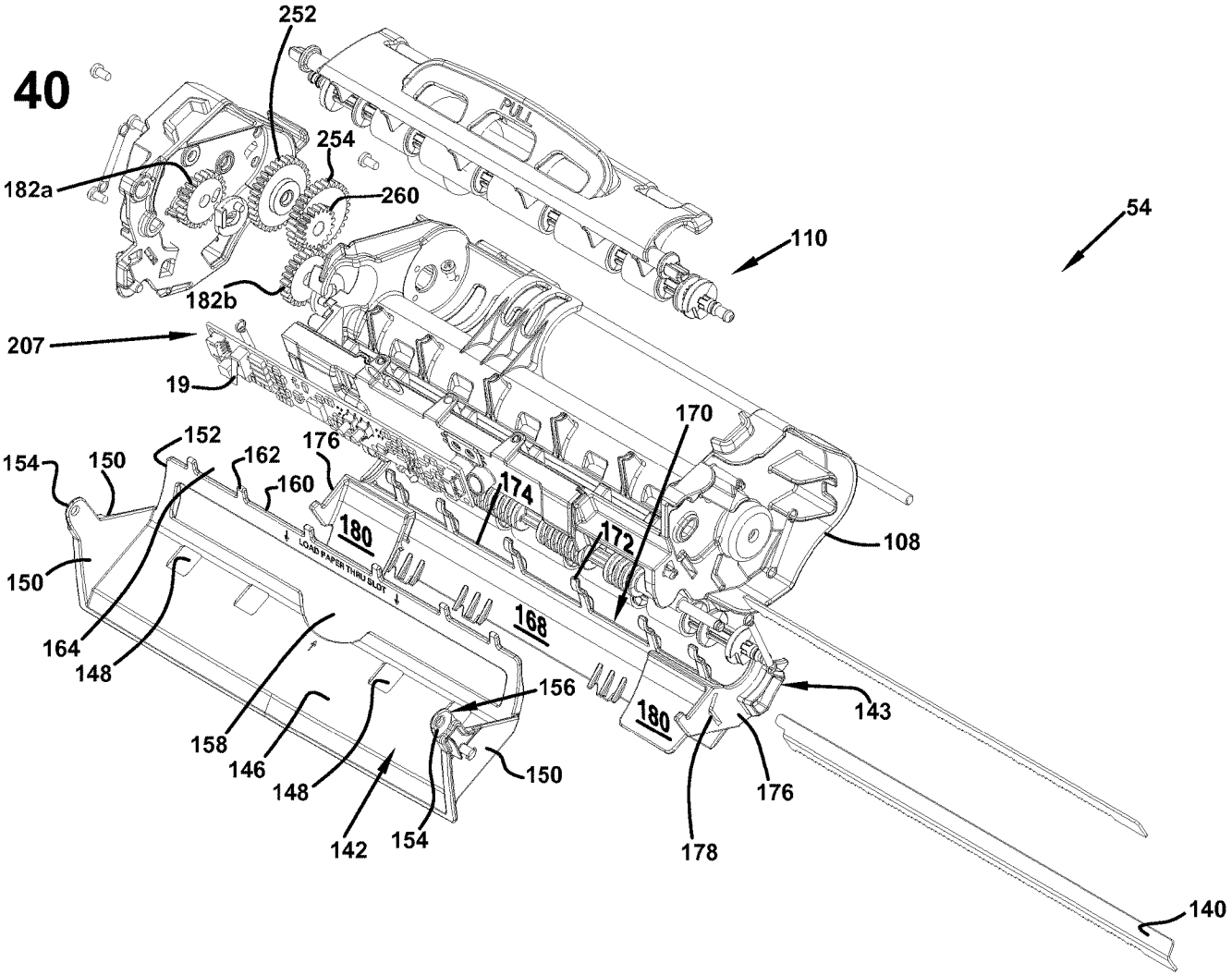
FIG. 40 is a perspective view of the drive module assembly showing the circuit board in accordance with the principles of the present invention.

Referring to FIG. 40, an exploded view of the drive module assembly 54 is shown. The drive module assembly 54 includes the control circuit 208. The control circuit 208 can include a switch 19 that can be configured to interact with a rib 17 (see FIG. 3) on the front cover 22. The features of the rib 17 and switch 19 are discussed and illustrated in more detail with reference to FIGS. 43-44.

Figure 41:
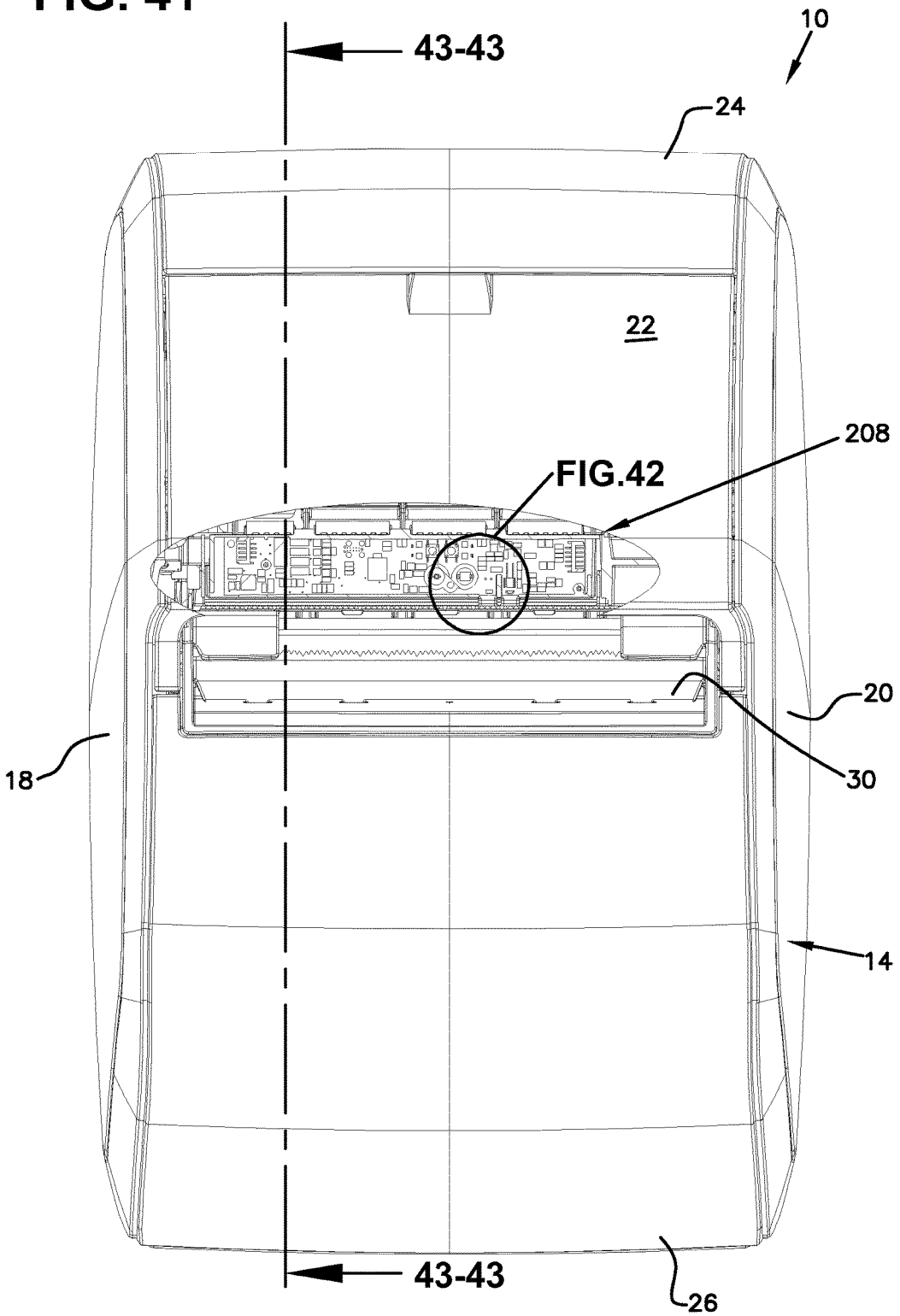
FIG. 41 is a front perspective view of the electronic dual roll paper towel dispenser showing the control circuit in accordance with the principles of the present invention.

Referring to FIG. 41, the control circuit 208 can be arranged and configured to mount within the housing 12 of the electronic dual roll paper towel dispenser 10. In one example, the control circuit 208 can include the paper sensor 210 and a hand sensor 212. In certain examples, the control circuit 208 can be arranged and configured to mount at an angle to direct the paper sensor 210 downward and backward and the hand sensor 212 downward and forward. However, the paper sensor 210 can be located anywhere between the source roll 50, 52 and the chute opening downstream of the drive rollers 120, 132.

Figure 44:
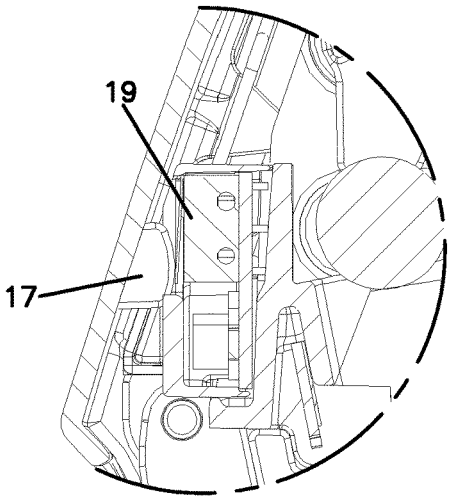
FIG. 44 is an enlarged view of a portion of the electronic dual roll paper towel dispenser shown in FIG. 43.
Figure 43:
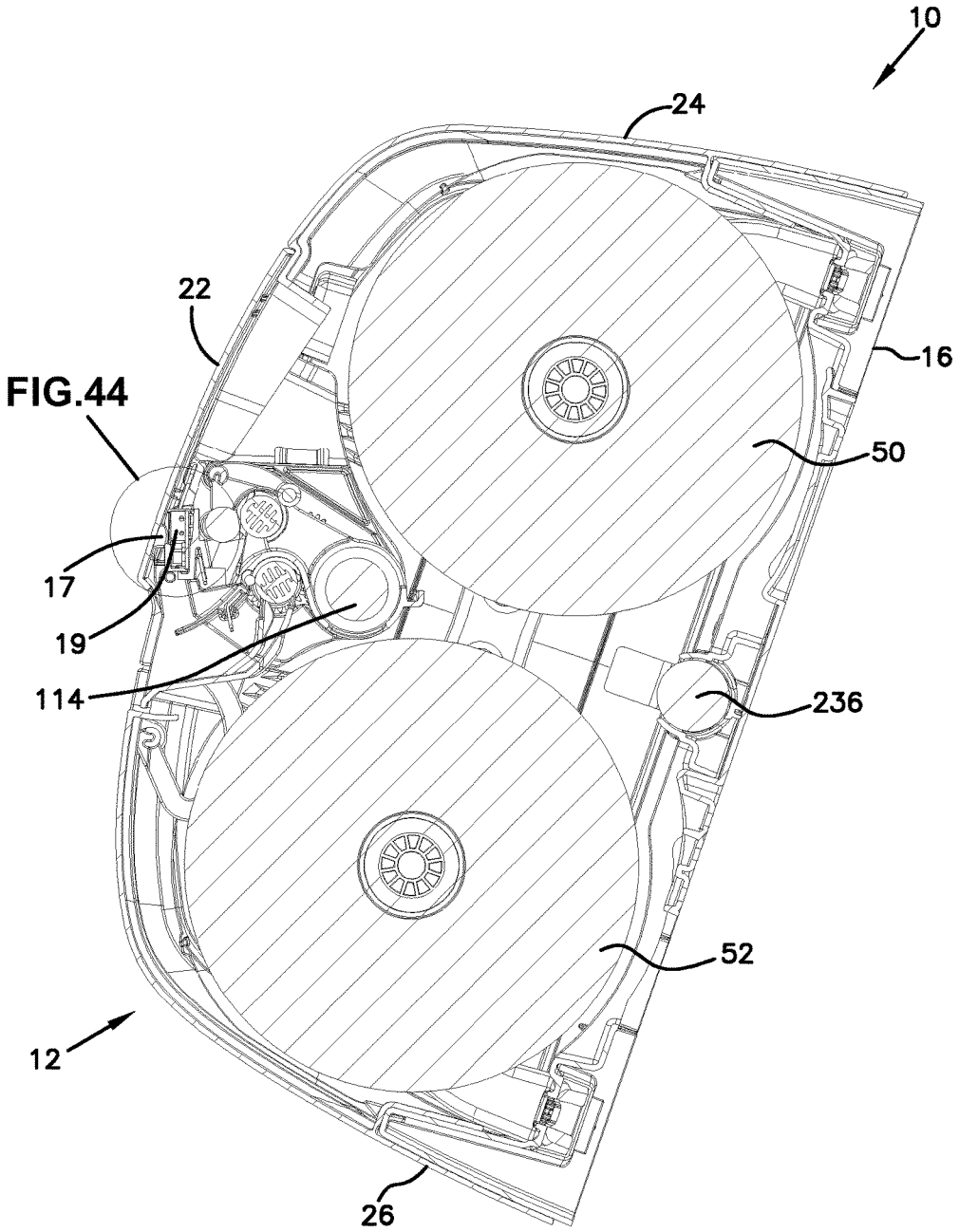
FIG. 43 is a cross-sectional view of the electronic dual roll paper towel dispenser shown in FIG. 41.

Referring to FIGS. 43-44, a cross-sectional view of the electronic dual roll paper towel dispenser 10 is shown to illustrate the features of the switch 19 of the control circuit 208. FIG. 44 is an enlarged view illustrating the interaction between the rib 17 of the front cover 22 and the switch 19 on the control circuit 208.

In one example, the switch 19 can be a mechanical switch or a magnetic switch. As shown, the rib 17 of the front cover 22 interacts with the switch 19 to control the electronics. In certain examples, the switch 19 can be activated by the rib 17 to turn on the electronics, with the switch 19 being closed by the rib when the front cover 22 is closed. When the switch 19 is closed, the electronic dual roll paper towel dispenser 10 is able to dispense toweling when triggered by the hand sensor 212. Otherwise, when the front cover 22 is open, the switch 19 is open turning off the electronics and the electronic dual roll paper towel dispenser 10 cannot dispense paper toweling.

Referring to FIG. 42, an enlarged portion of the control circuit 208 is depicted. In one example, the paper sensor 210 can be configured to include an infrared (IR) emitter 214 and an IR receiver 216. However, it should be understood that paper sensor 210 can be any type of electromechanical switch configured to detect the presence of paper and is not limited to only being an IR type switch. Additionally, the paper sensor 210 can include more than a single paper sensor 210, such as a first paper sensor 210 associated with roll 50 and/or 52 and a second paper sensor 210 associated with roll 50 and/or 52. Similarly, the hand sensor 212 can be configured to include an IR emitter 218 and an IR receiver 220. In certain examples, the front cover 22 is formed from a material that is transparent to IR thereby allowing IR light to pass through the front cover 22. Because the front cover 22 can allow IR light to pass therethrough, a hole to permit passage of IR light need not be formed in the front cover 22. Example sensors are disclosed in U.S. Pat. Nos. 7,325,767 B2 and 6,412,679 which is hereby incorporated by reference in its entirety.

Figure 45:
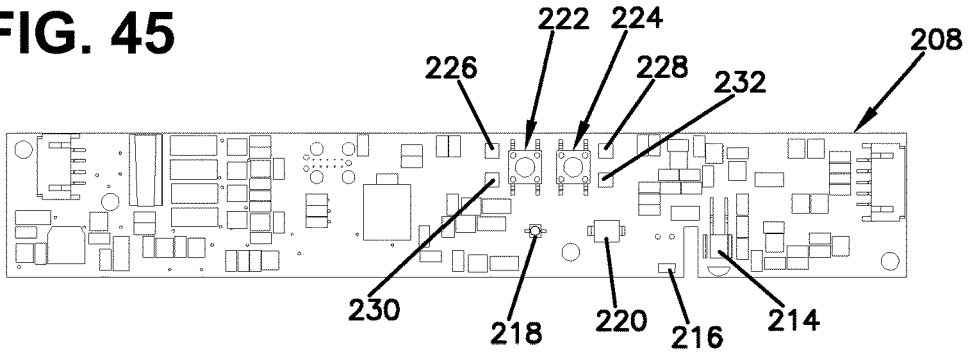
FIG. 45 is a front view of the control circuit shown in FIG. 41.

Referring to FIG. 45, a front plan view of the control circuit 208 is shown. The control circuit 208 can include a paper towel length switch 222, a dispense mode switch 224, LED 226, LED 228, LED 230, and LED 232. In one example, the paper towel length switch 222 can be used to control the length of the paper towel 32 that is dispensed.

In one example, the electronic dual roll paper towel dispenser 10 can include a power supply 234 for powering the drive module assembly 54. In one example, the power supply can be a battery. In the embodiment shown, the power supply 234 includes four batteries 236 arranged in a series configuration between two terminals 238 connected to the control circuit 208. Each of the batteries 236 may be removably held in place on the base 16 by one or more clips 240. As shown, three pairs of clips 240 are provided with each pair supporting and retaining the contacting ends of two batteries 236. The control circuit 208 can be used for receiving the signal from the paper sensor 210 and controlling the power supply to the drive module assembly 54.

Figures 46, 47, 48, 49, 50, 51, 52, 53, 54, 55, 56, 57:
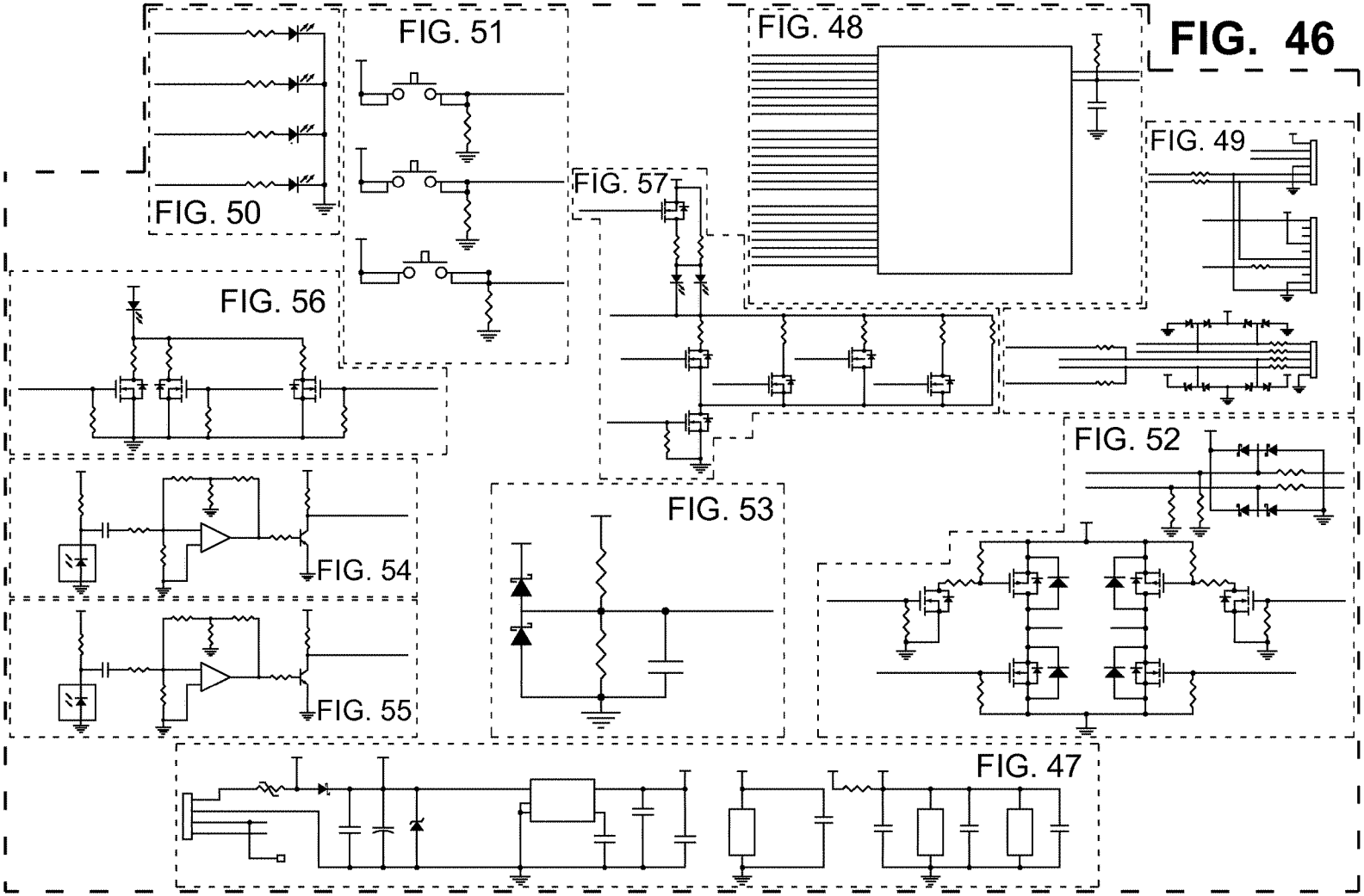
FIG. 46 is a schematic representation of the control circuit shown in FIG. 41.
FIG. 47 is a schematic representation of a power supply associated with the control circuit shown in FIG. 46.
FIG. 48 is a schematic representation of a microcontroller associated with the control circuit shown in FIG. 46.
FIG. 49 is a schematic representation of a debug and communication circuit associated with the control circuit shown in FIG. 46.
FIG. 50 is a schematic representation of an LED light circuit associated with the control circuit shown in FIG. 46.
FIG. 51 is a schematic representation of a switch input circuit associated with the control circuit shown in FIG. 46.
FIG. 52 is a schematic representation of a motor control circuit associated with the control circuit shown in FIG. 46.
FIG. 53 is a schematic representation of a battery voltage measurement circuit associated with the control circuit shown in FIG. 46.
FIG. 54 is a schematic representation of a hand sensing circuit associated with the control circuit shown in FIG. 46.
FIG. 55 is a schematic representation of a paper sensing circuit associated with the control circuit shown in FIG. 46.
FIG. 56 is a schematic representation of a hand sensor driver circuit associated with the control circuit shown in FIG. 46.
FIG. 57 is a schematic representation of a paper sensor driver circuit associated with the control circuit shown in FIG. 46.
Figure 47:
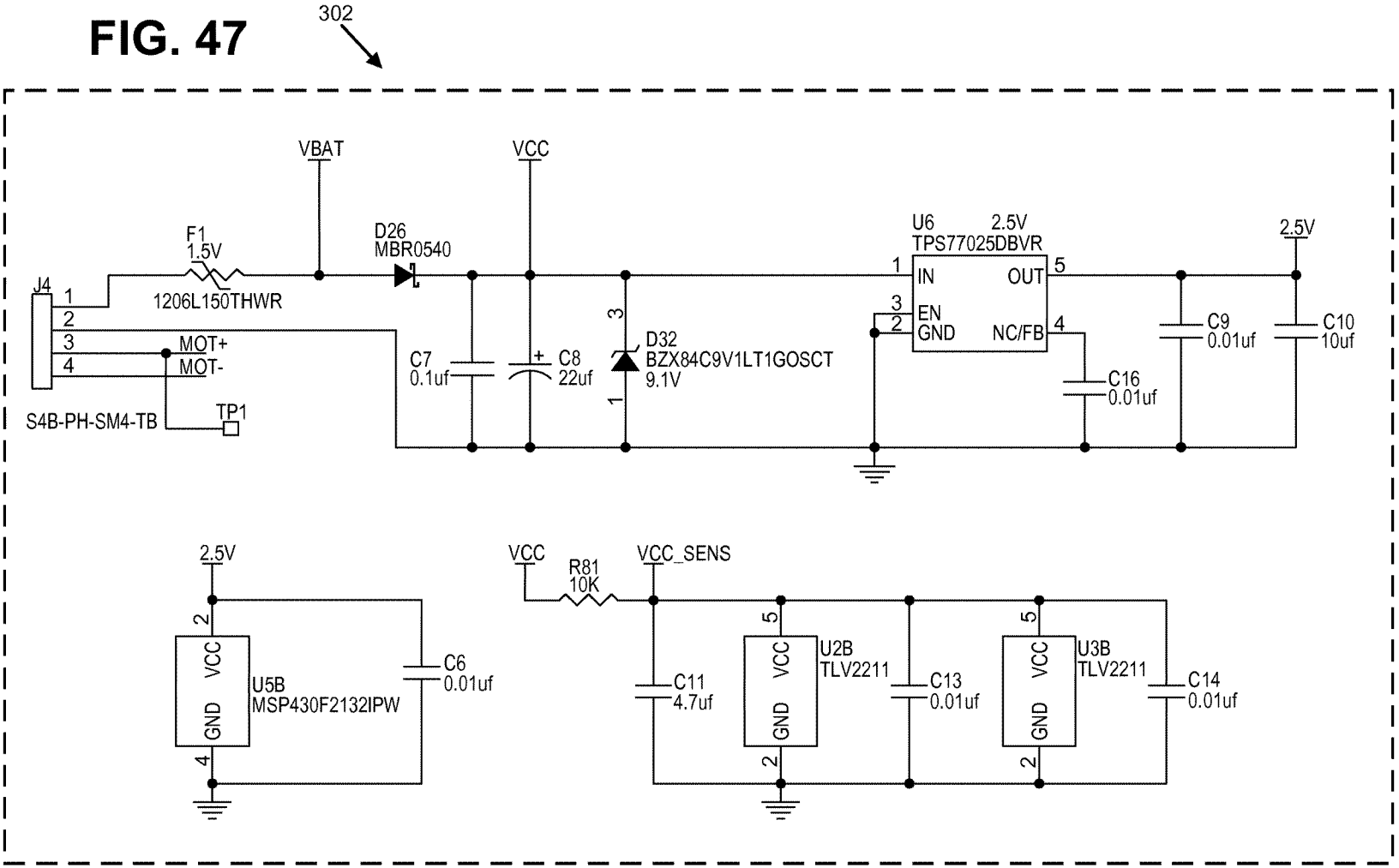
Figure 48:
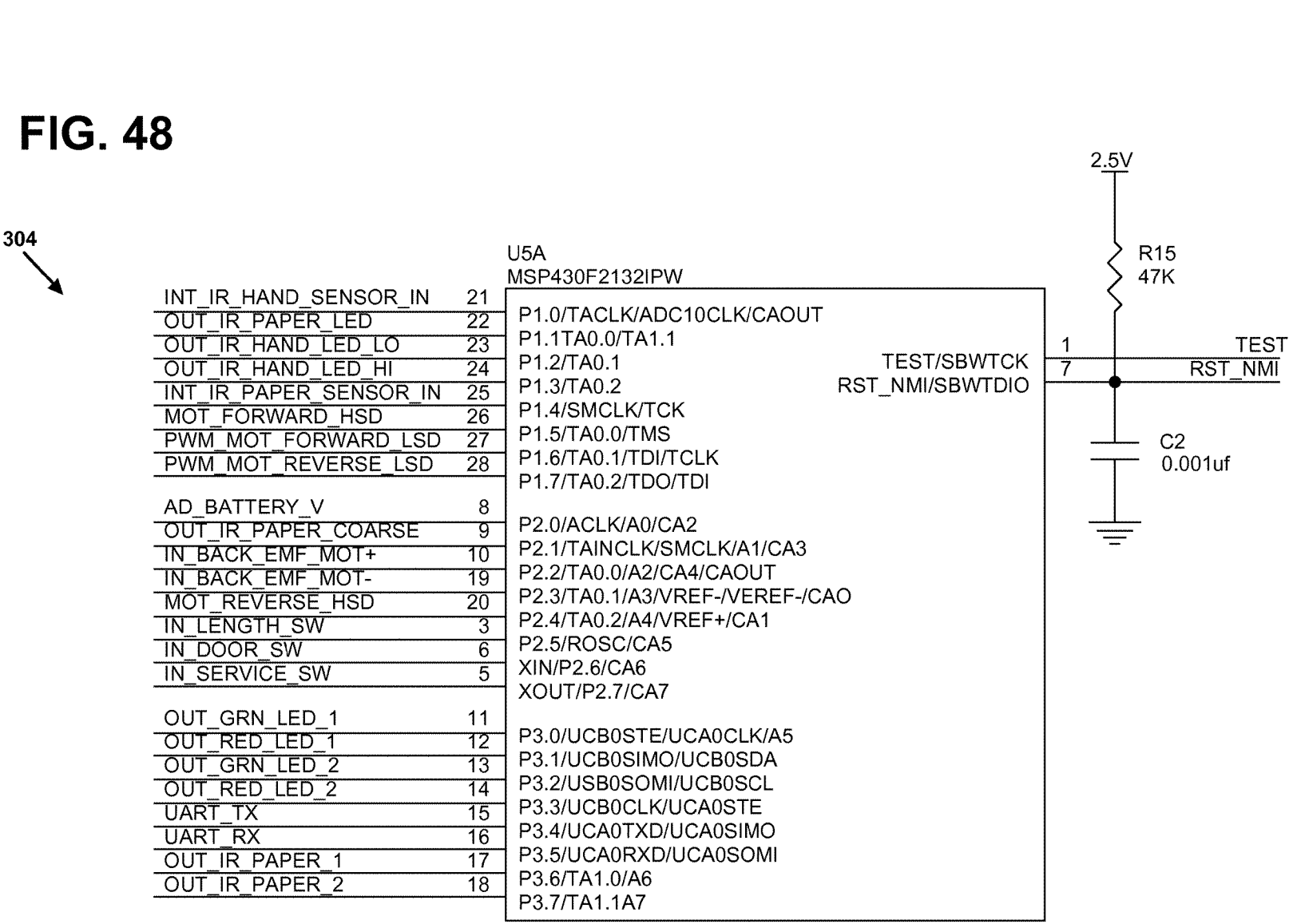
Figure 49:
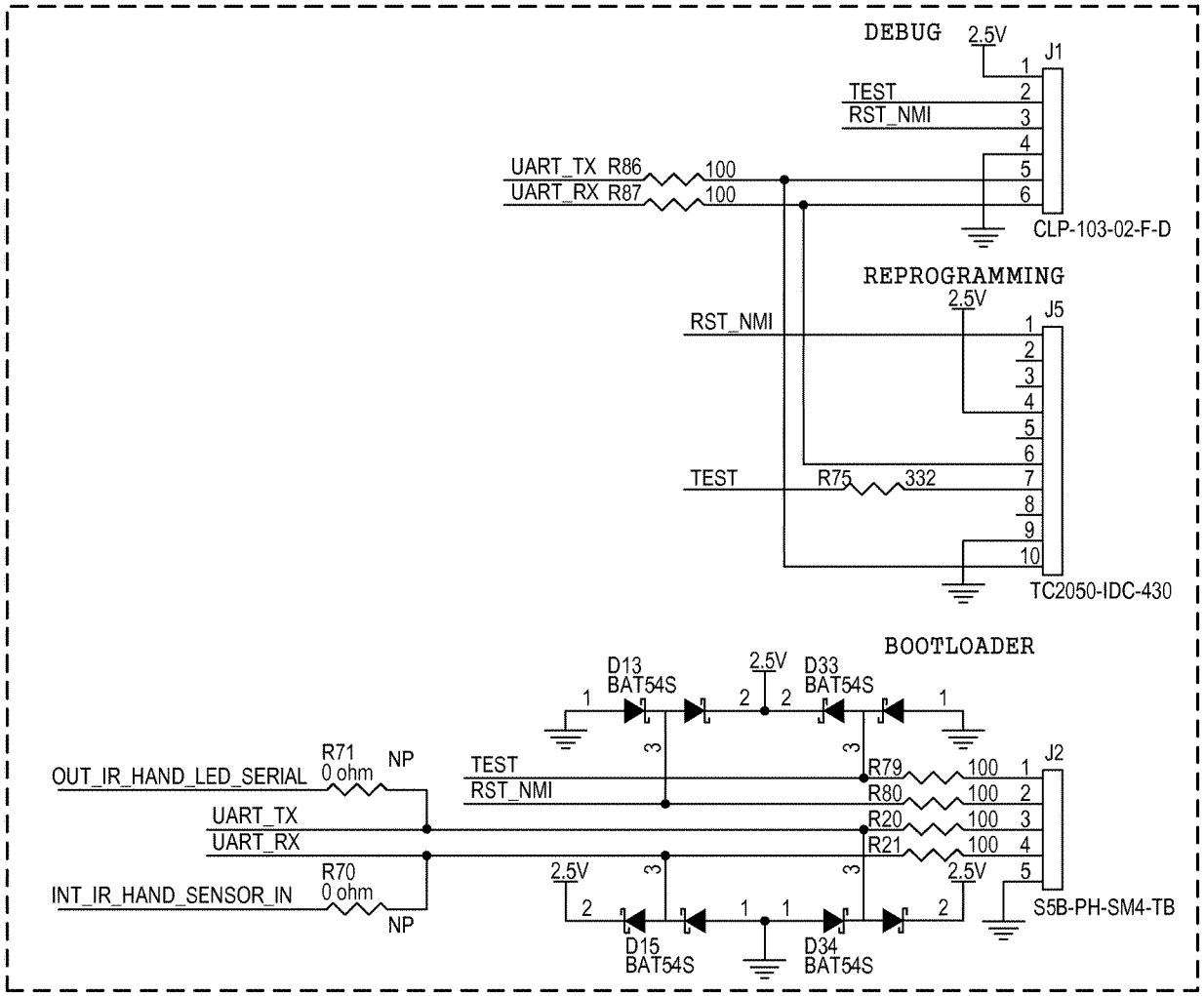
Figure 50:
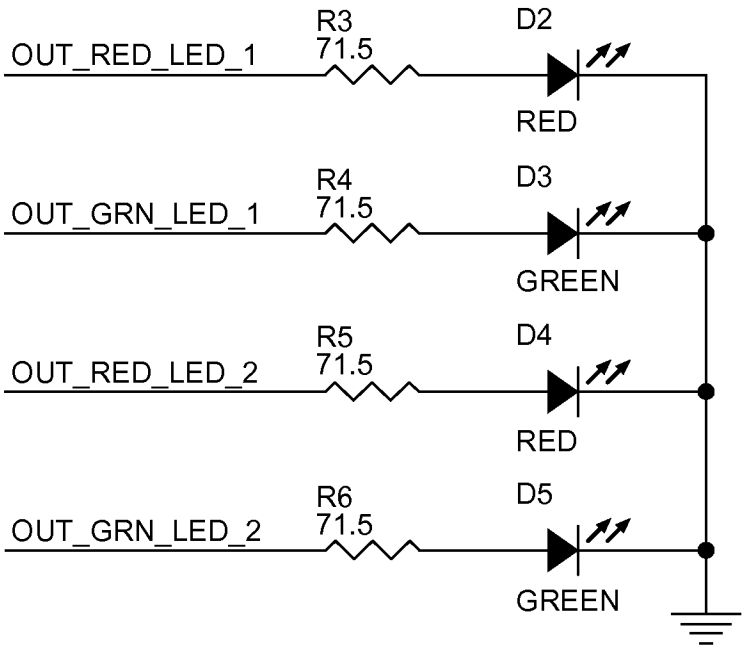
Figure 51:
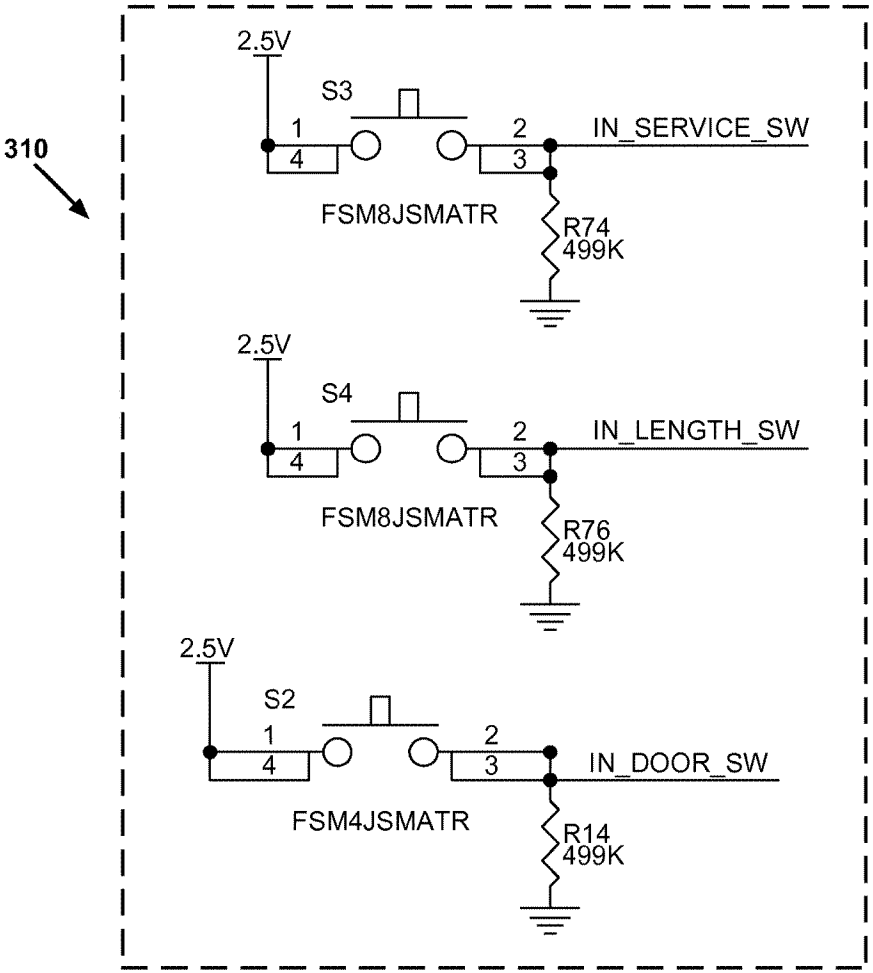
Figure 52:
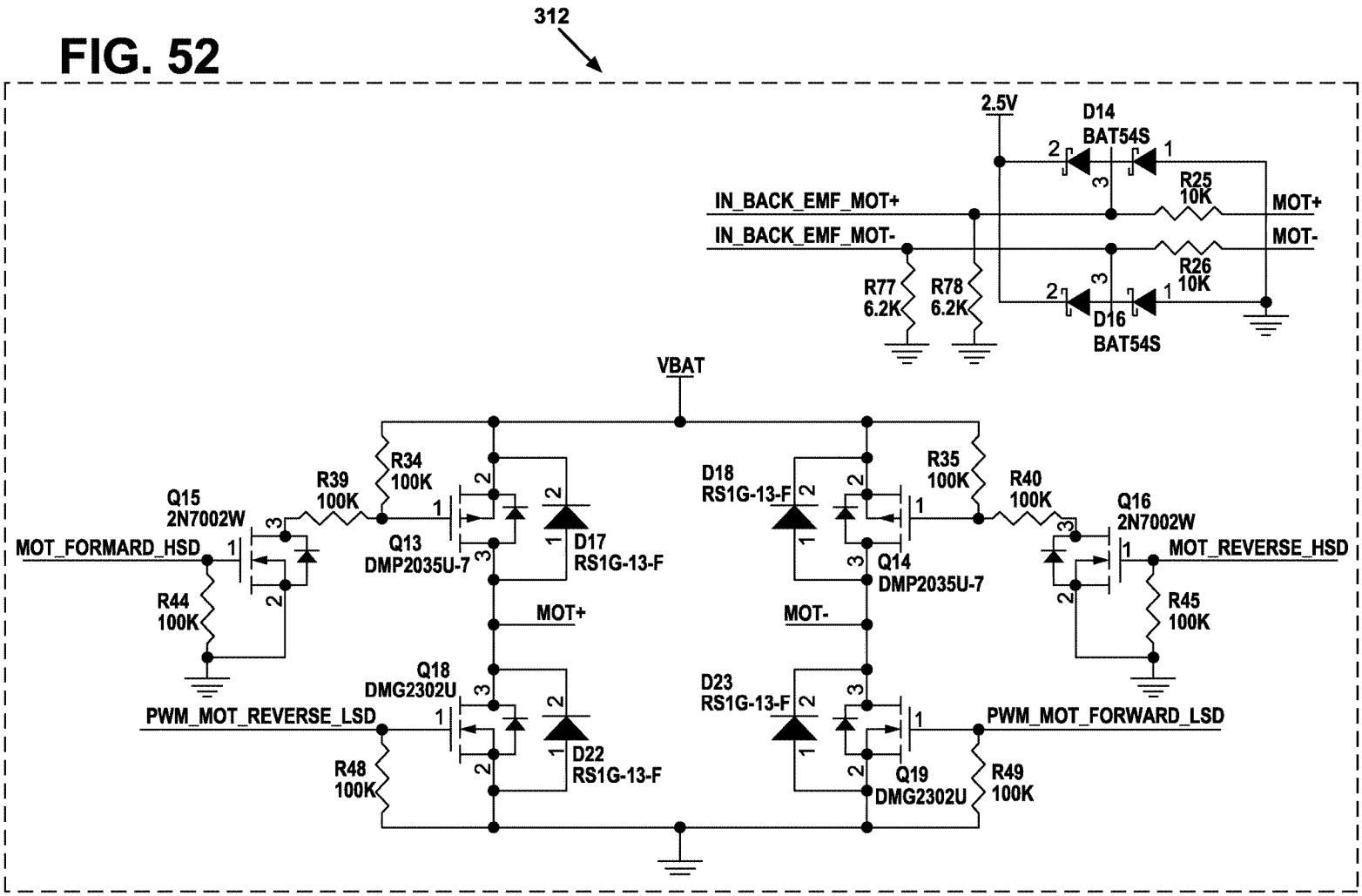
Figure 53:
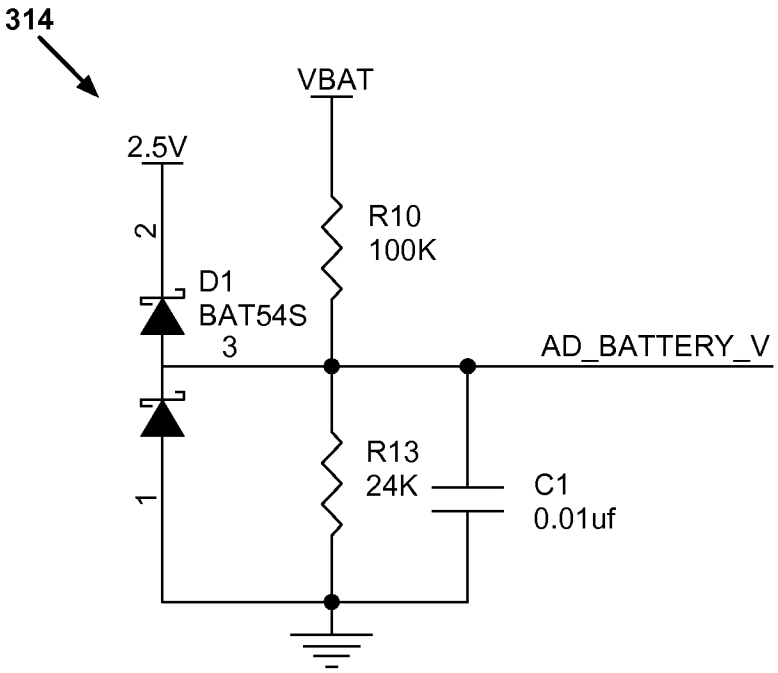
Figure 54:
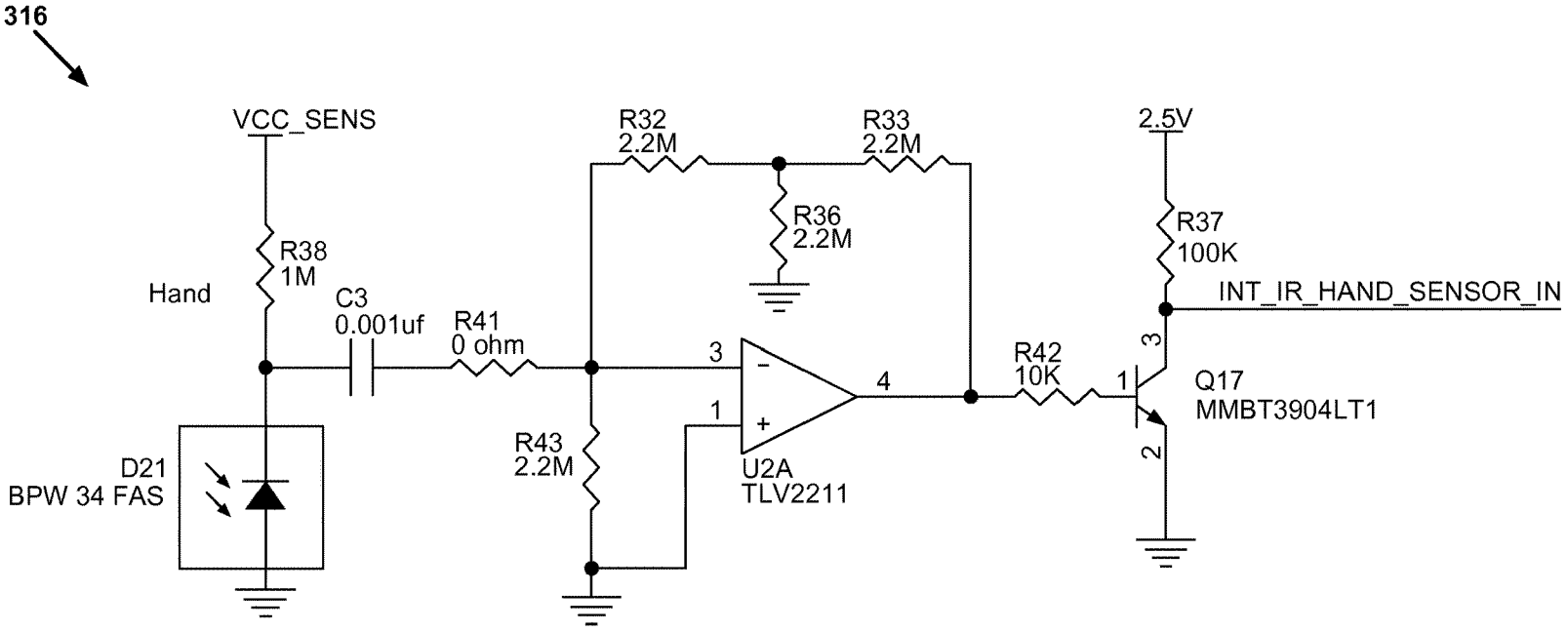
Figure 55:
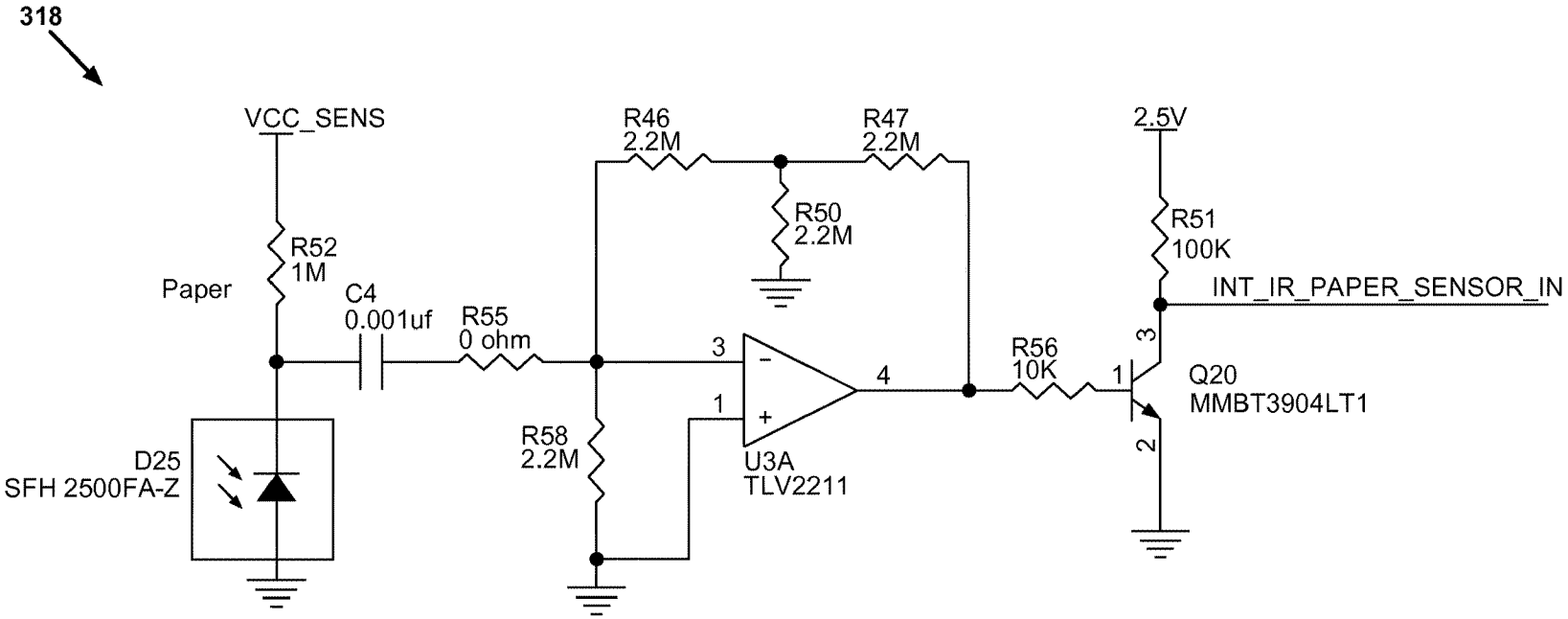
Figure 56:
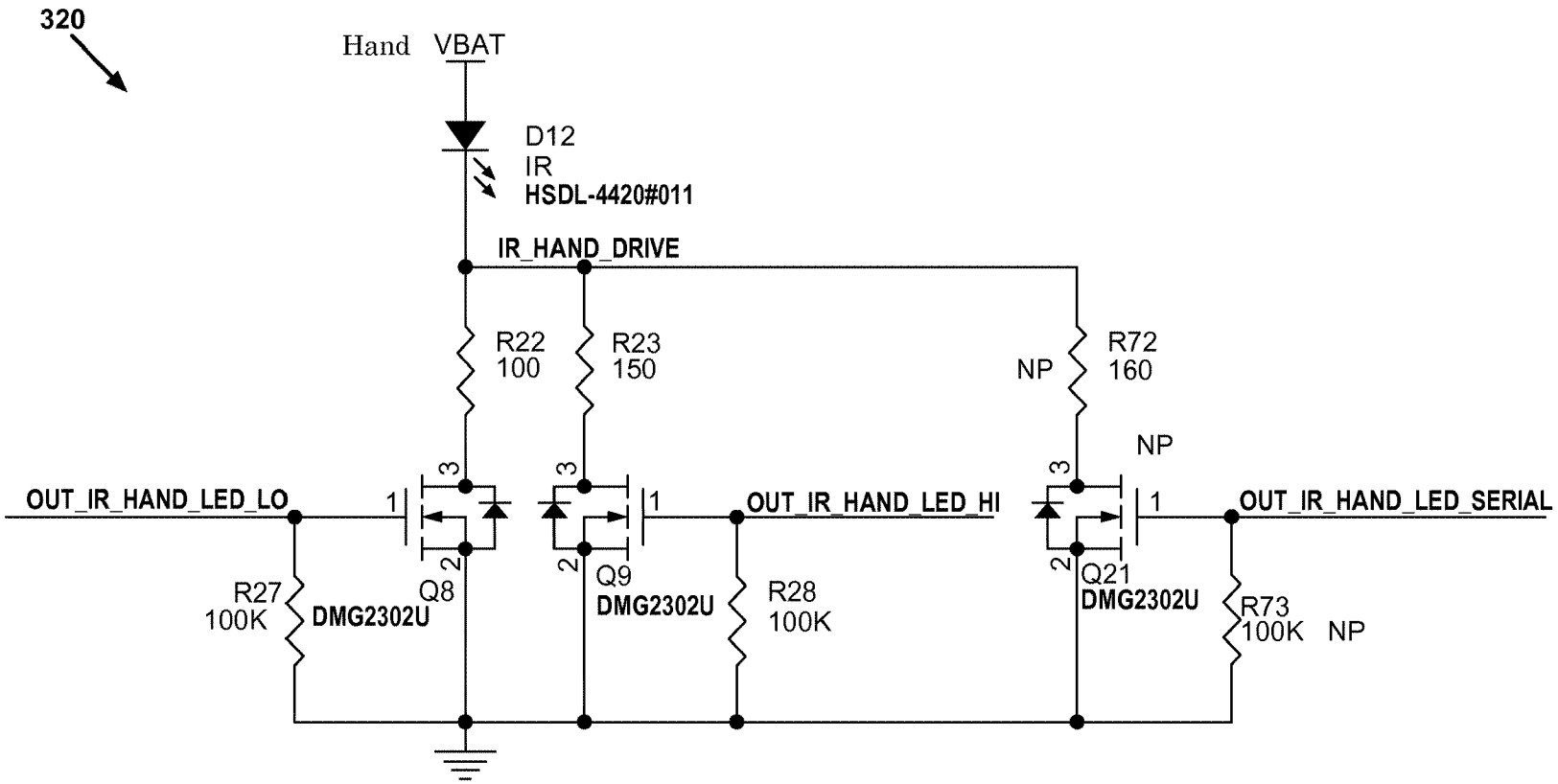
Figure 57:
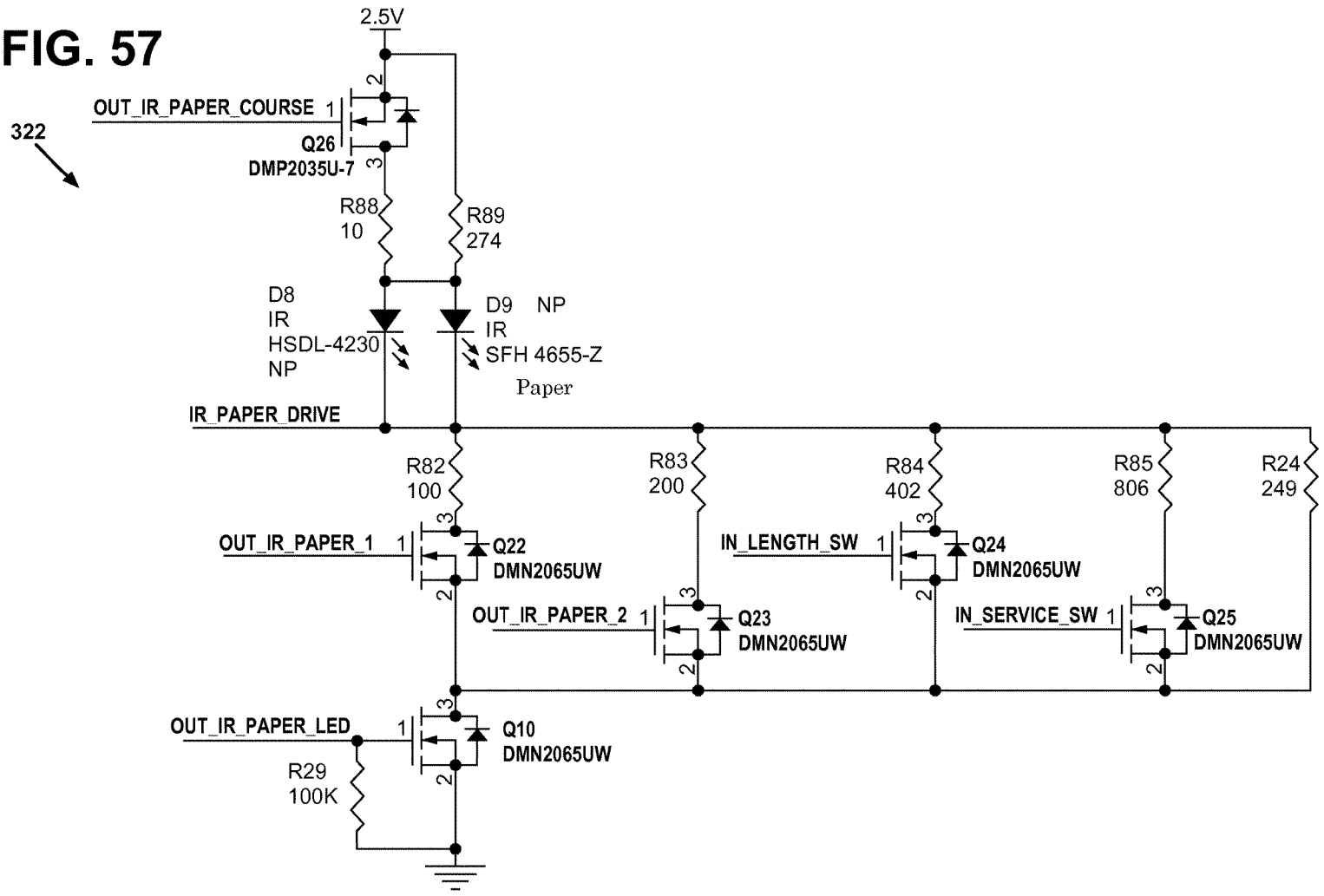
Figure 58:
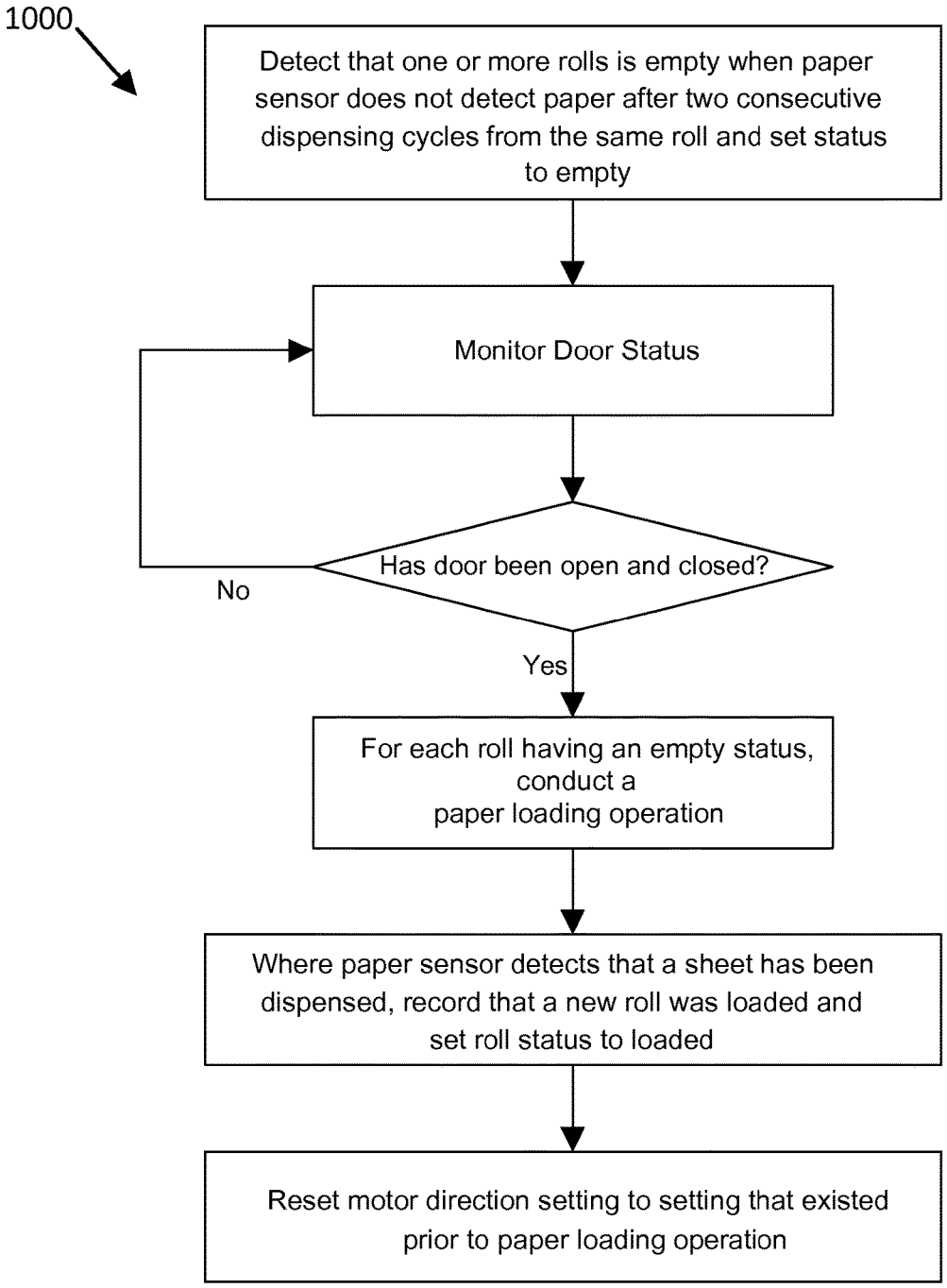
FIG. 58 is a flowchart of a roll status algorithm that can be implemented by the control circuit shown in FIG. 46.

Referring to FIG. 46, a schematic of the control circuit 208 is presented. As shown, the control circuit 208 includes a power supply 302, a microcontroller 304, a debug and communication control circuit 306, an LED light circuit 308, switch input circuits 310, a motor control circuit 312, a battery voltage measurement circuit 314, a hand sensing circuit 316, a paper sensing circuit 318, a hand sensor driver circuit 320, and a paper sensor driver circuit 322. Other circuits, switches, and other features may also be provided with control circuit 208. Furthermore, it is noted that the performance specifications and values cited for the above and below described components associated with the control circuit 208 are only exemplary in nature and are not limiting on the disclosure as other performance specifications and values may be used which may be required for any particular implementation of the disclosed dispenser 10.

Power Supply Circuit 302

Referring to FIG. 47, a schematic diagram for the power supply circuit 302 is presented. In the embodiment shown, the power supply 302 is powered from (4) 1.5V (volt) D-Cell batteries 236, with a nominal input power supply voltage is 6.0V. Power is fed into the board 207 via J4, p1 & p2. The 6.0V supply is fused with a resettable fuse F1. The fused battery voltage (VBAT) supplies the motor control H-Bridge, the Hand Sensor Driver, and the 2.5V regulator.

The input to the 2.5V regulator (VCC) is protected with a reverse-protection diode D26. This diode prevents damage to all remaining circuits should the input battery voltage be reversed. This diode also provides run-time protection for the microcontroller 304 to remain powered even if the input battery voltage momentarily dips below the minimum regulator voltage due to the motor load. The VCC is used to source the hand and paper sensing operating amps U2 and U3, and the photo-diodes. As shown, VCC is low-pass filtered with a 47 ms (millisecond) RC (resistor-capacitor) filter (R81 & C11). This filter is used to prevent false positives on the sensor circuits due to power supply noise. The op-amps are micro-power devices and thus allow the large resistor value in series with their power supply pins. Micro-power devices are also necessary for battery life. The 2.5V regulator VCC is used to power the micro-controller and all remaining circuitry. It is a micro-power device that provides the necessary quiescent battery life.

Microcontroller

Referring to FIG. 48, a schematic diagram for the microcontroller 304 is presented. The microcontroller 304 is for executing the various functions of the dispenser 10, as described herein. One particular example of a microcontroller 304 suitable for use in the dispenser 10 is a Texas Instruments MSP430F2132IPW. In addition to numerous GPIO (general purpose input and output) requirements of the microcontroller 304 to execute the functions described herein, the microcontroller 304 may also be provided with interrupt input pins associated with various components of the dispenser 10, for example, the hand sensor 210, the paper sensor 212, the door switch 19, and the towel length switch 222. Input channels can also be provided, for example, channels associated with the battery voltage, back EMF positive voltage, and the back EMF negative voltage.

As shown, the microcontroller 304 can be reset with a simple RC circuit, R15 & C2. However, an external supervisor circuit could be used, although with increased cost. On occasion, when batteries 236 are changed, the microcontroller 304 may lock up due to an intermediate battery voltage. In these cases, the RC circuit can be configured such that the user need only to simply remove the batteries 236, wait at least 10 seconds, and re-install the batteries 236 to reset the operation of the dispenser 10.

Debug and Communication Circuits 306

Referring to FIG. 49, a schematic diagram for the debug and communication circuits 306 is presented. The debug connection to the microcontroller 304 can be accomplished with a 6-pin 50-mil receptacle J1. Communication with the microcontroller 304 can be accomplished through Texas Instrument's Spy-By-Wire protocol (TEST & RST_NMI). In one aspect, a custom adapter board is required to connect the Texas Instruments emulator pod MSP-FET430UIF through this connector. Alternately, J5 is provided as another connector. This connector isn't a physical connector, rather it's a printed circuit board (PCB) footprint that connects to a pogo-pin style connector (TC2050-IDC-430). The connector is available as a standard component, and plugs directly into the emulator pod.

In addition to the emulator communication, the board and controller provide a Universal Asynchronous Receiver/Transmitter (UART) interface used for board configurations and general data extraction. A dedicated connector, J2, is provided for this purpose. Note that the voltage levels are shown as being 2.5V logic in the exemplary embodiment shown, therefore an external UART transceiver is required between the board and the laptop device. In addition to J2, the UART signals are also routed to the emulator connectors. This allows J2 to be de-populated at a later date, if desired, for cost savings. If these connectors are used, special adapter boards/harnesses must be used for proper signal routing.

LED Light Circuit

Referring to FIG. 50, a schematic diagram for the LED light circuit 308 is presented. As shown, four LEDs D1, D2, D3, D4, and D5 (corresponding to LEDs 226-232 in the other drawings) are used to indicate diagnostic status. The LED's are driven directly by the micro-controller port pins. The LEDs can be used to indicate the current mode of operation that the dispenser 10 is in and also the current status of the dispenser 10. For example, the LEDS 226 and 230 can be used to indicate the selected length of the paper towel 32 dispensed when the door 22 is open. For example, the LED 226 can indicate by flashing when the length of the paper towel 32 is set to the long mode and the LED 230 can be used as an indicator to flash when the length of the paper towel 32 is to the short mode. The LEDs can also be configured to provide an indication as to whether the dispenser is in the valet or on-demand mode. The LEDs can also be configured to indicate a status of the dispenser 10 when the door 22 is in a closed state (as known by switch 19). For example, the LEDs can indicate whether either or both of rolls 50, 52 are empty, whether a fault has been detected, and/or the battery health (i.e. indicate whether batteries have an adequate charge, when they may need to be changed in the near future and/or when they need to be changed immediately).

Switch Input Circuits

Referring to FIG. 51, the switch input circuits 310 are shown in greater detail. As shown, there are 3 switch inputs, all tactile switches. The Service and Length switch are user-actuated for mode control, manual feeding, and for calibration. The door switch is door-actuated for the purpose of detecting when the door is open or closed, for such things as statistics, battery change detection, roll change detection, etc.

Note that the port pins IN_LENGTH_SW and IN_SERVICE_SW are dual purpose. They are used for the aforementioned switch inputs while the door is open, and are used to control paper sensor calibration resistors when the door is closed. Because they control N-Channel FET's for the calibration, the switches use pull-down resistors (as opposed to pull-up resistors) to ensure the FET's are normally off when the switch inputs are used.

Motor Control and Back EMF Measurements

Referring to FIG. 52, the motor control and back EMF measurement circuits 312 are shown in greater detail. As discussed previously with respect to the power supply circuit 302, the dispenser 10 can be configured to use a 6 VDC motor 114. The microcontroller 304 drives the motor 114 with a standard H-bridge circuit, allowing the motor 114 to run in both directions. Thus, this aspect of the design is central to operation of a dual roll dispenser where each roll is driven from the same motor 114, as the motor direction determines which roll is dispensed, top roll 50 or bottom roll 52. As shown, the drive FETs (field-effect transistors) are specified for 3 A (amp) min. This provides adequate derating for the motor 114, which pulls 200 mA-300 mA (milliamp). It also provides headroom, should the motor 114 leads become shorted. The D-Cell alkaline batteries 236 will source around 3 A-4 A in this condition, and the PTC fuse on the battery input should also open up.

Note the net names indicate PWM (pulse width modulation) signals on the low-side drivers (LSD) Q14 & Q19 which would be advantageous for some motor 114 configurations, such as where the target motor voltage is 3 VDC. However, the disclosed 6V motor 114 will enable an increased battery life.

While a PWM signal is not necessary to regulate the motor voltage, a PWM signal is still applied to the LSD. The duty cycle of this signal is always 795 cts/800 cts=99%. The reason for this is to leverage the fly-back voltage phenomenon of the motor. Fly-back diodes (D17, D22, D18, and D23) across the FETS are included in the H-bridge to clamp the fly-back voltage. However, before the diodes can turn on, the battery voltage still spikes above 6V by a finite amount. This increased voltage, in combination with the power supply reverse voltage diode and bulk capacitor (D26 & C8), causes the VCC supply to increase while the motor is running. A 9.1V zener diode (D32) is included across VCC to limit this voltage increase to an allowable level. The increased voltage is a desirable behavior, as it ensures the control circuitry always has adequate voltage while the motor is running, even in low battery conditions.

The motor leads are fed back into 2 A/D channels for the purpose of back EMF voltage measurement. Because the motor is driven with 6V, resistor dividers (R25/R77 & R26/R78) are used to reduce this voltage within the A/D range (2.5V). The back EMF voltage measurement is made by briefly turning off the motor after is has been running, and allow the inertia to continue to spin the motor 114. During this period, the motor 114 acts like a generator, and generates a voltage. This voltage includes sinusoidal spikes at each pole of the motor 114. By knowing how many poles the motor 114 has, and by counting the time between those spikes, one can determine the actual motor speed. This is useful for paper-length regulation. For example, if there is drag on the paper spindle, and the motor is spinning slower than expected, the back-EMF measurement will show longer periods between spikes, and therefore allow the firmware to run the cycle longer to maintain a consistent sheet length.

Battery Voltage Measurement

Referring to FIG. 53, the battery voltage measurement circuit 314 is shown in greater detail. Battery voltage is measured with an A/D channel. Battery voltage is reduced with a resistor divider and fed directly into an A/D channel. The battery voltage measurement is used for diagnostics, and for paper length regulation (along with the aforementioned back-EMF measurement).

Hand and Paper Sensing Circuits

Referring to FIGS. 55 and 56, the hand and paper sensing circuits 316, 318 are shown in greater detail. Hand sensing and paper sensing are accomplished using standard IR PIN photodiodes. The diodes are reverse-biased to a filtered VCC. VCC provides the maximum available voltage to improve sensitivity, and the RC filter on VCC_SENSE provides the necessary filtering to prevent the circuits from falsely tripping due to noise on the battery supply (primarily due to the motor running).

In the embodiment shown, both circuits 316, 318 are identical, and utilize a micro-power op-amp (TLV2211) to amplify the current pulses created by the photodiode when the IR pulses emitted from the LED's are adequately reflected by a hand or by paper back to the photodiode. The circuits are cap-coupled (C3 & C4) and therefore only respond to changes in IR levels, not absolute levels. If the photodiode current is enough, the output of the op-amp will increase above 0.7V, turning on the output NPN transistor, creating an interrupt signal at INT_IR_HAND_SENSOR_IN or INT_IR_PAPER_SENSOR_IN. The amplifier gains used in the circuits 316, 318 are selected to maximize performance of the circuit.

Hand Sensor Driver Circuit

Referring to FIG. 56, the hand sensor driver circuit 320 is shown in greater detail. An IR LED is used to pulse IR light to be reflected by a human hand back to the hand sensor photodiode. The LED current required to do this is fairly large, around 40 mA, and so the LED is supplied directly from the battery voltage, to reduce the load and power dissipation on the 2.5V regulator.

Three LSD's are included as options to turn pulse the LED. Q8 and Q9 are the primary drivers, each using a different resistor to allow different power levels, and thus different hand detection distances, depending on the situation.

The third LSD, Q21, is not currently populated on the PCB. This driver is intended for use with the UART, allowing IR communication between the dispenser and an external IR transceiver. This would provide the ability to communicate with the board without having to physical connect to it with a cable.

Paper Sensor Driver Circuit

Referring to FIG. 57, the paper sensor driver circuit 322 is shown in greater detail. An IR LED is used to pulse IR light to be reflected by paper back to the paper sensor photodiode. In the absence of paper, the IR light will hit the paper chute at approximately the same distance as the paper, and should not reflect back to the sensor. The difference will be that the paper is white or brown, while the chute is black. Therefore, the power output of the LED must be precisely controlled such that it's strong enough to reflect off paper off the top roll 52 and the farther away bottom roll 50, but is too weak to reflect off chute.

In order to maintain this precise control of power, the LED is sourced from the regulated 2.5V supply. Since the distance is low, the power required from the LED is low enough to be powered from the regulator.

Along with the regulated voltage, the LED current can be varied by the micro-controller by switching in different combinations of FET's that switch discrete resistors to provide a total equivalent resistance, and thus a total current. This adjustment is made via (4) LSD FET's (Q22-Q25), and (1) high-side driver (HSD) FET (Q26), for a total of 32 discrete settings. The HSD was targeted as a "coarse" control, for cases where the board is shared with another product that has a significantly closer chute. The LSD's are then intended as the range of calibration for a given dispenser design. Each dispenser must be calibrated to determine the threshold at which no reflection is returned from the black chute. This calibration is saved in the board's data flash for running Once the calibration is set, and the calibration FET's are turned on or off accordingly, a single LSD FET (Q10) is used to actually pulse the LED. This is necessary because the calibration FETS are controlled by more than 1 GPIO register in the microcontroller, meaning they all cannot be changed at the exact same time.

Dispensing Operation Control

In one example, the electronic dual roll paper towel dispenser 10 is affected when a user places an object such as their hands in front of the hand sensor 212. The hand sensor 212 can activate the motor 114 to dispense a predetermined length of the paper towel 32. In certain examples, if the paper sensor 210 is blocked, the hand sensor 212 may not be activated. If the paper sensor 210 is blocked (e.g., paper is already dispensed) the user may be forced to take the paper towel 32 provided or already dispensed before taking another paper towel 32 in order to help reduce waste. In one example, the control circuit 208 can control the "hands-free" operation of the electronic dual roll paper towel dispenser 10.

In one example, the paper sensor 210 can be used to activate the next paper towel 32 after the user takes a previously dispensed paper towel 32. In certain examples, the electronic dual roll paper towel dispenser 10 can dispense from about ten to about twelve inches of paper towel 32 per dispensing cycle. An example switch setting for towel length is disclosed in U.S. Pat. No. 6,988,689 which is hereby incorporated by reference in its entirety.

Status of Rolls Algorithm

In certain examples, the paper sensor 210 can detect if a paper towel 32 is actually dispensed from the upper roll 50 or the lower roll 52 during a dispensing cycle or operation. In one example, the paper sensor 210 can automatically dispense at least one more time if a paper towel 32 is not detected. In some instances, the paper sensor 210 will still not detect a paper towel 32 after dispensing a second time. In such a case, the control circuit 208 can store a status that the roll is empty and change the motor direction setting to reverse the direction of the motor 114 to effectuate dispensing from the other roll, if not also empty. Where an empty roll is detected, one or more of the LEDs can be flashed to indicate that the roll is empty. The control circuit can also include monitoring motor current in conjunction with or as an alternative to using the paper sensor 210. In such an application, the control circuit 208 could monitor for a change in the motor current which could be indicative of a roll becoming empty.

Figure 60:
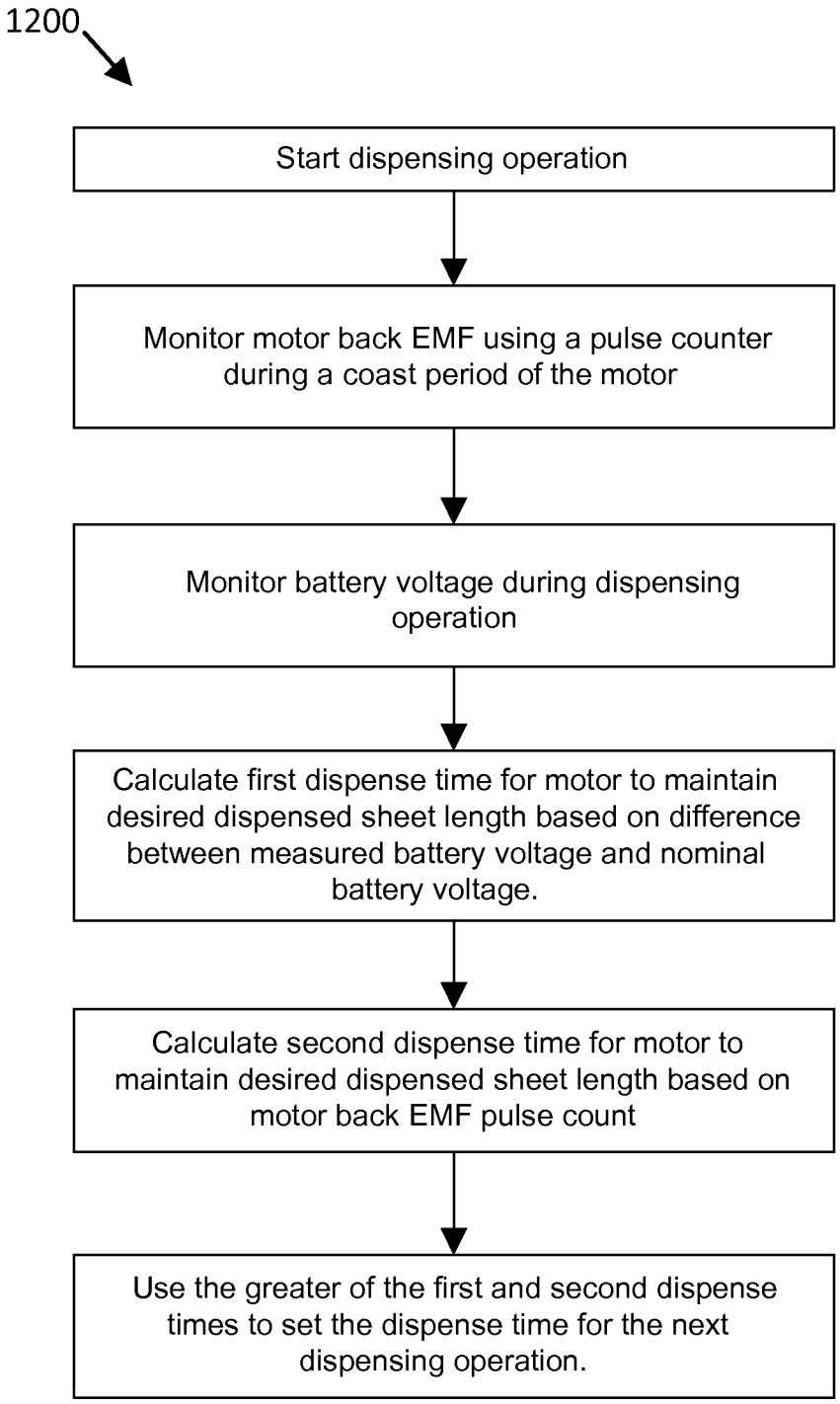
FIG. 60 is a flowchart of a sheet length control algorithm that can be implemented by the control circuit shown in FIG. 46.

As shown at FIG. 60, when the front cover 22 is opened and then closed, the control circuit 208 can be configured to cycle the last emptied roll (i.e., upper or lower drive roller) to dispense a length of paper towel 32 in a paper loading operation. If the paper sensor 210 detects that a paper towel 32 was actually dispensed from that roll, the control circuit 208 can store that either the upper or lower roll 50, 52 has been loaded. Where the motor direction setting is changed in order to cycle the last emptied roll, the motor direction setting can be reset back to the setting that existed prior to the paper loading operation so that the roll that was previously being dispensed can be used until depletion.

For example, a paper loading operation would be commenced where the upper roll 50 is currently being used and the lower roll 52 was previously detected as being empty and the door has been detected as having been open and closed. In such a case, the motor direction setting is changes such that a paper towel 32 is then dispensed from the lower drive roller 132 to determine if a new lower roll 52 has been loaded via the paper sensor 210. Where the paper sensor 210 detects that a paper towel 32 has been dispensed, the control circuit 208 will store that the lower roll 52 has been loaded. Once a user tears off the paper towel 32 from the lower roll 52, the motor direction setting can be changed back to its previous setting such that the next requested cycle can be dispensed from the upper roll 50. Where both rolls 50, 52 were previously empty, the paper sensor 210 can detect that the paper towel 32 from the upper roll 50 has been dispensed. If the upper roll 50 is previously emptied before the front cover 22 is opened and closed, the electronics can detect that both the upper and lower rolls 50, 52 are fully loaded.

The control circuit 208 can be configured to retain information about the loading and dispensing operations that may be helpful in assessing whether the dispenser 10 is being properly maintained. For example, the control circuit 208 can record the number of dispensing cycles from the top roll 50, the number of dispensing cycles from the bottom roll 50, the number of times the door has been opened, the number of times the top roll 50 has become empty, the number of times the bottom roll 50 has become empty, and the number of times both rolls 50, 52 have been empty at the same time.

Jam Detection Algorithm

Figure 59:
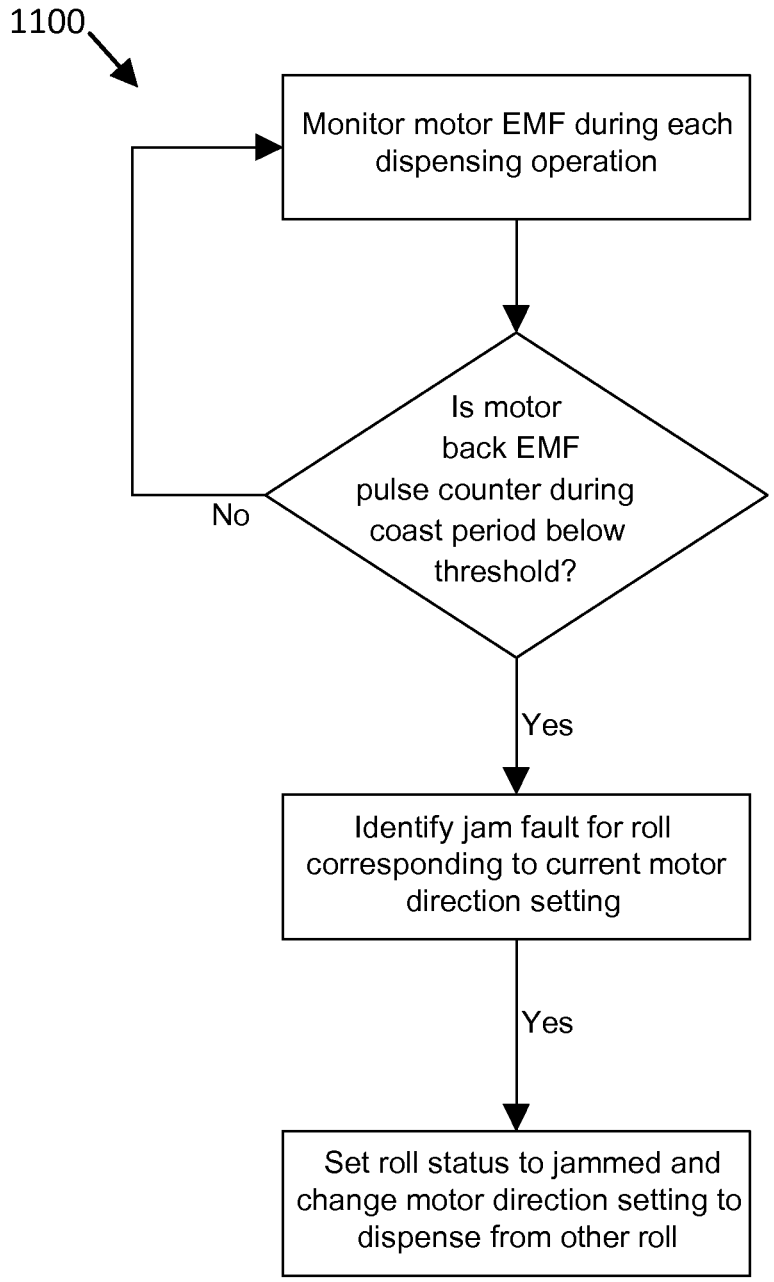
FIG. 59 is a flowchart of a paper jam fault detection algorithm that can be implemented by the control circuit shown in FIG. 46.

In some instances, a paper jam can occur when dispensing paper from one of the rolls 50, 52. As illustrated at FIG. 59, a paper jam can be identified utilizing a paper jam fault detection algorithm 1100. In certain examples, the control circuit 208 can include circuits which monitor and record electromagnetic fields (EMF) generated by the motor 114 when the motor 114 is spinning. The paper jam fault detection algorithm 1100 can include monitoring the back motor EMF and using a pulse counter as a feedback during each dispensing operation. As discussed in more detail in the Sheet Length Control section below, a paper jam fault can be detected when the motor back EMF pulse counter is below a predetermined threshold setting. A paper jam fault can be treated by the control circuit in the same manner as the detection of an empty paper roll, wherein the control circuit 208 changes the motor direction setting to reverse motor operation such that paper from the non jammed roll is dispensed. The control circuit 208 can also store a jammed status for the roll(s) that has been detected as having jam fault. The control circuit 208 can also store the cumulative number of jams for the upper roll 50 and the lower roll 52. In other examples, a safety timer circuit can turn the motor 114 off if a paper jam is detected, for example, if a paper jam is detected at both rolls. The detection algorithm 1100 can also include monitoring motor current in conjunction with or as an alternative to monitoring back motor EMF. In such an application, the control circuit 208 could monitor for a change in the motor current which could be indicative of a paper jam.

Sheet Length Control Algorithm

In certain examples, EMF, battery voltage, and/or current can be used to calculate runtime for the operation of the motor 114 to dispense the desired length of paper towel 32. An example control circuit that monitors EMF is disclosed in U.S. Pat. No. 6,988,689 B2 which is hereby incorporated by reference in its entirety.

The disclosed control circuit 208 includes circuits that allow two different measurements that are useful in controlling sheet length. The first is battery voltage. An attenuator/clamp circuit is included that provides an input to one channel of the microcontroller's A/D converter. The second is motor back EMF. Two attenuator/clamp circuits are included that provide inputs to two channels of the microcontroller's A/D converter. The control circuit 208 can also include monitoring motor current in conjunction with or as an alternative to monitoring voltage and motor back EMF. In such an application, drag on the motor could be calculated using current as a parameter to add another dimension to the estimation of sheet length.

The disclosed design includes a motor 114 H-bridge circuit (see FIG. 52) that allows the microcontroller 304 to control the motor 114. The H-bridge is sourced directly from the raw battery voltage. The battery voltage decreases as the batteries drain over time and use. Therefore, the speed of the motor 114 will drop as the batteries drain.

Sheet length is therefore controlled by varying the amount of time in which the motor 114 is driven. With a fresh set of batteries, the motor 114 will spin the fastest, and therefore the nominal dispense time, DispenseTimenom, will be the shortest for a given length of sheet. As the batteries discharge, the dispense time will increase.

The battery voltage is measured during each dispense cycle under load. Because the motor 114 is the only significant load on the batteries, it is important the measurement is performed during the dispense cycle with the motor 114 energized. Specifically, the firmware in the microcontroller 304 samples this voltage 400 ms after the start of the dispense cycle. Because the motor 114's speed is nominally proportional to voltage provided to it, theoretically the dispense time can be proportionally increased based on the measured battery voltage. Therefore, in an ideal case with no drag, this would be the case of a simple calculation:

$$\text{DispenseTimenew}=\text{DispenseTimenom}*(V\text{batmeas}/6\text{V})$$

Where:

DispenseTimenew is the current dispense cycle time calculation

DispenseTimenom is the nominal dispense time determined for all dispensers with fresh batteries Vbatmeas is the current measured battery voltage 6V is a constant and represents the battery voltage used to determine DispenseTimenom However, drag does exist in the real system, and the motor torque will vary with motor voltage. Therefore, the relationship between motor speed in the dispenser and battery voltage is non-linear. This is best handled in the firmware with a 2-D lookup table. The lookup table implemented in the firmware is:

| Vbatmeas (mV) | Vtarget (mV) |
|---|---|
| 3000 | 9000 |
| 4000 | 7200 |
| 5000 | 6300 |
| 6000 | 6000 |

The first column represents the measured battery voltage. The 2nd column represents a theoretical value necessary adjust the dispense time appropriately given the slower motor 114 speed. The lookup table can be used as a way to simplify the firmware calculations and reduce the math overhead. The calculation follows:

Determine the closest table entry less than the measured battery voltage. Using the corresponding Vtarget from the table, the dispense time is:

DispenseTimenew=DispenseTimenom*(Vtarget/Vbat-meas)

For example, a measured battery voltage of 4.1V (4100 mV) would result is the 3rd table entry, or Vtarget=6300. With a nominal dispense time of 1.11 sec, the adjusted dispense time would then be:

DispenseTimenew=1.11 sec*(6300/4100)=1.71 sec

In this example, the dispense time is increased by 5% over the value that would be calculated by a simple proportion. One can observe by the table this difference increases exponentially as the battery voltage decays.

Although the lookup table was determined empirically on a dispenser, the values can be calculated based on the motor 114 voltage-speed-torque relationship, gear ratio, and roller dimensions.

The only conditions expected to cause motor 114 speed changes are battery voltage decay and/or drag. Both of these conditions cause the motor 114 to spin slower. There are no conditions that will cause the motor 114 to spin faster. Therefore, the battery voltage adjustment on dispense time is only allowed to increase the time, never decrease it.

As mentioned previously, dispense time can also be controlled through back EMF measurement which works by energizing the motor 114 for a period, then removing power and allowing the motor 114 to coast (i.e. spin via inertia only). During this coast period, one of the motor 114 leads is connected to ground, and the other lead is sampled with an A/D converter. The sampling results essentially in a tachometer reading, as the motor 114 brushes spin past the poles and create peaks in a waveform. The coast period is brief, specifically 10 ms, after which the motor 114 is re-energized, and the cycle is completed.

Because the disclosed dispenser 10 uses an H-bridge for forward and reverse control, the hardware must include 2 channels of measurement, 1 for each motor 114 direction. For each given direction, the firmware must determine the correct A/D channel to sample, as well as correctly hold the H-bridge in a state that will not saturate the A/D channel. In one example, the sampled data is saved to a buffer and post-processed after the coast period which allows for easier debugging and analysis.

For a given dispense cycle, the motor 114 is coasted 600 ms after the start of the cycle. Once the coast begins, the A/D is triggered and begins collecting a sample every 100 μs. After 100 samples have been collected (i.e. 10 ms), the motor 114 is re-energized, and the samples are processed.

The firmware processes the data first by counting the total number of pulses detected. It does this by first determining the DC bias of the sampled waveform. The DC bias can be broken up into 2 calculations (e.g. sample #0-63, and sample #36-100) which is helpful for at least a couple of couple reasons. The first is that the DC bias decays with time since the motor 114 coast was started. The second was to eliminate mathematical division in determining the average. Rather, a simple bit shift can be employed as each buffer size is 64 samples. However, this results in overlap in the middle 28 samples, which is made manageable by weighting the averages in the middle of the entire 100 sample buffer.

Using the calculated bias for each section of the buffer, the buffer is then evaluated sample-by-sample. Whenever a zero crossing is detected, a ½ pulse count is accumulated. A zero crossing is defined as any data that exceeds the DC bias by 10 cts or more on the positive side (if the last state was negative), or falls below the DC bias by 10 cts or more on the negative side (if the last state was positive). During this counting of pulses, the sample number of the 4th pulse detection is recorded.

After all of the 100 samples have been evaluated, the resulting pulse counter represents the total number of pulses detected during the coast period. If the total number of pulses counted is less than the jam threshold (nominally 2 pulses), then a jam condition is detected.

The sample number of the 4th pulse, which is equivalent to time, is then used adjust the dispense time. Similar to the battery voltage calculation, the adjusted dispense time is started as nominal value, and is then increased by a proportion of the measured 4th pulse time versus the nominal time.

DispenseTimenew=DispenseTimenom*(Time4thPulsemeas/Time4thPulsenom)

For example, the nominal dispense time is 1.11 sec, the nominal 4th pulse time (sample) is 52, and the measured sample time for the 4th pulse is 73, the adjusted time would then be:

DispenseTimenew=1.11 sec*(73/52)=1.56 sec.

The only conditions expected to cause motor 114 speed changes are battery voltage decay and/or drag. Both of these conditions cause the motor 114 to spin slower. There are no conditions that will cause the motor 114 to spin faster. Therefore, the battery voltage adjustment on dispense time is only allowed to increase the time, never decrease it. For each dispense cycle, both of these calculations are performed. Whichever of the resulting dispense time is greater is the time that is used for that cycle. This dual method approach capitalizes on the advantages provided by each, while reducing the negative aspects of each.

The battery voltage method is advantageous because the measurement itself is stable and repeatable. Given no unusual sources of drag, this method provides consistent results cycle-to-cycle. However, if excess drag is present, this method has no means of compensation, and the resulting sheet would be short. The back EMF method is also advantageous because it is a closed-loop approach, meaning the actual speed of the motor 114 is directly measured and used to adjust the dispense time. However, the measurement itself is not as stable and repeatable as might be ideal, and so there can be a higher degree of cycle-to-cycle variability. Furthermore, as wear occurs within the motor 114 (such as the brushes in a brush-type DC motor), the voltage method can become a more reliable source of data than the back EMF approach over the life cycle of the dispenser 10. The back EMF can also have limited reliability at low motor voltages. As such, the back EMF approach and the voltage approach are complementary to each other.

By performing both calculations, and adjusting the dispense time based on the greater of the two values, greater consistency is achieved for cases of nominal drag, while the closed-loop control will still provide adjustment in cases where the drag exceeds nominal. FIG. 60 shows a flowchart showing this generalized approach in a control algorithm 1200. As importantly, the use of motor voltage and back EMF monitoring eliminates the additional costs associated with additional hardware and controls that would be necessary to install feedback systems to verify sheet length, such as encoders on the drive rolls and/or motor. Accordingly, reliability is also inherently increased by the disclosed system. Where it is necessary to provide an absolute certain sheet length, encoders can be used in conjunction with the above cited method. Additionally, the use of a stepper-type motor which operates only in discrete rotational increments is also possible as well.

Hand Sensor Control and Sensor Backup Algorithms

In certain examples, the paper sensor 210 or the hand sensor 212 may be blocked such that the paper towel 32 may not be dispensed. If the paper sensor 210 or the hand sensor 212 becomes blocked over a predetermined period of time such that the functionality of the paper or hand sensor 210, 212 fails, one sensor can act as a back-up for the other sensor. In other words, if the paper sensor 210 becomes blocked, the hand sensor 212 can be activated to dispense the paper towel 32. In one example, the paper sensor 210 can become blocked by, for example, paper resulting from a bad tear. If the paper sensor 210 is blocked continuously or over a specified period of time or number of cycles, a user can activate the hand sensor 212 which allows the electronic dual roll paper towel dispenser 10 to reset and dispense the paper towel 32 via the hand sensor 212. The reset can then restore the paper sensor 210 to its normal functionality. The paper sensor 210 can also act as a backup for the hand sensor 212, for example, if the hand sensor 212 is inoperative, the dispenser 10 could initiate a dispensing cycle if the paper sensor 210 changes state meaning that a person may be reaching for a sheet 32 within the chute. The dispenser 10 could also be configured to switch modes of operation based on the operating states of the sensors 210, 212. For example, the dispenser 10 could automatically switch to the valet mode if the hand sensor 212 is determined to be non-functional.

In certain examples, the dispense mode switch 224 can be used to change the mode of the electronic dual roll paper towel dispenser 10 between a hand request or sensing mode to a valet mode. In the hand request mode, paper towels 32 are dispensed when the hand sensor 212 detects a person's hand in front of the sensor. In the valet mode, a paper towel 32 is automatically dispensed as soon as the paper sensor 210 detects that a paper towel 32 has been removed. In one example, the LEDs 228, 232 can be used to indicate the mode of the electronic dual roll paper towel dispenser 10 when the front cover 22 is open. The LEDs 228, 232 can flash momentarily when the dispense mode switch 224 is pressed. The LED 228 can be used to indicate the mode status is in the hand sensing mode. The LED 232 can be used to indicate the status of the mode of the electronic dual roll paper towel dispenser 10 is in Valet mode.

An improvement to the valet mode is to allow the hand sensor 212 to signal a dispense after a predetermined time has elapsed with paper blocking the paper sensor 210. This is advantageous in the instance wherein the end user removes the paper 32 prior to completion of the dispense cycle. This is referred to as a mid-cycle tear. When a mid-cycle tear occurs, a short portion of towel will remain under the paper sensor 210. To address this issue, the microcontroller 304 can be configured to allow the hand sensor 212 to activate the next dispense after a predetermined period of time. In valet mode, dispensing can be initiated by either paper removal or hand detection (after a predetermined time). The addition of using the hand sensor 212 in the valet mode acts as a backup signal to the paper sensor 210. If the paper sensor 210 fails to sense the removal of paper 32, the hand sensor 212 will override and activate a dispense cycle. In one aspect, the override operation may be limited by the control circuit. For example, the number of dispensing operations that occur with the hand sensor 212 overriding the paper sensor may be limited to a predefined number when the paper sensor 210 is blocked and then to reset the override function. Another example would be to allow a predetermined number of dispensing cycles to occur without the removal of the sheet 32 and to allow the override operation to occur again only after the sheet 32 has been removed. These approaches would help to limit inadvertent or unintended dispenses.

Paper Sensing Calibration Algorithms

The control circuit 208 can also be configured to automatically calibrate the paper sensor 210 while the dispenser 10 is in service. As mentioned previously, the paper sensor 210 can include an IR emitter 214 that projects light toward the exit chute area 126, 144 and light is reflected from the paper 32 back to an IR receiver 216. In this embodiment, the paper sensor 210 must detect paper 32 coming from roll 50 or roll 52, but not erroneously detect the exit chute 126, 144 as paper.

Figure 61:
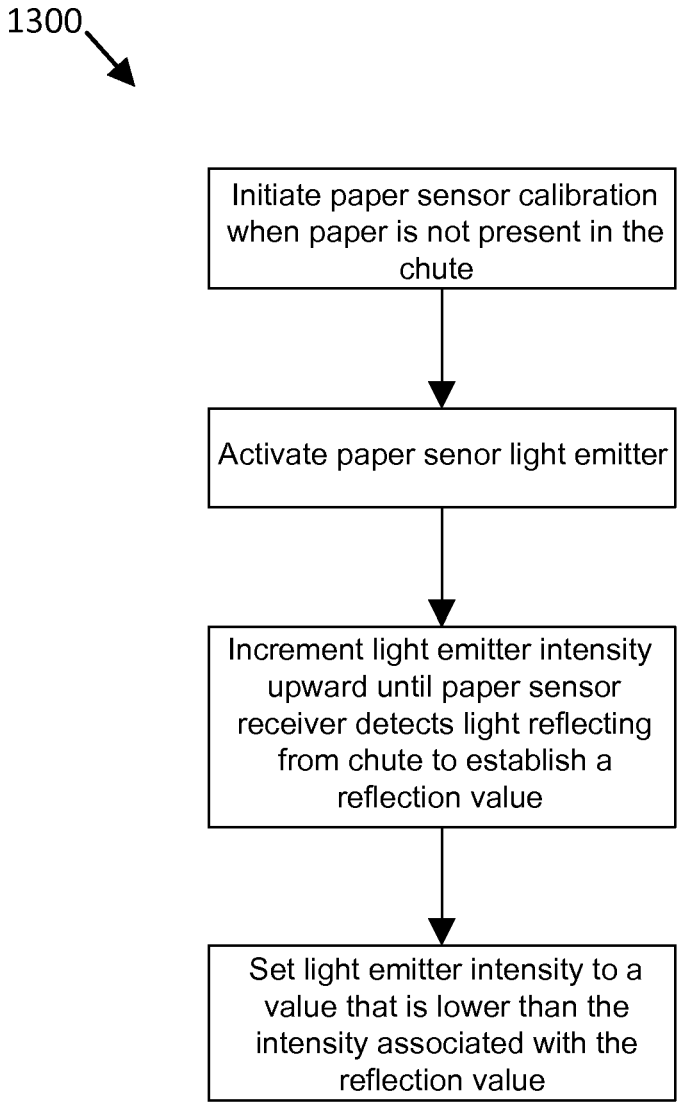
FIG. 61 is a flowchart of a paper sensor calibration algorithm that can be implemented by the control circuit shown in FIG. 46.

Variations in IR emitters and receivers require calibration of the paper sensor 210. As shown at FIG. 61, a control algorithm 1300 for calibrating the paper sensor 210 is presented. In one aspect, the emitted light intensity is increased until the exit chute is detected. This is accomplished by increasing the current supplied to the emitter 214 by reducing the circuit resistance. Once the exit chute 126, 144 is detected, a reflection value is established. The reflection value is then used to select a higher resistance value that will reduce the emitted light intensity such that the exit chute 126, 144 is not detected by the paper sensor system 210. This method allows detection of paper without detecting the exit chute and allows for component variation. In one example, the bottom roll 52 is selected as the roll to feed from for calibration as it is the roll farther away from the sensor 210.

Although initial paper sensor calibration using the above described calibration routine can performed during the manufacturing process of the printed circuit boards (e.g. against a stationary target that emulates the exit chute that is placed in front of the emitter and receiver), additional calibration during use may be required due to changing conditions. For example dust may accumulate on the exit chute 126, 144 or on the paper sensor window that can affect the operability of the paper sensor. To alleviate this circumstance, the above described calibration routine 1300 can be executed based on parameters set within the microcontroller 304 of the control circuit 208.

In one example, the parameter for initiation of the calibration routine 1300 is after the dispenser 10 has dispensed a predetermined number of towels 32. The routine 1300 requires the paper sensor state to change to ensure paper 32 is not under the sensor when the routine 1300 is commenced. To improve accuracy, the calibration routine 1300 can be performed on a predetermined number of consecutive dispenses. The advantage of this type of automatic calibration is it compensates automatically for changing conditions.

In one example, the parameter can be the activation of one or more tactile switches by a user such that the routine 1300 is initiated manually. In such an approach, the microcontroller 304 can be configured to cycle the power to the circuit board 207 and to verify that a zero in the motor run counter exists and that paper is not present in the exit chute 126, 144. The advantage of this type of manually initiated calibration is a provision for addressing issues with paper sensing.

Hand Sensing Range Reduction Algorithm

Figure 62:
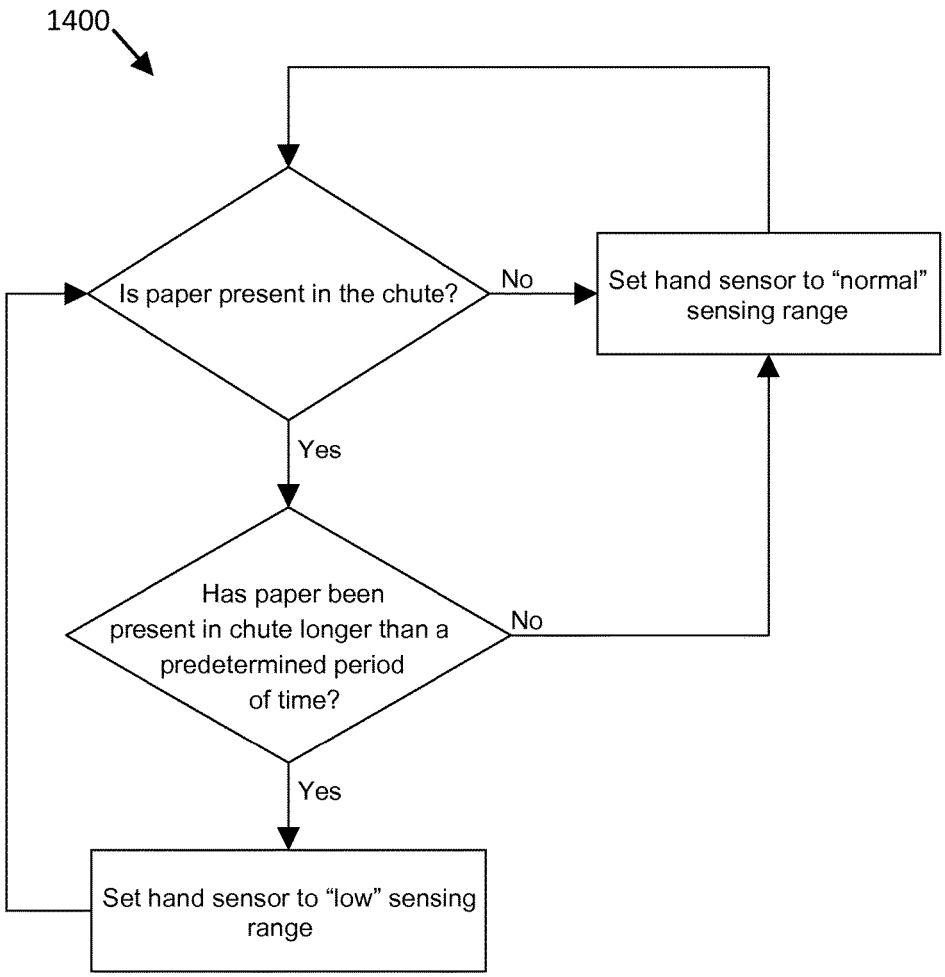
FIG. 62 is a flowchart of a hand sensor calibration algorithm that can be implemented by the control circuit shown in FIG. 46.
Figure 64:
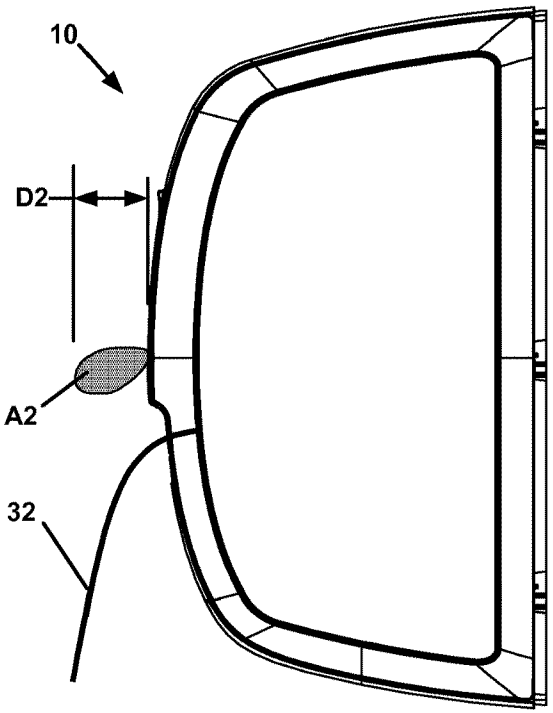
FIG. 64 is a schematic side view of the dispenser of FIG. 1 with the hand sensor calibrated to a "low" sensing range.
Figure 63:
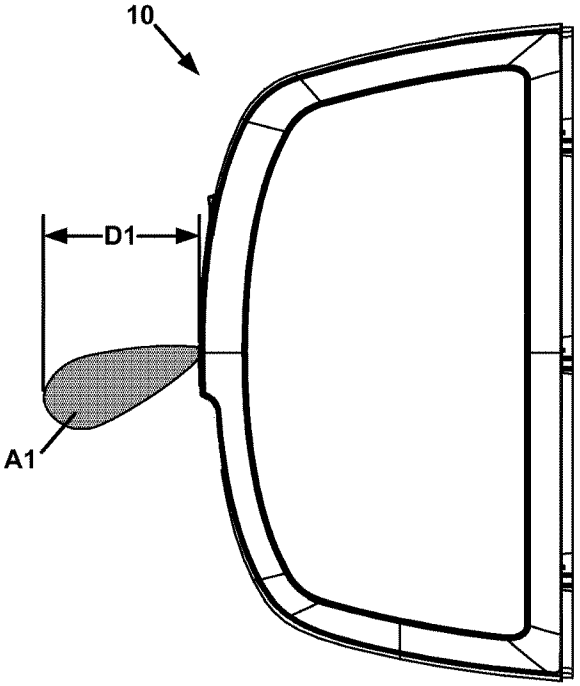
FIG. 63 is a schematic side view of the dispenser of FIG. 1 with the hand sensor calibrated to a "normal" sensing range.

The control circuit 208 can be configured to initiate different sensing ranges associated with the hand sensor 212 to minimize and/or prevent the occurrence of inadvertent actions causing a paper towel 32 to be dispensed. In one example, the microcontroller 304 is configured with a hand sensing range reduction routine 1400, as shown at FIG. 62. The hand sensing range reduction routine 1400 configures the hand sensor 212 to operate in either a "normal" sensing range area A1 and distance D1, as shown at FIG. 63 or a "low" sensing range area A2 and distance D2, as shown at FIG. 64.

Normal hand sensing range D1 is approximately 3-4" from the face of the dispenser 10. The dispenser 10 controls use the "normal" range D1 unless a towel 32 has been dispensed and is detected by the paper sensor 210. If the towel 32 is not removed, after a predetermined time, then the microcontroller 304 switches to a "low" sensing range D2. The "low" sensing range D2 distance is approximately 50% of the "normal" range distance D1 The dispenser 10 will remain in "low" sensing range D2 until the towel 32 is removed and the paper sensor is cleared.

As stated previously, the hand sensor 212 can be configured to include an IR emitter 218 and an IR receiver 220. In one aspect, resistors in the hand sensor emitter circuit are selectively used to control the amount of current to the emitter 218 and thus control the sensing range. Selectively controlling the resistance can be accomplished by using multiple resistors or using an adjustable resistor. Resistors can be used individually, in series or parallel combinations to selectively control the current and light emitted from the emitter.

The microcontroller 304 logically controls the emitter 218 based on the state of the paper sensor, elapsed time since the last dispense and the voltage from the power source. As the voltage decreases, the low range resistance setting is decreased; this compensation allows the hand sensor to continue to detect hands at low voltage. The range reduction method 1400 can be utilized in multiple dispensing modes, for example, the previously described on-demand mode and the valet mode.

Advantages of the electronic hand sensing range reduction algorithm 1400 are that the sensing range occurs automatically without additional hardware being required, unsightly housekeeping issues are minimized or eliminated, and waste from inadvertent dispense activations is minimized or eliminated.

Battery Condition Monitoring Algorithm

In one example, the electronics can turn on the LEDS 226, 230 to indicate the condition of the battery. The LEDS 226, 230 can indicate a status of low battery or good battery when the front cover 22 is closed. The LED 226 is the status indicator for a good battery. The LED 226 can flash at a predetermined frequency when the battery is good. The LED 230 is the status indicator for a low battery. The LED 230 can flash at a predetermined frequency when the battery is low. A low battery can be indicated by determining the cycle time between turning the motor 114 on and receiving input from the switch 19. In one example, if the cycle time is greater than a predetermined time, such as between 1-2 seconds, or 0.2 seconds, the low battery LED is illuminated, thereby providing an indication that the battery needs replacement.

In certain examples, the electronics can turn on the LEDS 228, 232 to indicate whether service is required. The LED 228 can be illuminated and flash at some frequency when service is not required (e.g., when a roll is not empty). The LED 232 can be illuminated and flash at some frequency when service is required (e.g., when a roll is empty). Example switches are disclosed in U.S. Pat. No. 7,325,767 B2 which is hereby incorporated by reference in its entirety.

From the forgoing detailed description, it will be evident that modifications and variations can be made without departing from the spirit and scope of the disclosure.

What is claimed is:

1. A dual roll paper towel dispenser comprising:

(a) a dispenser housing constructed to receive a first roll of paper and a second roll of paper wherein the first roll of paper and the second roll of paper are vertically arranged so that the first roll of paper is located vertically above the second roll of paper when the dispenser is mounted on a wall, and comprising a dispenser opening for dispensing paper from the first roll of paper and the second roll of paper;

(b) a first mandrel for holding the first roll of paper within the dispenser housing and a second mandrel for holding the second roll of paper within the housing; and (c) a dispenser mechanism comprising:

(i) a first drive roller and a first nip roller for dispensing paper from the first roll of paper through the dispenser opening;

(ii) a second drive roller and a second nip roller for dispensing paper from the second roll of paper through the dispenser opening; and (iii) a single motor for powering the first drive roller and the second drive roller, the single motor rotating in a first rotational direction to power the first drive roller, the single motor rotating in a second rotational direction opposite the first rotational direction to power the second drive roller.

2. A dispenser according to claim 1, wherein the dispenser housing comprises a front wall containing the dispenser opening, and side walls including a door for servicing the dispenser.

3. A dispenser according to claim 2, wherein the dispenser mechanism is located in a space within the housing between a deepest part of the first roll of paper and a deepest part of the second roll of paper and between the front wall of the housing and both the first roll of paper and the second roll of paper.

4. A dispenser according to claim 1, further comprising:

(a) a sensor for detecting the presence of an object and generating a signal;

(b) a power supply for powering the dispenser mechanism; and (c) a control circuit for receiving the signal from the sensor and controlling the power supply to the dispenser mechanism.

5. A dispenser according to claim 1, wherein paper from the first roll of paper is fed downwardly through the first drive roller and the first nip roller, and paper from the second roll of paper is fed upwardly through the second drive roller and the second nip roller.

6. A dispenser according to claim 1, further comprising:

(a) feeder assembly for assisting loading of paper from the second roll of paper to between the second drive roller and the second nip roller.

7. A dispenser according to claim 1, further comprising:

(a) first chute constructed to deliver paper front between the first drive roller and the first nip roller to the dispenser opening; and (b) a second chute constructed to deliver paper from between the second drive roller and the second nip roller to the dispenser opening.

8. A dispenser according to claim 1, wherein the dispenser is constructed to dispense paper from the first roll of paper through the dispenser opening while paper from the second roll of paper is located between the second drive roller and the second nip roller.

9. A dispenser according to claim l, wherein the dispenser is constructed to dispense paper from the second roll of paper through the dispenser opening while the paper from the first roll of paper is located between the first drive roller and the first nip roller.

10. A dual roll paper towel dispenser comprising:

(a) a dispenser housing constructed to receive a first roll of paper on an upper mandrel and a second roll of paper on a lower mandrel;

(b) a dispenser mechanism comprising:

(i) a first drive roller for dispensing paper from the first roll of paper;

(ii) a second drive roller for dispensing paper from the second roll of paper; and (iii) a drive system including a motor for selectively operating the first drive roller and the second drive roller, the drive system powering the motor in a first rotational direction to actuate the first drive roller, the drive system powering the motor in a second rotational direction opposite the first rotational direction to actuate the second drive roller.

11. The dual roll paper towel dispenser of claim 10, further comprising:

(a) a paper sensor for detecting and generating a signal when the first roll is empty and when the second roll is empty;

(b) a power supply for powering the dispenser mechanism motor; and (c) a control circuit for receiving the signal from the sensor and controlling the power supply to the dispenser mechanism motor, the control circuit including a motor direction setting.

12. The dual roll paper towel dispenser of claim 11, wherein:

(a) the control circuit sets the motor direction setting to the first rotational direction until the first roll of paper has been detected as being empty and then sets the motor direction setting to the second rotational direction to dispense from the second roll of paper.

13. A method of dispensing towel from a dual roll paper towel dispenser comprising:

(a) arranging a first roll of paper on a first mandrel and arranging a second roll of paper on a second mandrel, wherein:

(i) the dispenser is mounted on a wall;

(ii) the first roll of paper and the second roll of paper are located within a dispenser housing having a dispenser opening in a front wall of the housing;

(iii) the dispenser includes a dispenser mechanism comprising a first drive roller and a first nip roller, and a second drive roller and a second nip roller; and (iv) paper from the first roll of paper is located between the first drive roller and the first nip roller, and paper from the second roll of paper is located between the second drive roller and the second nip roller; and (b) dispensing the paper from the first roll of paper through the dispenser opening or dispensing the paper from the second roll of paper through the dispenser opening by using a single motor to power the first drive roller and the second drive roller, the single motor rotating in a first rotational direction to power the first drive roller, the single motor rotating in a second rotational direction opposite the first rotational direction to power the second drive roller.

14. A dual roll paper towel dispenser comprising:

(a) a dispenser housing, constructed to receive a first roll of paper and a second roll of paper wherein the first roll of paper and the second roll of paper are vertically arranged so that the first roll of paper is located vertically above the second roll of paper when the dispenser is mounted on a wall, and comprising a dispenser opening for dispensing paper from the first roll of paper and the second roll of paper;

(b) a first mandrel for holding the first roll of paper within the dispenser housing and a second mandrel for holding the second roll of paper within the housing;

(c) a dispenser mechanism comprising:

(i) a first drive roller and a first nip roller for dispensing paper from the first roll of paper through the dispenser opening;

(ii) a second drive roller and a second nip roller for dispensing paper from the second roll of paper through the dispenser opening; and (iii) a single motor for powering the first drive roller and the second drive roller; and (d) a cam stop and roller gear located on the upper and lower drive rollers, the cam stop comprising:

(i) a lock having a driving surface and a locking surface, (ii) a pivot pin adjacent to the lock, wherein the lock and pivot pin are on a first surface of the cam stop; and (iii) a post on a second side of the cam stop, wherein the second side is opposite the first side;

wherein the cam stop interacts with the roller gear of the dispenser, the roller gear including:

(i) a ring opening; and (ii) a slot constructed between the ring opening;

wherein the roller gear drives the cam stop by the slot of the roller gear interacting with the post of the cam stop; and wherein the cam stop is free to rotate about the pivot pin with limitations imposed by the slot on the roller gear and the lock.

15. A dispenser according to claim 14, further comprising:

(a) a sensor for detecting the presence of an object and generating a signal;

(b) a power supply for powering the dispenser mechanism; and (c) a control circuit for receiving the signal from the sensor and controlling the power supply to the dispenser mechanism.

16. A dispenser according to claim 14, wherein paper from the first roll of paper is fed downwardly through the first drive roller and the first nip roller, and paper from the second roll of paper is fed upwardly through the second drive roller and the second nip roller.

17. A dispenser according to claim 14, further comprising:

(a) feeder assembly for assisting loading of paper from the second roll of paper to between the second drive roller and the second nip roller.

18. A dual roll paper towel dispenser comprising:

(a) a dispenser housing constructed to receive a first roll of paper on an upper mandrel and a second roll of paper on a lower mandrel;

(b) a dispenser mechanism comprising:

(i) a first drive roller for dispensing paper from the first roll of paper;

(ii) a second drive roller for dispensing paper from the second roll of paper; and (iii) a drive system including a motor for selectively operating the first drive roller and the second drive roller, the drive system powering the motor in a first rotational direction to actuate the first drive roller, the drive system powering the motor in a second rotational direction opposite the first rotational direction to actuate the second drive roller; and (c) a drive gear train including a first drive gear, a second drive gear, an upper roller gear and a lower roller gear, the first and second drive gears being mounted to a shaft of the motor, the upper roller gear being mounted to a shaft of the upper drive roller and being operated by the first drive gear, the lower roller gear being mounted to a shaft of the lower driver roller and being operated by the second drive gear.

19. The dual roll paper towel dispenser of claim 18, further comprising:

(a) an idler gear intermeshed with the first drive gear and the upper roller gear such that the upper roller gear rotates in the first rotational direction when the motor is operated in the first rotational direction.

20. The dual roll paper towel dispenser of claim 19, wherein the second drive gear is intermeshed with the lower roller gear such that the second drive gear rotates in the first rotational direction when the motor is operated in the second rotational direction.

21. The dual roll paper towel dispenser of claim 18, wherein:

(a) torque from the motor shaft is only transmitted to the first drive gear when the motor is driven in the first rotational direction; and (b) torque from the motor shaft is only transmitted to the second drive gear when the motor is driven in the second rotational direction.

22. The dual roll paper towel dispenser of claim 21, wherein:

(a) the first drive gear includes a first one-way clutch bearing mounted to the motor shaft; and (b) the second drive gear includes a first one-way clutch bearing mounted to the motor shaft.

* * * * *